US009436119B1

(12) United States Patent
Iikura et al.

(10) Patent No.: US 9,436,119 B1
(45) Date of Patent: Sep. 6, 2016

(54) IMAGE FORMING APPARATUS HAVING A REMOVABLE UNIT WITH A DRIVING PORTION

(71) Applicant: FUJI XEROX CO., LTD., Tokyo (JP)

(72) Inventors: Kazuaki Iikura, Yokohama (JP); Kaoru Watanabe, Yokohama (JP); Kazuhiro Saito, Yokohama (JP); Lei Yuan, Yokohama (JP); Satoshi Miyawaki, Yokohama (JP); Atsuna Saiki, Yokohama (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/809,773

(22) Filed: Jul. 27, 2015

(30) Foreign Application Priority Data

Mar. 19, 2015 (JP) ..... 2015-056683

(51) Int. Cl.
*G03G 15/00* (2006.01)
*G03G 21/18* (2006.01)
*G03G 15/04* (2006.01)

(52) U.S. Cl.
CPC ..... *G03G 15/04036* (2013.01)

(58) Field of Classification Search
CPC ..... G03G 15/04036
USPC ..... 399/110, 111, 118
See application file for complete search history.

(56) References Cited

U.S. PATENT DOCUMENTS 8,311,440 B2 * 11/2012 Tidrick ..... G03G 15/0896 399/111
8,521,061 B2 * 8/2013 Sato ..... G03G 21/1846 399/110

FOREIGN PATENT DOCUMENTS

JP 2014-157365 A 8/2014

* cited by examiner

*Primary Examiner* — William J Royer
(74) *Attorney, Agent, or Firm* — Oliff PLC

(57) ABSTRACT

An image forming apparatus includes the following elements. A housing includes a mounting unit. A removable unit includes at least a photoconductor drum and is mounted on and dismounted from the mounting unit. An exposure device includes a light-emitting source and is fixed to the mounting unit such that the exposure device pivots about a pivot point in directions in which it approaches and separates from the photoconductor drum. The exposure device includes a driven portion at an end on an upstream side in an inserting direction of the removable unit. The driven portion is driven to move the exposure device in a direction in which it approaches the photoconductor drum. The removable unit includes a driving portion at the end on the upstream side. The driving portion contacts and drives the driven portion to move the exposure device in the direction in which the exposure device approaches the photoconductor drum.

8 Claims, 49 Drawing Sheets

IMAGE FORMING APPARATUS HAVING A REMOVABLE UNIT WITH A DRIVING PORTION

CROSS-REFERENCE TO RELATED APPLICATIONS

This application is based on and claims priority under 35 USC 119 from Japanese Patent Application No. 2015-056683 filed Mar. 19, 2015.

BACKGROUND

Technical Field

The present invention relates to an image forming apparatus.

SUMMARY

According to an aspect of the invention, there is provided an image forming apparatus including the following elements. A housing includes a mounting unit. A removable unit includes at least a photoconductor and is mounted on and dismounted from the mounting unit as a result of being inserted into and being removed from the mounting unit in a direction along an axial direction of the photoconductor. An exposure device includes a light-emitting source disposed along the axial direction of the photoconductor and is fixed to the mounting unit in a state in which the exposure device pivots about a pivot point, which is provided on a downstream side in an inserting direction of the removable unit, in directions in which the exposure device approaches and separates from the photoconductor of the removable unit. The exposure device includes a driven portion at an end on an upstream side in the inserting direction of the removable unit. The driven portion is driven so as to move the exposure device in a direction in which the exposure device approaches the photoconductor. The removable unit includes a driving portion at the end on the upstream side in the inserting direction of the removable unit. The driving portion contacts the driven portion of the exposure device and drives the driven portion so as to move the exposure device in the direction in which the exposure device approaches the photoconductor.

BRIEF DESCRIPTION OF THE DRAWINGS

An exemplary embodiment of the present invention will be described in detail based on the following figures, wherein.

DETAILED DESCRIPTION

A mode for carrying out the invention (hereinafter referred to as an "exemplary embodiment") will be described below with reference to the accompanying drawings.

Exemplary Embodiment

FIGS. 1 through 6 illustrate an image forming apparatus 1 according to an exemplary embodiment.

Figure 1:
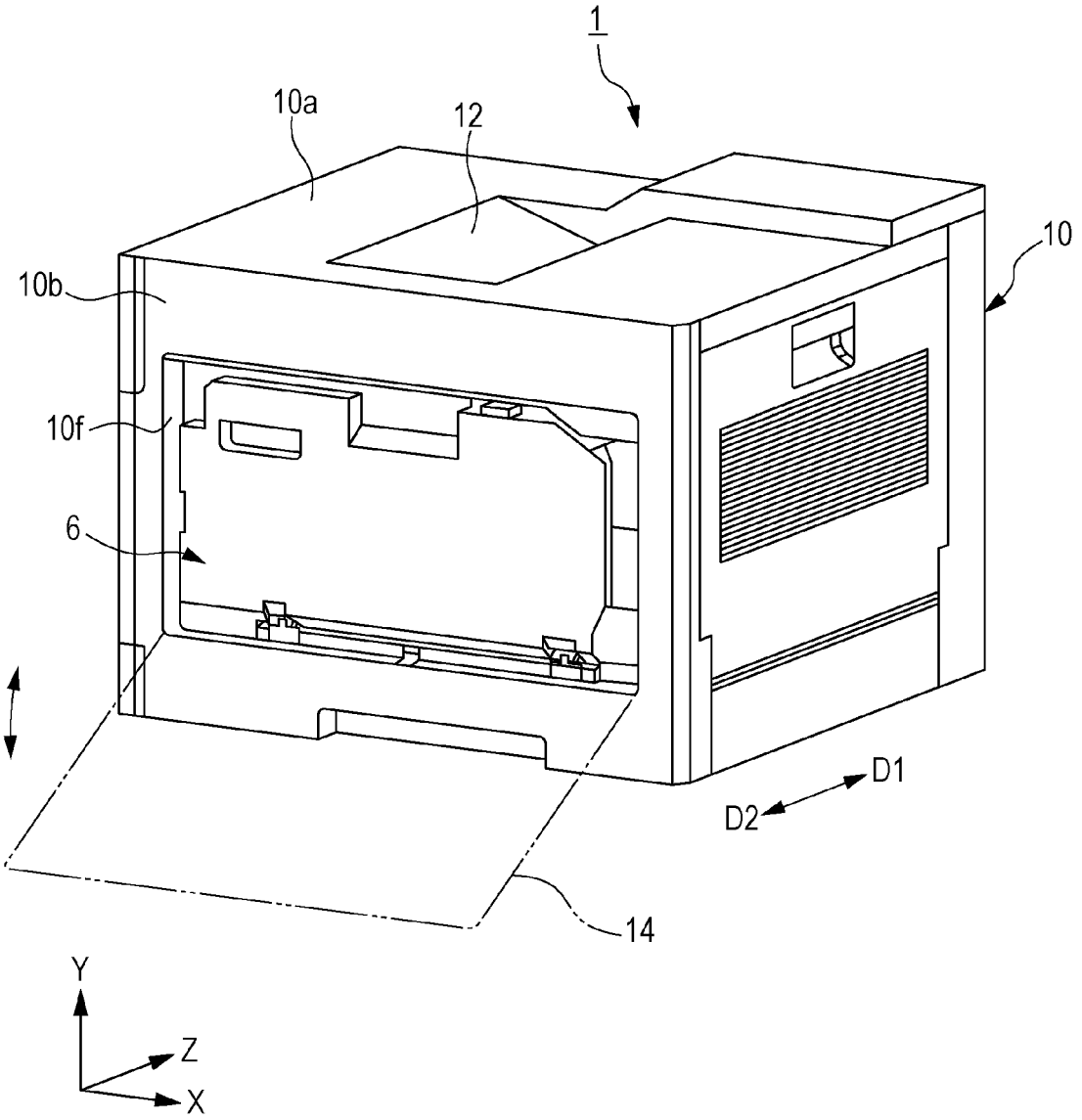
FIG. 1 is a perspective view illustrating the external appearance of an image forming apparatus according to an exemplary embodiment.
Figure 2:
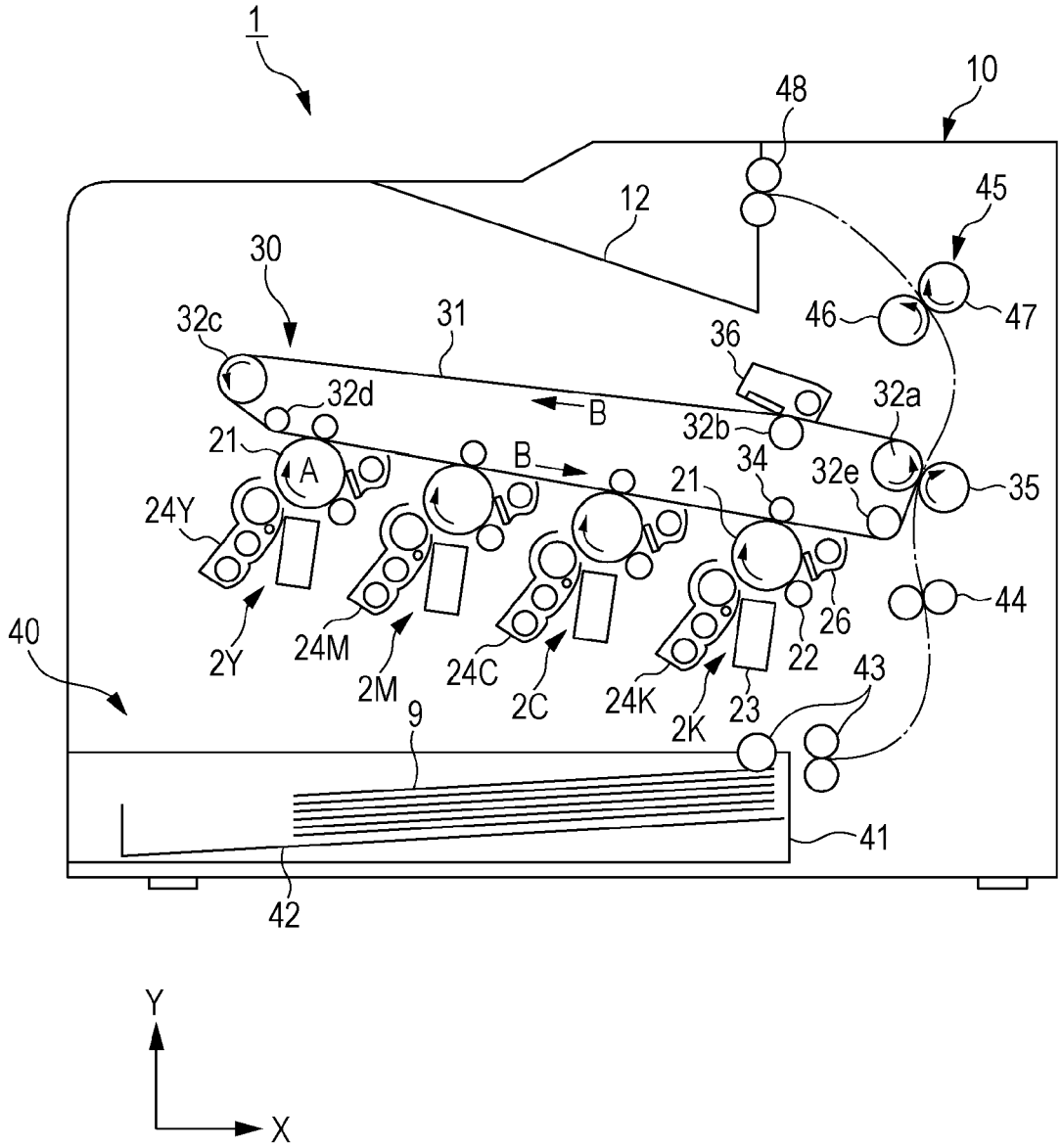
FIG. 2 is a schematic view illustrating the internal configuration of the image forming apparatus shown in FIG. 1.
Figure 3:
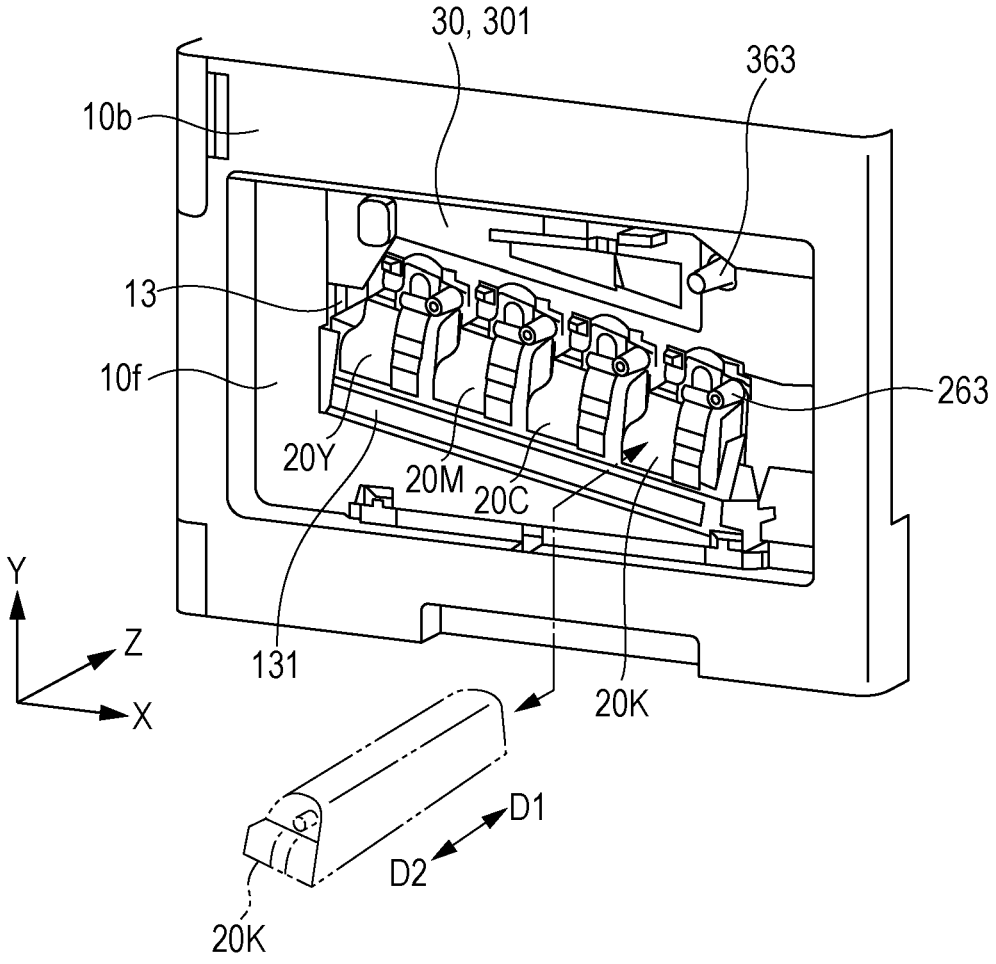
FIG. 3 is a perspective view illustrating a removable unit to be mounted on or dismounted from the image forming apparatus shown in FIG. 1 and a mounting state thereof.
Figure 4:
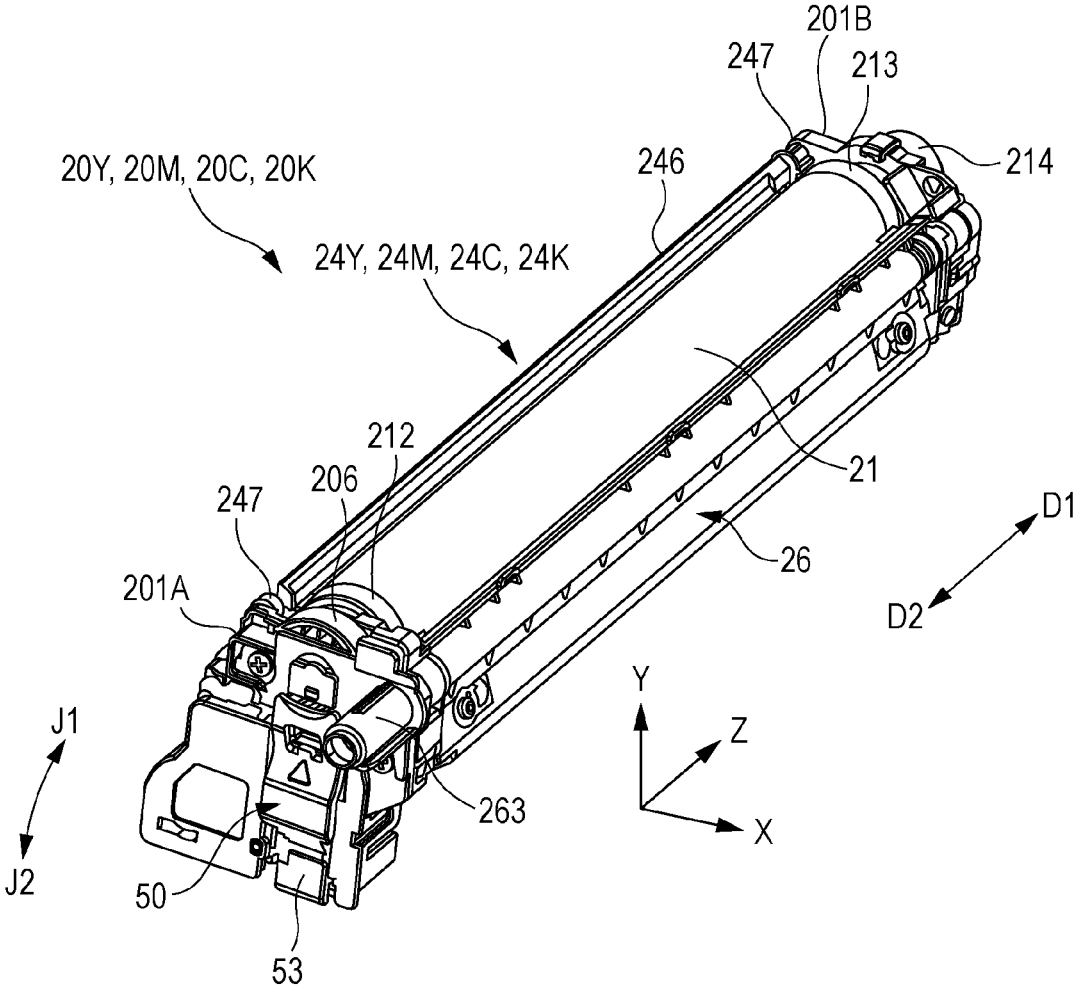
FIG. 4 is a perspective view illustrating the removable unit shown in FIG. 3, as viewed from the near end of the inserting direction of the removable unit.
Figure 5:
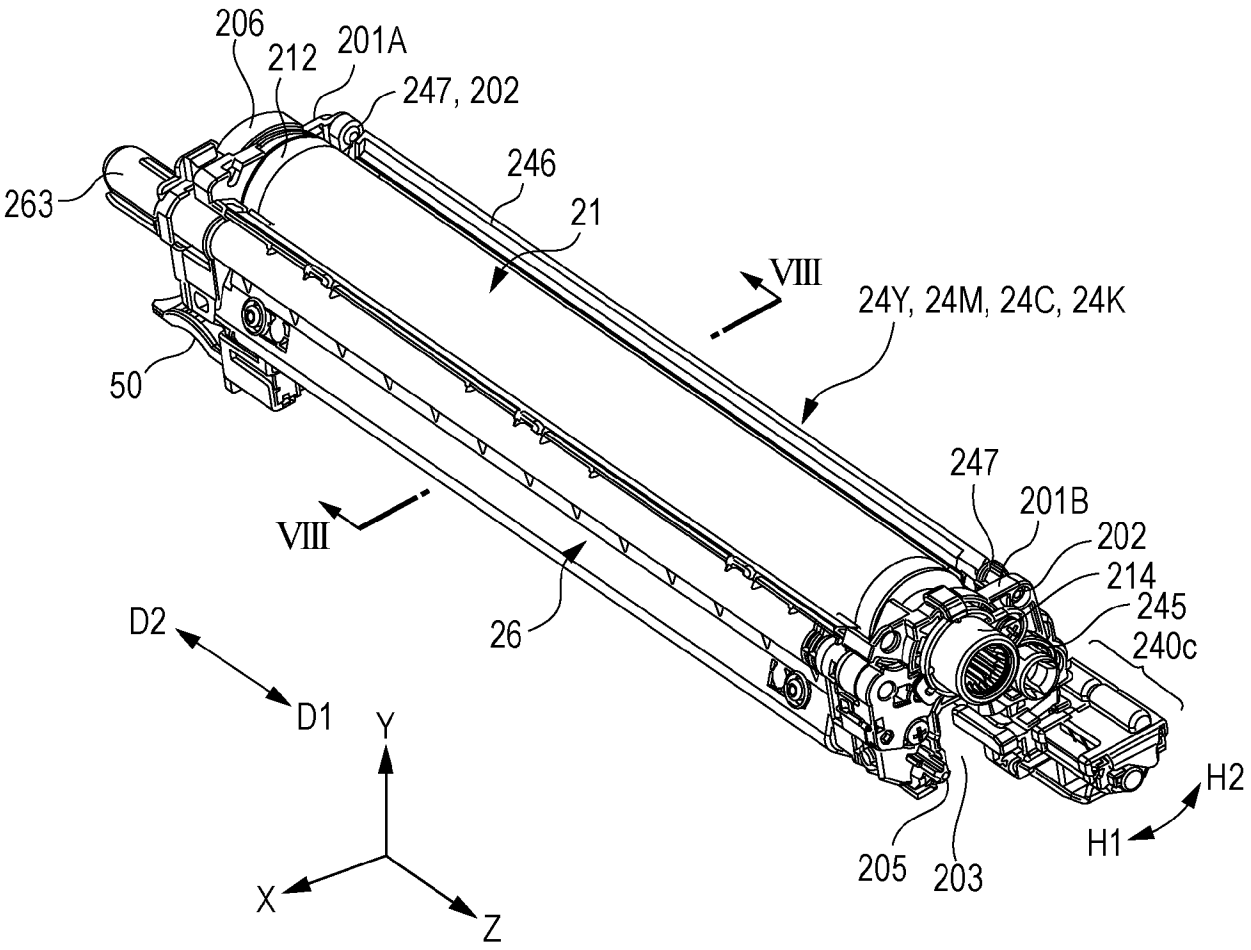
FIG. 5 is a perspective view illustrating the removable unit shown in FIG. 4, as viewed from the far end of the inserting direction of the removable unit.
Figure 6:
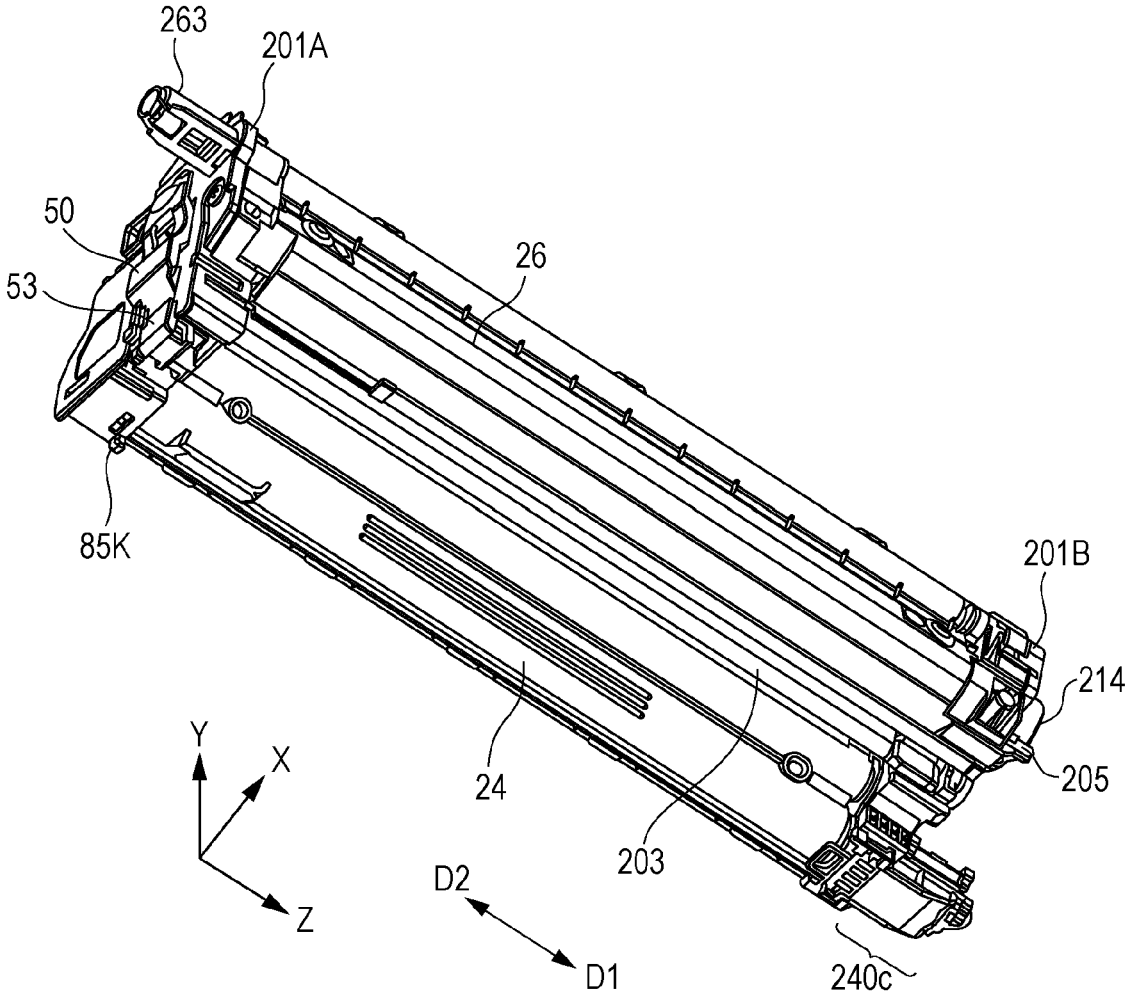
FIG. 6 is a perspective view illustrating the removable unit shown in FIG. 4, as viewed from the bottom surface thereof.

FIG. 1 illustrates the external appearance of the image forming apparatus 1 (when an exterior cover 14 is opened). FIG. 2 illustrates the internal configuration of the image forming apparatus 1. FIG. 3 illustrates part of the image forming apparatus 1 in a state in which an image forming device 2 is exposed by removing a developer recovery container 6 from the image forming apparatus 1. FIGS. 4 through 6 illustrate a removable unit to be removably fixed to the image forming apparatus 1. The arrows designated by X, Y, and Z in the drawings respectively indicate the directions of the axes of a rectangular coordinate system representing the length, height, and depth in an assumed three-dimensional space in the drawings.

(Overall Configuration of Image Forming Apparatus)

The image forming apparatus 1 forms an image made of a developer on recording paper 9, which is an example of a recording medium. The image forming apparatus 1 is configured as, for example, a printer which forms an image by receiving image information input from an external device, such as an information terminal.

The image forming apparatus 1 includes a housing 10 generally formed in a box-like shape. In the internal space of the housing 10, as shown in FIG. 2, an image forming device 2(2Y, 2M, 2C and 2K), an intermediate transfer device 30, a paper feeder device 40, and a fixing device 45 are disposed. The image forming device 2 forms toner images made of toner, which serves as a developer. The intermediate transfer device 30 holds toner images transferred from the image forming device 2 (first transfer) and then transports the toner images to a second transfer position at which the toner images are transferred to the recording paper 9 (second transfer). The paper feeder device 40 stores and outputs the recording paper 9 to be supplied to the second transfer position of the intermediate transfer device 30. The fixing device 45 fixes toner images, which have been transferred to recording paper 9 in the intermediate transfer device 30, on the recording paper 9. On a top surface 10*a* of the housing 10, a paper discharge/storage unit 12 for discharging and storing recording paper 9 having an image thereon is formed. The long dashed dotted line in FIG. 2 indicates the major transport path of the recording paper 9 within the housing 10.

The image forming device 2 is constituted by four image forming devices 2Y, 2M, 2C, and 2K for individually forming developer (toner) images of four colors, that is, yellow (Y), magenta (M), cyan (C), and black (K), respectively. These image forming devices 2K, 2C, 2M, and 2Y are disposed in the internal space of the housing 10 such that they gradually tilt upwards in ascending order.

Each of the four image forming devices 2Y, 2M, 2C, and 2K include a photoconductor drum 21, a charging device 22, an exposure device 23, a developing device 24(24Y, 24M, 24C and 24K), and a drum cleaner 26. The photoconductor drum 21 is driven and rotated in the direction (clockwise in FIG. 2) indicated by the arrow A. The charging device 22 is formed in a roller-like shape and charges the outer peripheral surface of the photoconductor drum 21 on which an image is formed (hereinafter such a surface will be referred to as an "image forming surface") to a predetermined potential. The exposure device 23 applies light representing an image signal of an associated color based on certain image information onto the image forming surface of the charged photoconductor drum 21 so as to form an electrostatic latent image of the associated color. The developing device 24 supplies a toner of the associated color to develop the electrostatic latent image, thereby visualizing the electrostatic latent image as a toner image of the associated color. The drum cleaner 26 cleans the photoconductor drum 21 by removing unwanted substances, such as toner, remaining on the outer peripheral surface of the photoconductor drum 21 from which a toner image has been transferred to an intermediate transfer belt 31 of the intermediate transfer device 30. In FIG. 2, the charging device, the exposure device, and the drum cleaner are designated by reference numerals 22, 23, and 26, respectively, only for the image forming device 2K.

In each of the image forming devices 2Y, 2M, 2C, and 2K, upon receiving a request (information) to form an image, the charging device 22 charges the outer peripheral surface of the rotating photoconductor drum 21 to a predetermined potential, and then, the exposure device 23 irradiates the outer peripheral surface of the photoconductor drum 21 with light corresponding to an image signal of an associated color, thereby forming an electrostatic latent image of the associated color. Then, the developing device 24 develops the electrostatic latent image of the associated color formed on the outer peripheral surface of the photoconductor drum 21 by using a toner of the associated color. As a result of all the image forming devices 2Y, 2M, 2C, and 2K performing the above-described operation, toner images of the four colors (Y, M, C, and K) are formed on the associated photoconductor drums 21. Hereinafter, the image forming devices 2Y, 2M, 2C, and 2K will be collectively referred to as the "image forming device 2" or "image forming devices 2" unless it is necessary to distinguish them from each other.

The intermediate transfer device 30 is disposed at a position above the image forming device 2 in the gravity direction such that it slightly tilts, in a manner similar to the image forming devices 2.

The intermediate transfer device 30 includes an endless intermediate transfer belt 31, plural support rollers 32*a* through 32*e*, roller-shaped first transfer portions 34, a roller-shaped second transfer portion 35, and a belt cleaner 36. The intermediate transfer belt 31 holds toner images formed on the photoconductor drums 21 of the image forming devices 2 and transferred to the intermediate transfer belt 31 (first transfer), and then transports the toner images to the second transfer position. The plural support rollers 32*a* through 32*e* support the intermediate transfer belt 31 so that the intermediate transfer belt 31 sequentially passes through the first transfer positions of the image forming devices 2 and is rotated in the direction indicated by the arrow B in FIG. 2. The first transfer portions 34 are disposed inward of the intermediate transfer belt 31, and implement a first transfer function of transferring toner images formed on the photoconductor drums 21 of the image forming devices 2 to the outer peripheral surface of the intermediate transfer belt 31. The second transfer portion 35 implements a second transfer function of transferring toner images transferred onto the intermediate transfer belt 31 to the recording paper 9. The belt cleaner 36 cleans the intermediate transfer belt 31 by removing unwanted substances, such as toner which has not been transferred to the recording paper 9 and remains on the outer peripheral surface of the intermediate transfer belt 31.

The support roller 32*a* serves as a drive roller and a second transfer backup roller. The support roller 32*b* serves as a cleaning backup roller. The support roller 32*c* serves as a tension applying roller. The support rollers 32*d* and 32*e* serve as flattening rollers.

The paper feeder device 40 is disposed at a position below the image forming device 2 in the gravity direction.

The paper feeder device 40 includes single or plural paper storage units 41 and an output unit 43. The single or plural paper storage units 41 are each attached to the housing 10 such that they can be pulled out of the housing 10 and store sheets of recording paper 9 of a desired size and type therein by piling them on a paper plate 42. The output unit 43 outputs sheets of recording paper 9 one by one from the paper storage unit 41. In the paper feeder device 40, when performing image formation, a required number of sheets of recording paper 9 are output one by one by the output unit 43 from the paper storage unit 41. The recording paper 9 fed from the paper feeder device 40 is transported along the transport path indicated by the long dashed dotted line in FIG. 2, and is supplied to the second transfer position (part of the second transfer portion 35 in contact with the intermediate transfer belt 31) of the intermediate transfer device 30 by a pair of transport timing adjustment rollers 44 disposed on the transport path in accordance with the second transfer timing.

In the intermediate transfer device 30, when performing image formation, toner images of the individual colors formed in the image forming devices 2Y, 2M, 2C, and 2K are sequentially transferred to the outer peripheral surface of the intermediate transfer belt 31 by using the first transfer function of the first transfer portions 34. In this case, the toner images are transferred to the outer peripheral surface of the intermediate transfer belt 31 in a state in which they are in register with each other. After performing first transfer, in the image forming device 2, the outer peripheral surface of the photoconductor drum 21 is cleaned by the drum cleaner 26. The intermediate transfer belt 31 then transports the toner images to the second transfer position which faces the second transfer portion 35. Thereafter, in the intermediate transfer device 30, by using the second transfer function of the second transfer portion 35, the toner images on the intermediate transfer belt 31 are transferred to a sheet of recording paper 9 which has been fed from the paper feeder device 40 to the second transfer position. After performing second transfer, the outer peripheral surface of the intermediate transfer belt 31 is cleaned by the belt cleaner 36.

The fixing device 45 is disposed at a position above the second transfer position of the intermediate transfer device 30 in the gravity direction.

The fixing device 45 includes a roller-shaped or belt-shaped heating rotator 47 and a roller-shaped or belt-shaped pressurizing rotator 46 within the housing of the fixing device 45. The heating rotator 46 is rotated in a predetermined direction and is heated by a heating member so as to be maintained at a predetermined surface temperature. The pressurizing rotator 47 is rotated, together with the heating rotator 46, while being in contact with the heating rotator 46 with a certain pressure in a direction substantially along the rotational axis of the heating rotator 46.

In the fixing device 45, when performing image formation, the recording paper 9 onto which toner images are transferred by the intermediate transfer device 30 is fed to a pressurizing portion at which the heating rotator 46 and the pressurizing rotator 47 contact each other with pressure, and passes through the pressurizing portion, so that the recording paper 9 is heated and pressurized. As a result, the toner images are fused and fixed on the recording paper 9. The recording paper 9 having the fixed toner images thereon is transported along the transport path indicated by the long dashed dotted line in FIG. 2 and is output to the outside of the housing 10 by a pair of discharge rollers 48 disposed on the transport path. The recording paper 9 is then discharged to and stored in the paper discharge/storage unit 12.

In the image forming apparatus 1, by selecting and operating some or all of the image forming devices 2Y, 2M, 2C, and 2K (at least toners of plural colors), a multicolor image constituted by toners of some or all of the four colors (Y, M, C, and K) may be formed. Alternatively, by selecting and operating one of the image forming devices 2Y, 2M, 2C, and 2K, a single-color image constituted by a toner of one color, for example, black (K), may be formed.

In the image forming apparatus 1, a developer, which will be recovered, removed from the photoconductor drums 21 by the drum cleaners 26 of the four image forming devices 2 and from the intermediate transfer belt 31 by the belt cleaner 36 of the intermediate transfer device 30 is collected in the removable developer recovery container 6 and is recovered. The developer recovery container 6 is removably mounted on a container mounting portion 10*f* provided as a recessed structure on one surface 10*b* of the housing 10 (see, for example, FIG. 1). The developer recovery container 6 is replaced when it is filled with recovered developer.

(Configuration of Removable Unit)

In the image forming apparatus 1, as shown in FIGS. 3 through 9, some of the elements forming the image forming device 2, such as the photoconductor drum 21, the charging device 22, the developing device 24, and the drum cleaner 26, are supported by a support frame 201 (FIG. 8) and are integrated. The entirety of these elements is formed as a unit structure which is removably mounted on a mounting unit 13 provided at part of the housing 10 of the image forming apparatus 1. The unit structures of the individual image forming units 20 will be referred to as "removable units 20Y, 20M, 20C, and 20K", and they will be collectively referred to as the "removable unit 20" or "removable units 20" unless it is necessary to distinguish them from each other.

Figure 15:
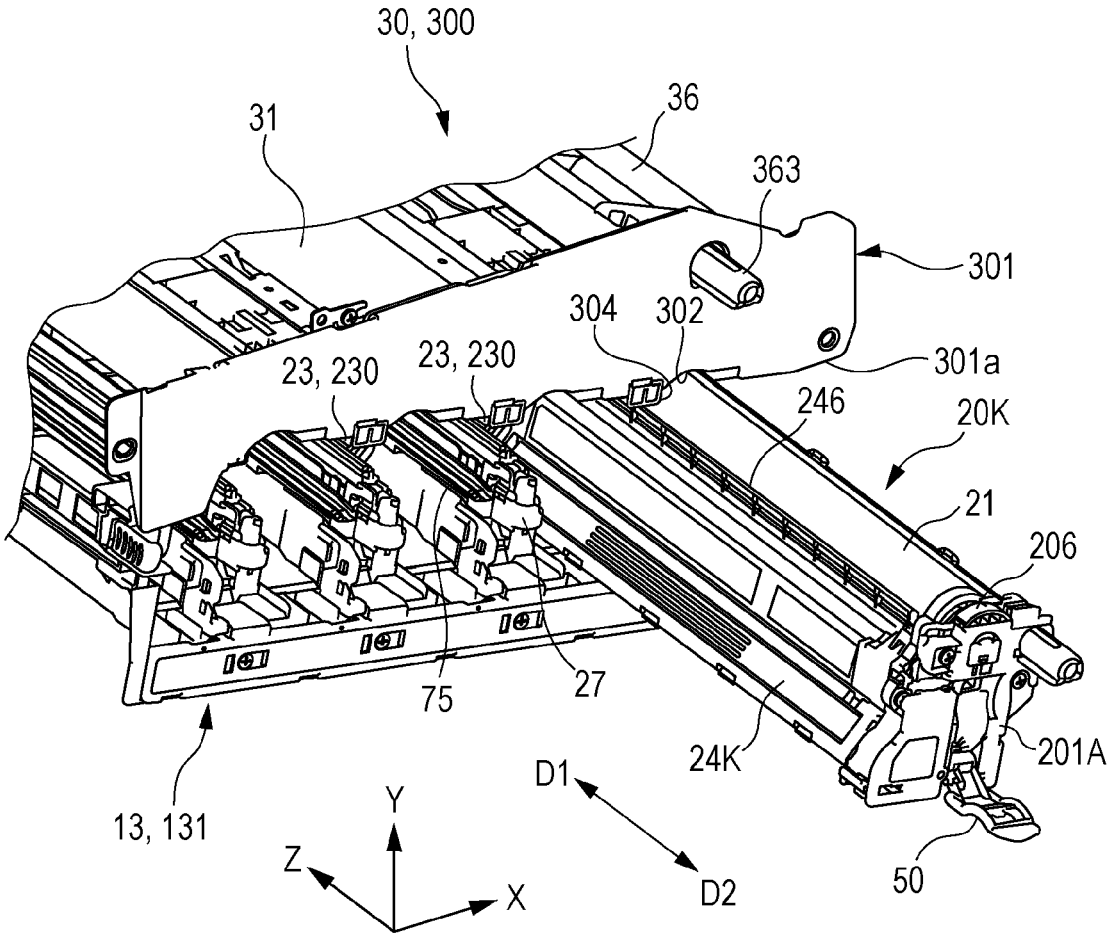
FIG. 15 is a perspective view illustrating a mounting unit and an intermediate transfer device of the image forming apparatus shown in FIG. 1 and a mounting or dismounting process of a removable unit.

As shown in FIGS. 3 and 15, the removable unit 20 is inserted into and removed from the mounting unit 13 of the housing 10 in the directions indicated by the arrows D1 and D2 (hereinafter simply called the directions D1 and D2), respectively, along the rotational axis of the photoconductor drum 21, so that they can be mounted on or dismounted from the mounting unit 13. That is, the removable unit 20 can be inserted into the mounting unit 13 by moving along the direction D1 in which it is inserted (inserting direction). The removable unit 20 can be removed from the mounting unit 13 by moving along the direction D2 in which it is removed (removing direction).

Figure 20:
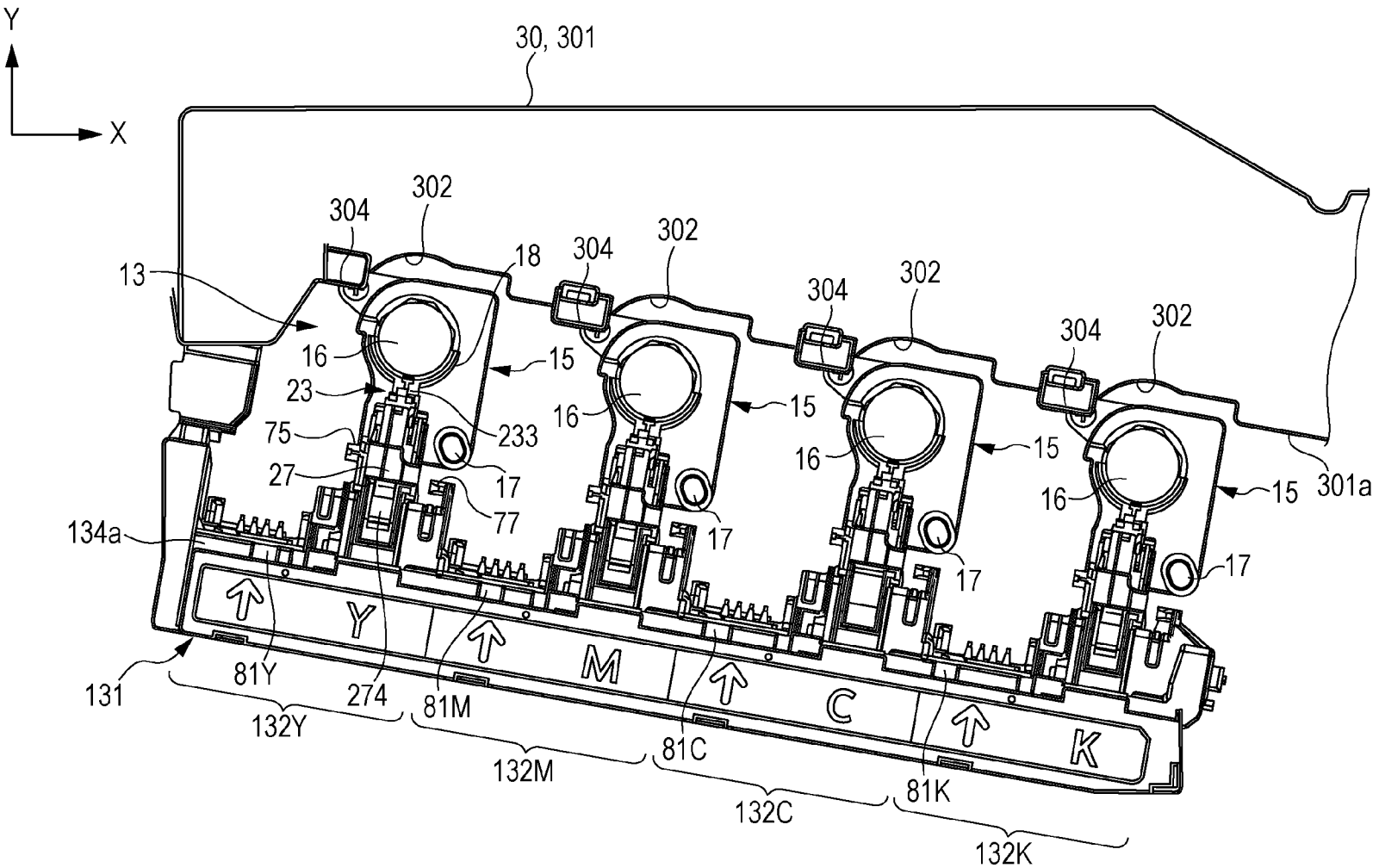
FIG. 20 is a side view illustrating the mounting unit shown in FIG. 15, as viewed from the near end of the inserting direction of a removable unit.

The exposure device 23 of each of the image forming units 20 is fixed to a predetermined part of the mounting unit 13 in advance (see, for example, FIGS. 15 and 20).

The intermediate transfer device 30 is fixed to a predetermined position of a dedicated mounting portion (not shown), which is formed at part of the housing 10 as a space for receiving the intermediate transfer device 30 therein. The intermediate transfer device 30 (transfer unit 300 shown in FIG. 15), except for the second transfer portion 35, can be pulled out of the dedicated mounting portion, which is positioned above the mounting unit 13 of the housing 10, for example, in the same direction as the removing direction D2 of the removable unit 20, so that it can be exposed to the outside of the housing 10.

(Overview of Mounting and Dismounting Operation of Removable Unit)

Generally, the removable unit 20 is mounted on and dismounted from the mounting unit 13 in the following manner. In the image forming apparatus 1, it is not necessary to perform a displacement operation for causing the intermediate transfer device 30 to approach or separate from the photoconductor drum 21 of the removable unit 20 nor is it necessary to provide a displacement mechanism for such a displacement operation when the removable unit 20 is mounted on or dismounted from the mounting unit 13.

When mounting the removable unit 20, as shown in FIG. 15, the removable unit 20 is first inserted into the mounting unit 13 of the housing 10 and is stored therein.

Figure 16:
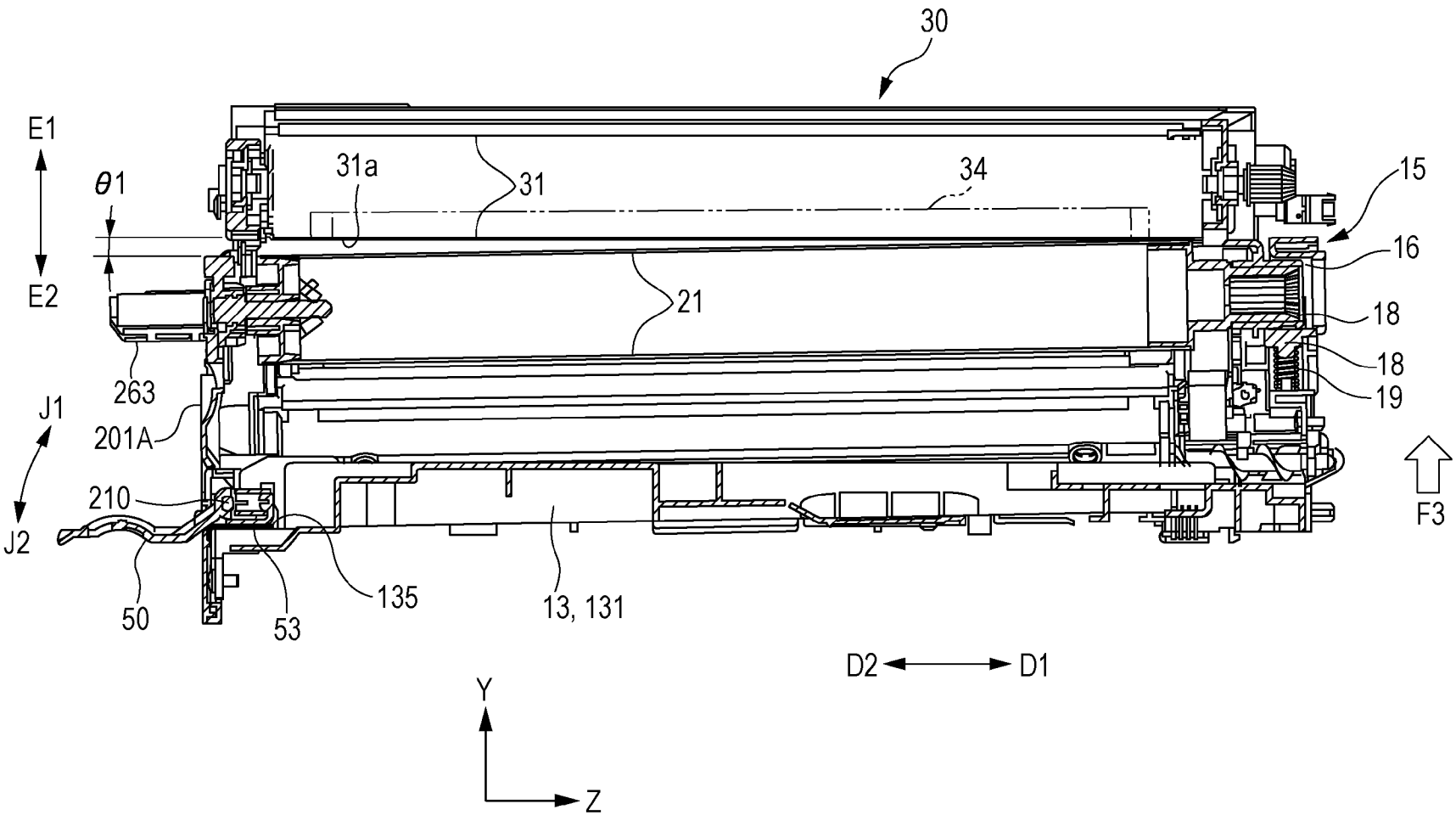
FIG. 16 is a sectional view illustrating a state in which a removable unit is inserted in the mounting unit shown in FIG. 15.
Figure 17:
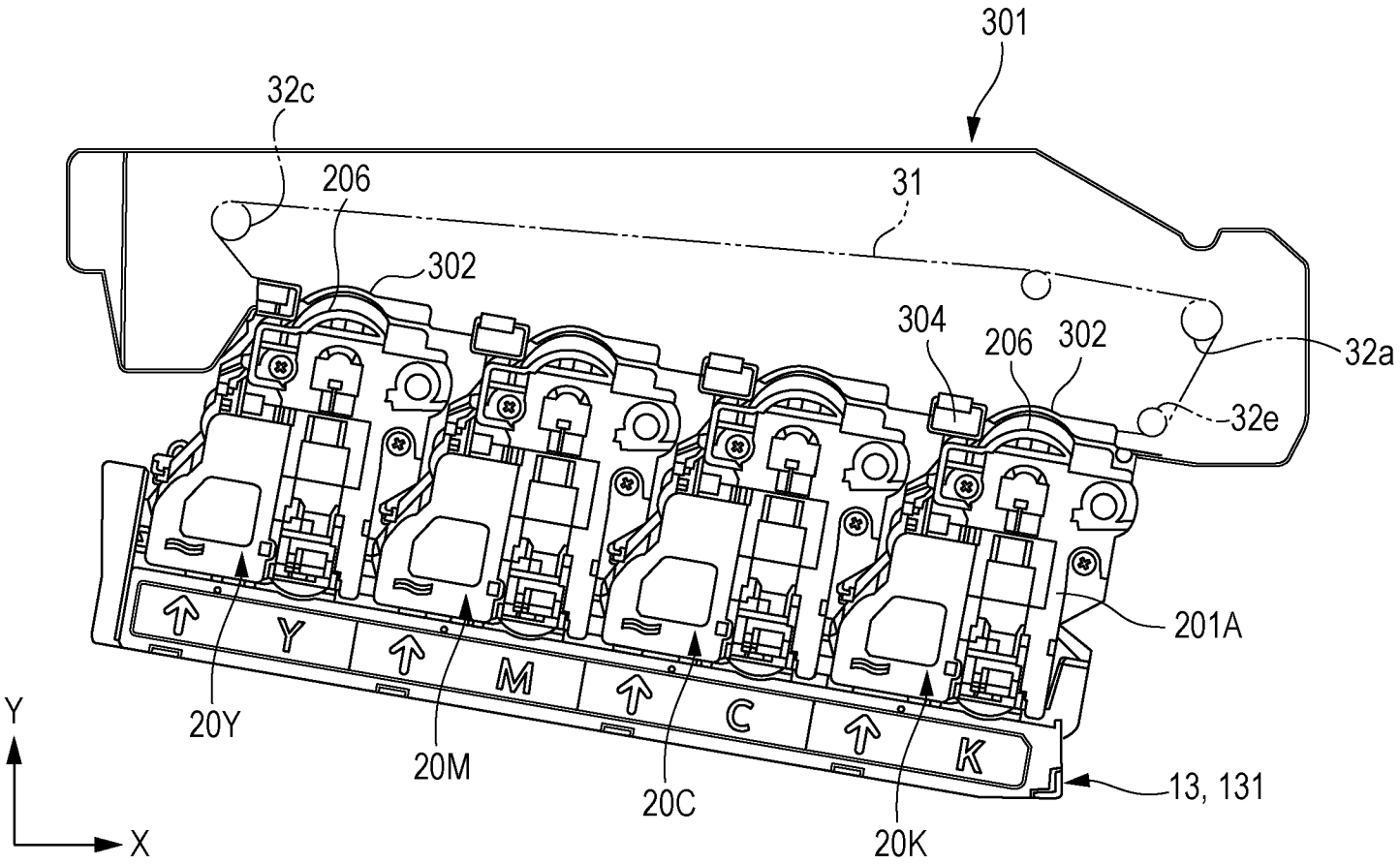
FIG. 17 is a perspective view illustrating a state of the mounting unit and the removable unit shown in FIG. 16, as viewed from the near end of the inserting direction of the removable unit.

In this case, as shown in FIG. 16, the removable unit 20 is inserted and stored in the mounting unit 13 in a state in which the end of the removable unit 20 on the upstream side in the inserting direction D1 is separated from the intermediate transfer device 30. With this configuration, in the removable unit 20, the end of the photoconductor drum 21 on the upstream side in the inserting direction D1 is displaced such that it is separated from the intermediate transfer belt 31 (more specifically, the belt portions supported by the transfer rollers of the first transfer portions 34) downward. The removable unit 20, as a whole, is maintained such that it tilts downward toward one side. In this case, as shown in FIG. 17, the end (at a side plate 201A of the support frame 201) of each of the removable units 20 on the upstream side in the inserting direction D1 is located at a position slightly lower than a position at which image formation can be performed in the mounting unit 13.

Figure 42:
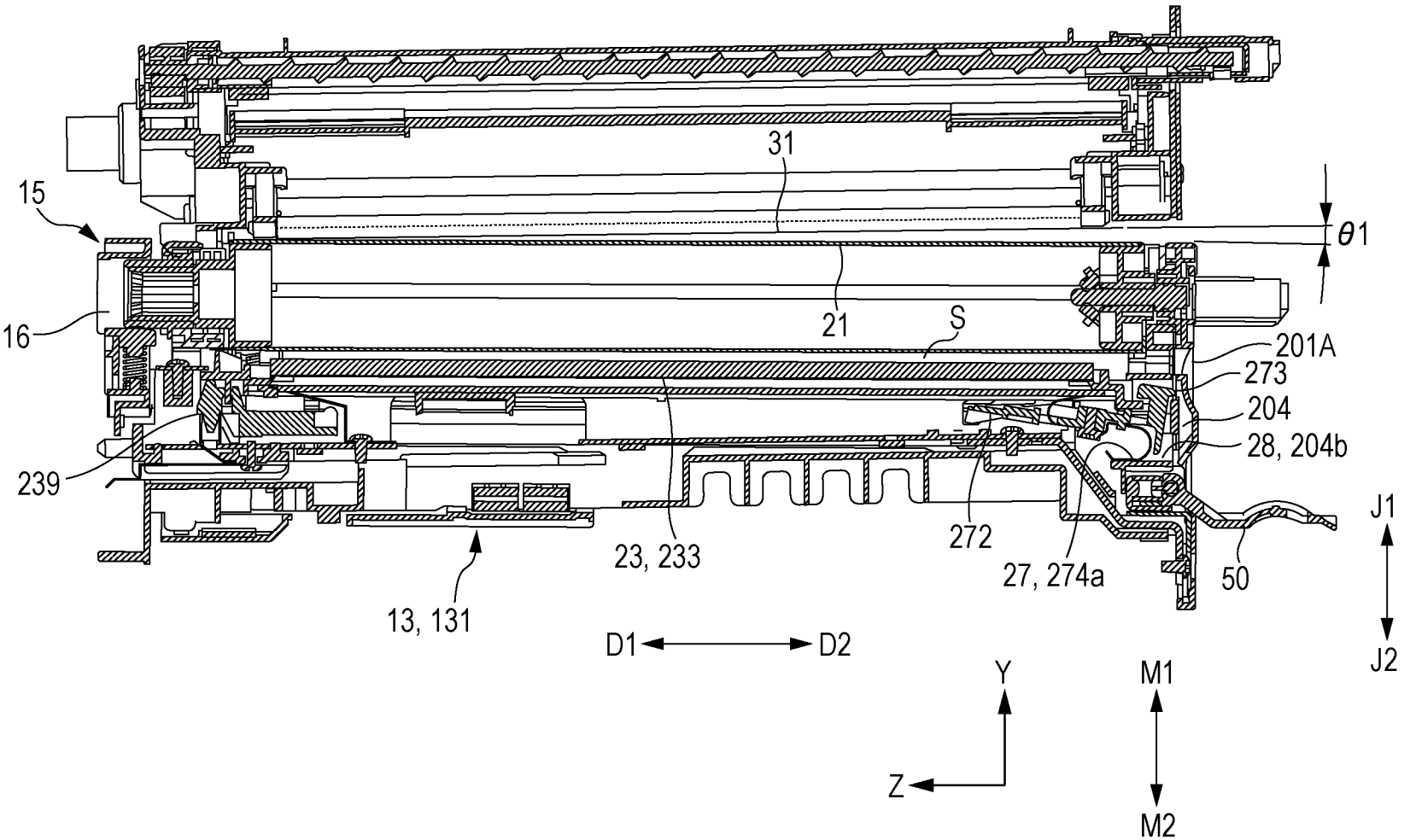

In this state, the removable unit 20 is set so that the angle (angle of tilt) 01 between the outer surface of the photoconductor drum 21 along its axial direction and an outer peripheral surface 31*a* of the intermediate transfer belt 31 will be a predetermined angle (for example, 1°)(see FIGS. 16 and 42). Accordingly, the inserting direction D1 of the removable unit 20 is a direction inclined upward toward the downstream side of the inserting direction D1 with respect to a reference level. In other words, the removing direction D2 of the removable unit 20 is a direction inclined downward toward the downstream side of the removing direction D2 with respect to the reference level. The reference level corresponds to a surface formed by the axes X and Z in the drawings. The reference level may be a level determined at the time of designing the image forming apparatus 1 or a floor level on which the image forming apparatus 1 may be installed.

Then, the positioning of the removable unit 20 in the mounting unit 13 of the housing 10 is performed.

Figure 18:
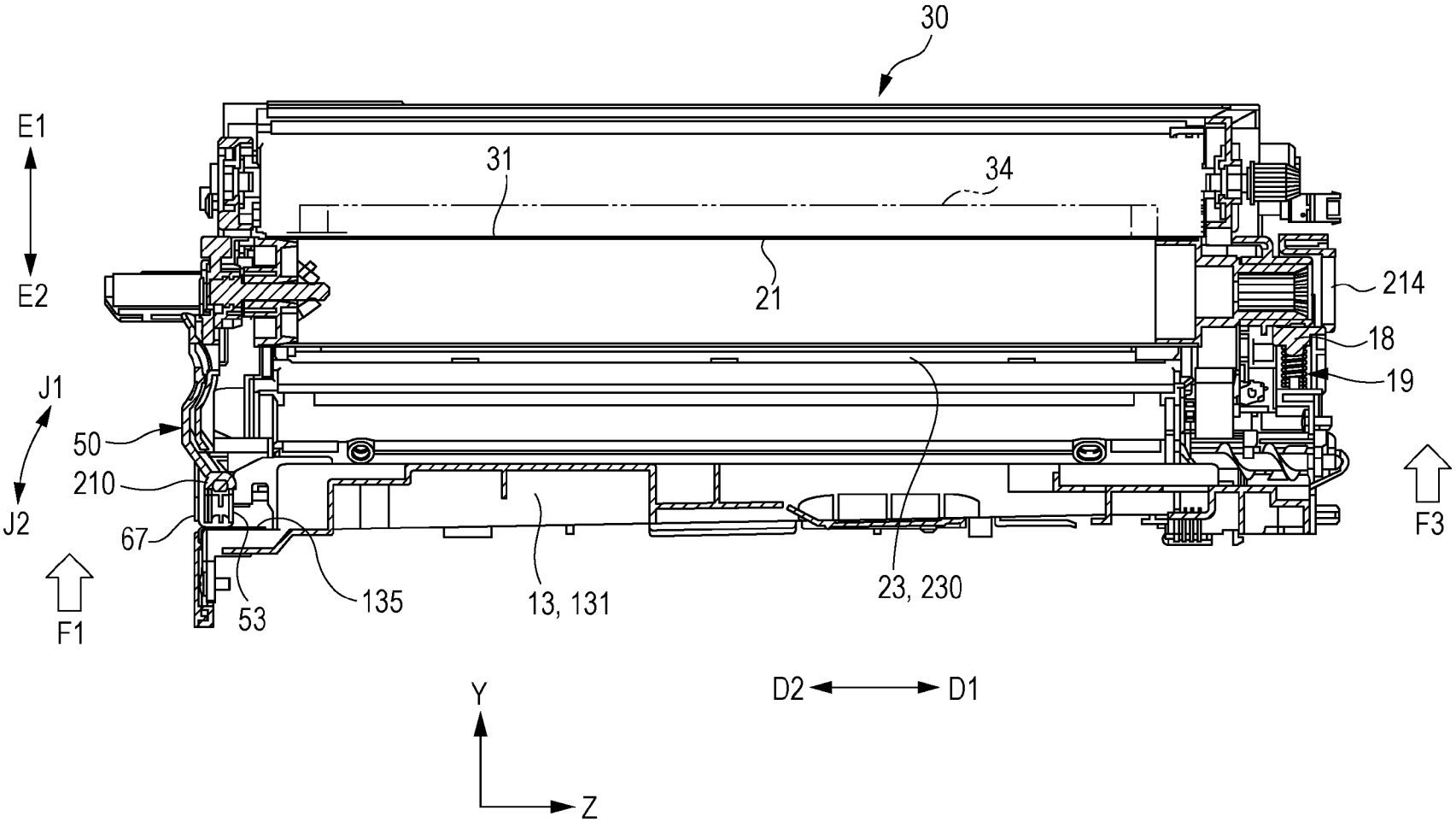
FIG. 18 is a sectional view illustrating a state in which a removable unit has been positioned (mounted) on the mounting unit shown in FIG. 15.

In this case, by operating an operation lever 50, which will be discussed later, the removable unit 20 is displaced in a direction in which the end of the removable unit 20 on the upstream side in the inserting direction D1 approaches the intermediate transfer device 30. With this operation, as shown in FIG. 18, the removable unit 20 is maintained in a state in which the photoconductor drum 21 including its end on the upstream side in the inserting direction D1 contacts the intermediate transfer belt 31 (more specifically, the belt portions supported by the transfer rollers of the first transfer portions 34).

Figure 19:
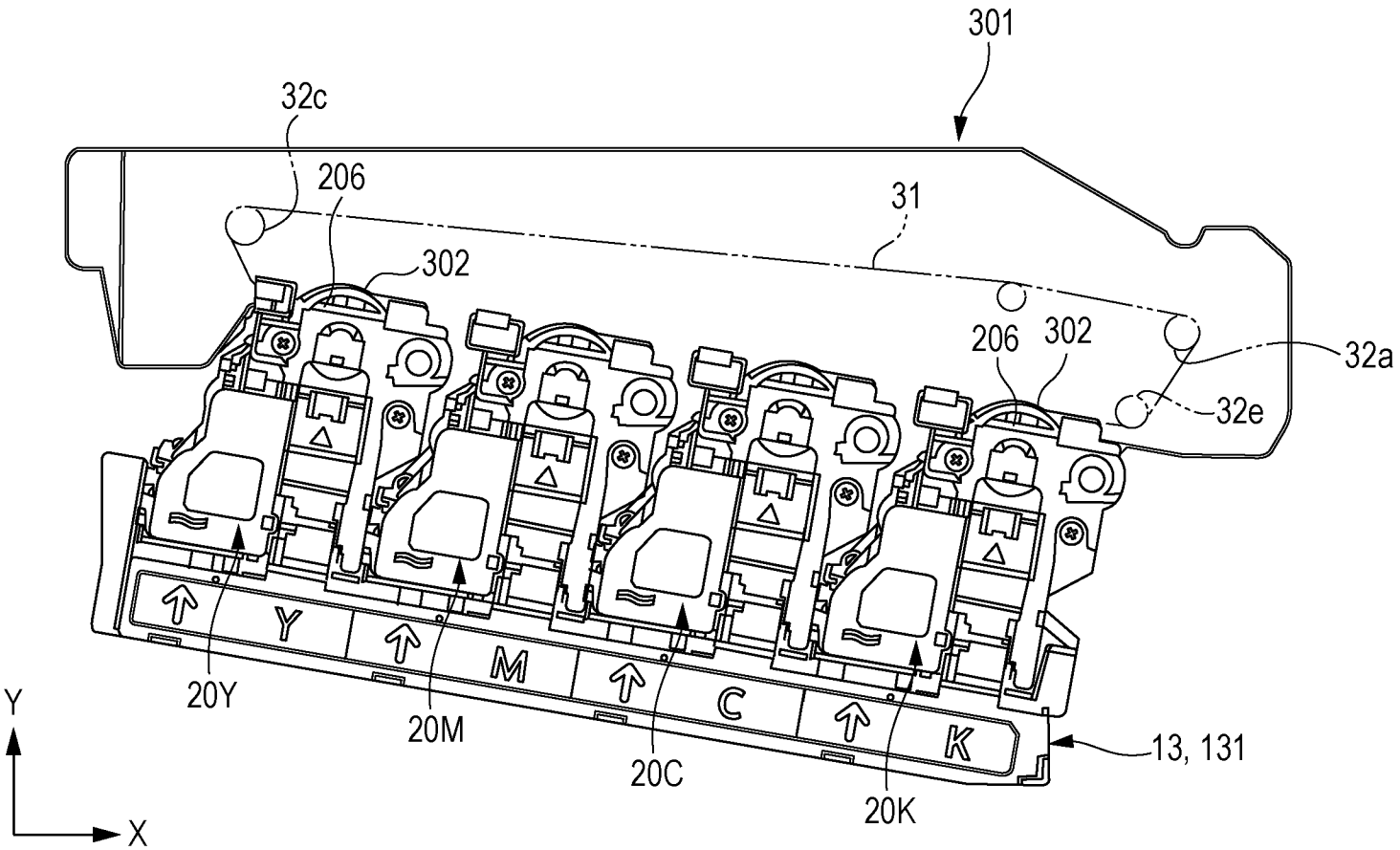
FIG. 19 is a perspective view illustrating a state of the mounting unit and the removable unit shown in FIG. 18, as viewed from the near end of the inserting direction of the removable unit.

By performing the above-described mounting operation, the removable unit 20 is in a state in which it has been positioned in the mounting unit 13 and is fixed properly (state in which the image forming operation can be performed). In this case, as shown in FIG. 19, the removable unit 20 is displaced so that the end thereof (side plate 201A) on the upstream side in the inserting direction D1 can be raised toward a position at which the image forming operation can be performed in the mounting unit 13.

On the other hand, when dismounting the removable unit 20, the removable unit 20 is removed from the mounting unit 13 of the housing 10.

In this case, prior to the removing of the removable unit 20, by operating the operation lever 50, which will be discussed later, the end of the removable unit 20 on the upstream side in the inserting direction D1 is displaced in a direction in which it is separated from the intermediate transfer device 30 (state in which the positioning of the removable unit 20 is canceled). With this operation, as discussed above, the end of the photoconductor drum 21 on the upstream side in the inserting direction D1 is separated from the intermediate transfer belt 31 downward. The removable unit 20, as a whole, is displaced such that it tilts downward toward one side. In this case, in each of the removable units 20, as shown in FIG. 17, as in the state in which the removable unit 20 is inserted into the mounting unit 13, the end (side plate 201A) on the upstream side in the inserting direction D1 is located at a position slightly lower than a position at which image formation can be performed in the mounting unit 13.

Thereafter, the removable unit 20 is removed from the mounting unit 13 by moving along the removing direction D2 in the state in which it remains tilting as described above. As a result, the removable unit 20 is removed from the mounting unit 13 to the outside (FIG. 3).

(Detailed Configuration of Removable Unit)

As shown in FIGS. 4 through 8, the removable unit 20 is a structure in which the photoconductor drum 21, the charging device 22, the developing device 24, and the drum cleaner 26 are supported by the support frame 201 and are integrated.

Major Components Forming Removable Unit

The support frame 201 is principally constituted by two side plates 201A and 201B, and may also be constituted by an interconnecting member (not shown) for connecting and supporting the side plates 201A and 201B if necessary.

As the photoconductor drum 21, a cylindrical conductive substance, which is grounded, is prepared, and a photosensitive layer made of, for example, an organic conductive material, is formed on the outer peripheral surface of the conductive substance. At both ends of the photoconductor drum 21 in the longitudinal direction, disc-shaped flanges 212 and 213 forming part of the conductive substance are provided. The photoconductor drum 21 is rotatably fixed to the side plates 201A and 201B of the support frame 201 by means of a shaft which projects from both ends of the photoconductor drum 21. A transmission gear 215 (see FIG. 7) which receives torque transmitted from the mounting unit 13 is disposed inside a shaft 214 projecting from the side plate 201B at the forward end of the removable unit 20 (far end when the removable unit 20 is mounted) in the inserting direction D1. As the transmission gear 215, a cylindrical female gear having gear teeth on the inner wall, for example, is used.

Figure 8:
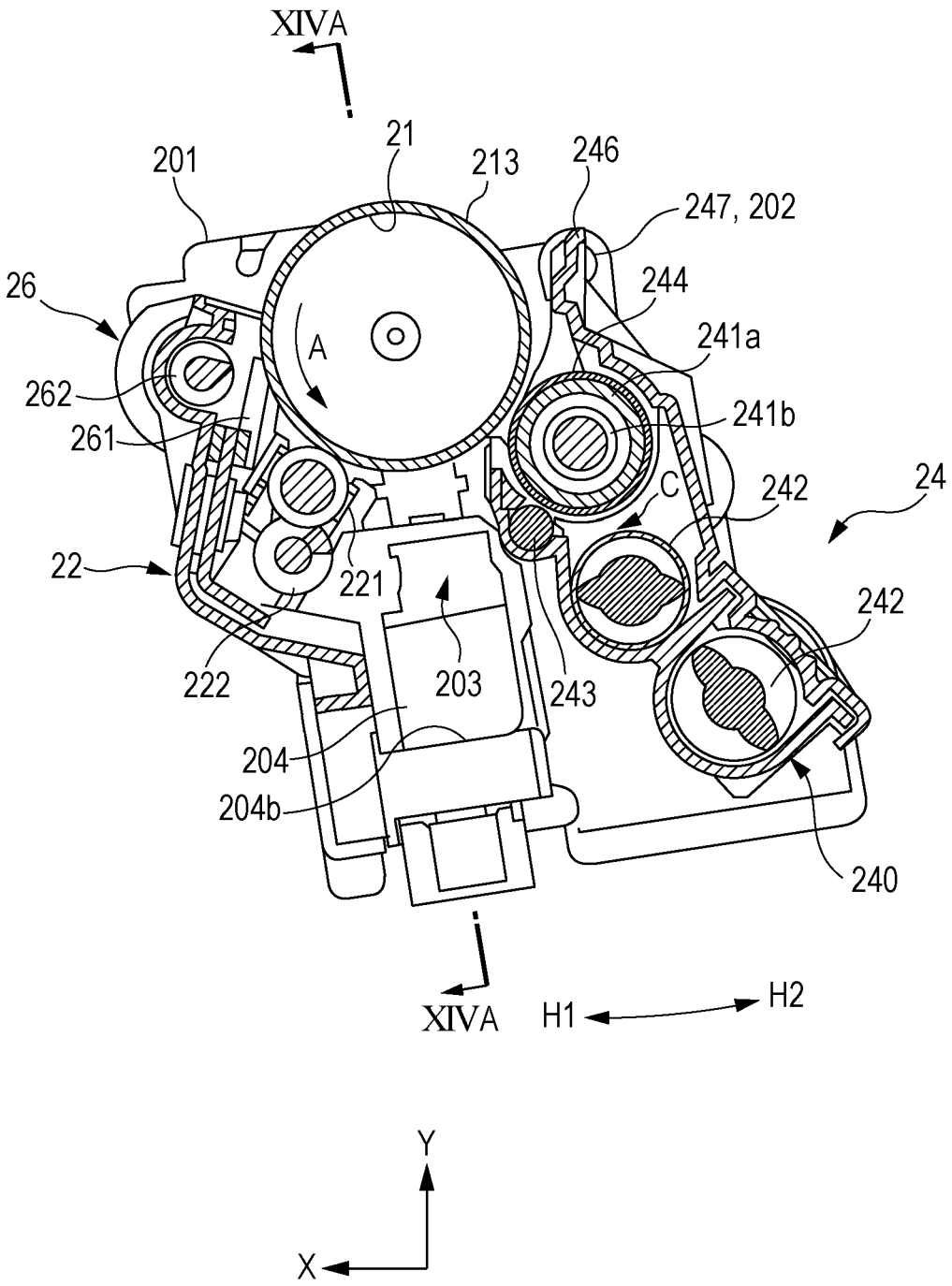
FIG. 8 is a schematic sectional view illustrating the removable unit taken along line VIII-VIII of FIG. 5.

As the charging device 22, a contact-type charging device is used. More specifically, as shown in FIG. 8, a charging roller 221 is rotated, together with the photoconductor drum 21, while being in contact with the image forming surface of the photoconductor drum 21. The charging roller 221 is rotatably fixed at both ends to the side plates 201A and 201B of the support frame 201. The charging roller 221 is rotated, together with the photoconductor drum 21, while being in contact with the outer peripheral surface of the photoconductor drum 21. A charging voltage is supplied from the mounting unit 13 to the charging roller 221. The outer peripheral surface of the charging roller 221 is cleaned by a cleaning brush roller 222, which is rotated in contact with the outer peripheral surface of the charging roller 221.

Figure 44:
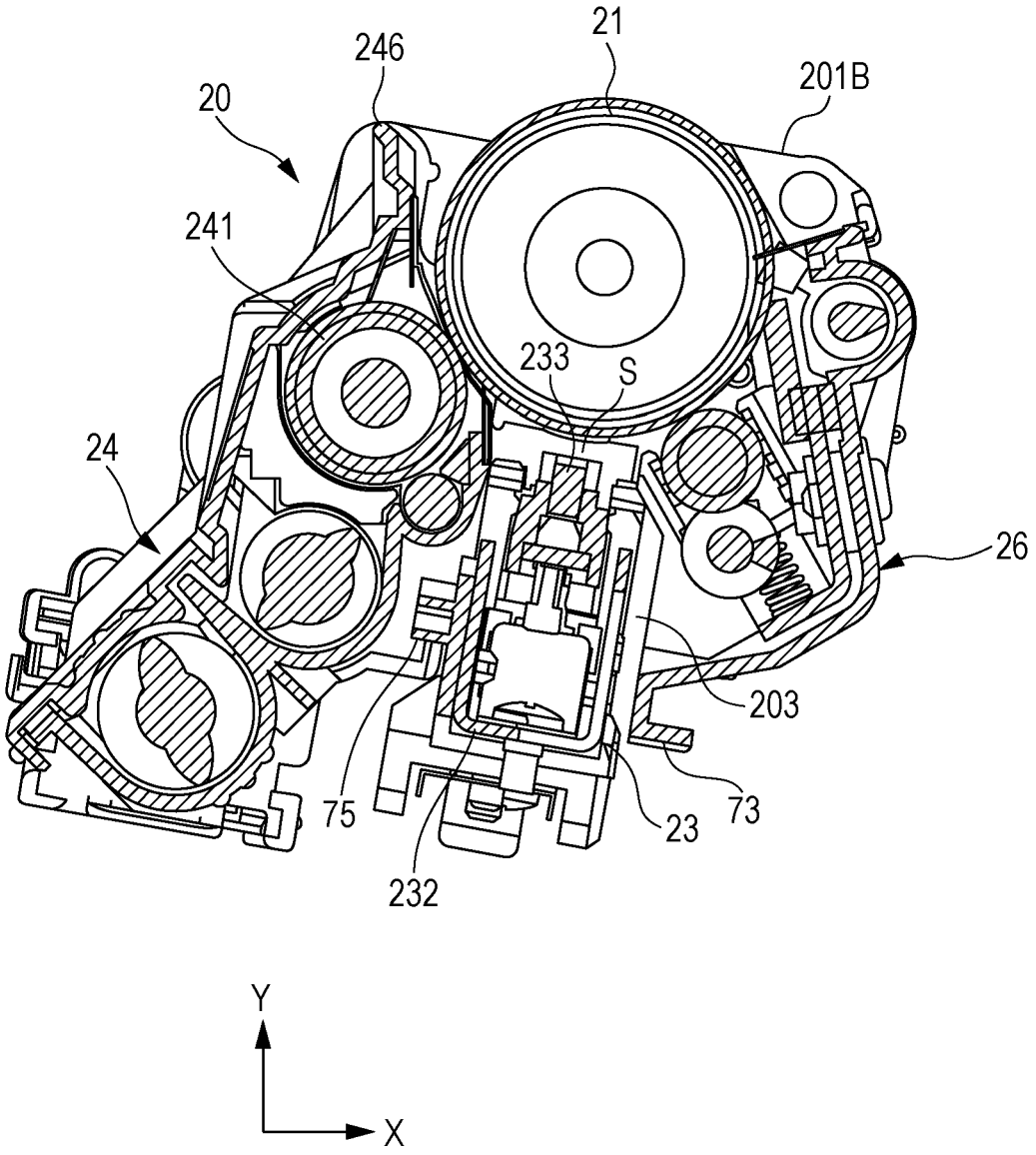
FIG. 44 is a sectional view illustrating the removable unit and the exposure device from which the intermediate transfer device and the mounting unit are removed, taken along line XLIV-XLIV of FIG. 43.

As the developing device 24, for example, a two-component developing device which performs development by using a two-component developer containing toner and carrier is used. The developing device 24 includes a housing 240 in which a development opening, a storage portion, and a developer receiving portion 240*c* (FIGS. 5 and 7) are formed. The development opening faces the photoconductor drum 21 along the axial direction thereof. The storage portion is formed as a partitioned space in which a developer is stored therein and is transported therefrom while circulating. The developer receiving portion 240*c* receives a developer to be supplied to the storage portion. In the housing 240, a developing roller 241 (FIG. 44), a screw auger 242, and a rod-shaped layer thickness regulating member 243 are disposed (FIG. 8). The screw auger 242 is an example of a stirring transport member for stirring a developer stored in the storage portion and transporting it toward the developing roller 241. The layer thickness regulating member 243 regulates the thickness of the layer of a developer to be supplied to and held in the developing roller 241.

The developing roller 241 includes a cylindrical sleeve 241*a* and a magnet roller 241*b* disposed within the sleeve 241*a*. The sleeve 241*a* is rotated in the direction indicated by the arrow C in FIG. 8. At both ends of the developing roller 241, a disc-shaped tracking roller 244 is provided which is brought into contact with the flanges 212 and 213 so as to maintain a predetermined gap between the developing roller 241 and the image forming surface of the photoconductor drum 21.

Figure 7:
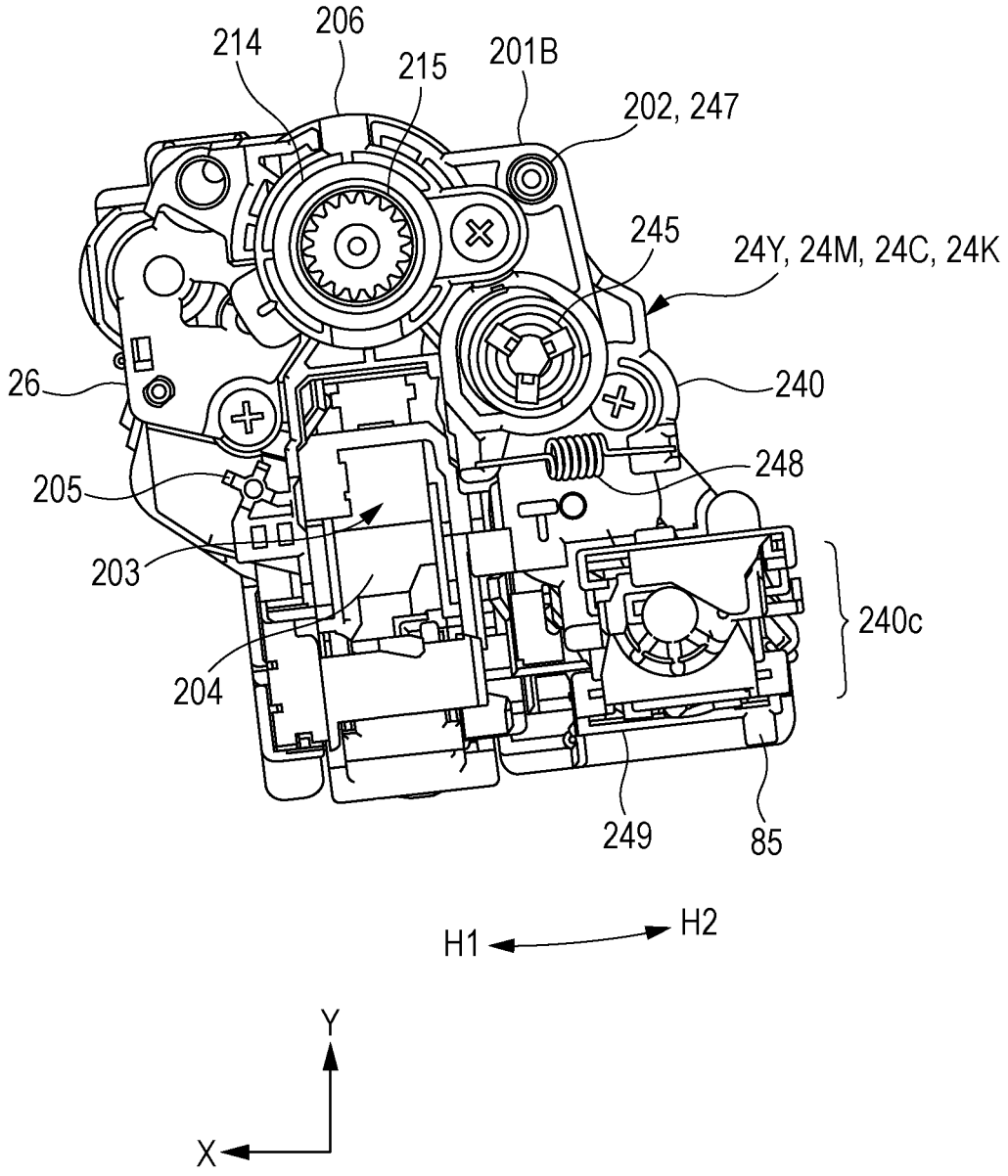
FIG. 7 is a rear view illustrating the removable unit shown in FIG. 4, as viewed from the far end of the inserting direction of the removable unit.

As shown in FIGS. 5 and 7, at the end of the sleeve 241*a* of the developing roller 241 on the downstream side in the inserting direction D1, a driven coupling 245, which serves as a coupling member for receiving torque, is fixed such that it projects from the end of the housing 240.

In the developing device 24, as shown in FIGS. 4, 5, and 8, pivoting support portions (pivot shafts) 247 are formed at both ends of a projecting edge portion 246 extending upward from the development opening of the housing 240. The pivoting support portions 247 are rotatably fit in pivot bearing holes 202 formed in the side plates 201A and 201B of the support frame 201. Because of this structure, the developing device 24 is supported by the removable unit 20 so that it is pivotable about the pivoting support portions 247 in the directions indicated by the arrows H1 and H2 (hereinafter simply called the directions H1 and H2).

The developing device 24 is pressed in the direction H1 by a coil spring 248 (FIG. 7) fixed between part of the housing 240 and each of the side plates 201A and 201B of the support frame 201. The provision of the coil spring 248 contributes to maintaining a state in which the tracking roller 244 of the developing roller 241 is in contact with the flanges 212 and 213 of the photoconductor drum 21.

The drum cleaner 26 includes a cleaning member 261, such as an elastic plate, and a rotational transport member 262, such as a screw auger, within a housing of the drum cleaner 26 (FIG. 8). The cleaning member 261 is brought into contact with the outer peripheral surface of the photoconductor drum 21 so as to scrape unwanted substances, such as toner, remaining on the photoconductor drum 21. The rotational transport member 262 transports toner scraped by the cleaning member 261 to the developer recovery container 6 through a transport pipe 263 (FIG. 5). The drum cleaner 26 is attached to the support frame 201 in a state in which both ends thereof are fixed to the side plates 201A and 201B (or their interconnecting member) of the support frame 201.

Operation Lever in Removable Unit

In the removable unit 20, the operation lever 50 (FIGS. 5 and 6) is provided. When the removable unit 20 is mounted on and stored in the mounting unit 13, the operation lever 50 displaces the end of the removable unit 20 on the upstream side in the inserting direction D1 in the directions indicated by the arrows E1 and E2 in FIGS. 16 and 18 (hereinafter simply called the directions E1 and E2) in which it approaches and separates from the intermediate transfer device 30.

As stated above, the operation lever 50 is a member for displacing the end of the removable unit 20 on the upstream side in the inserting direction D1 in the directions in which it approaches or separates from the intermediate transfer device 30. By operating the operation lever 50, the photoconductor drum 21 of the removable unit 20 may be set in a state in which it approaches or separates from the portions of the intermediate transfer belt 31 supported by the first transfer portions 34.

Figure 10A:
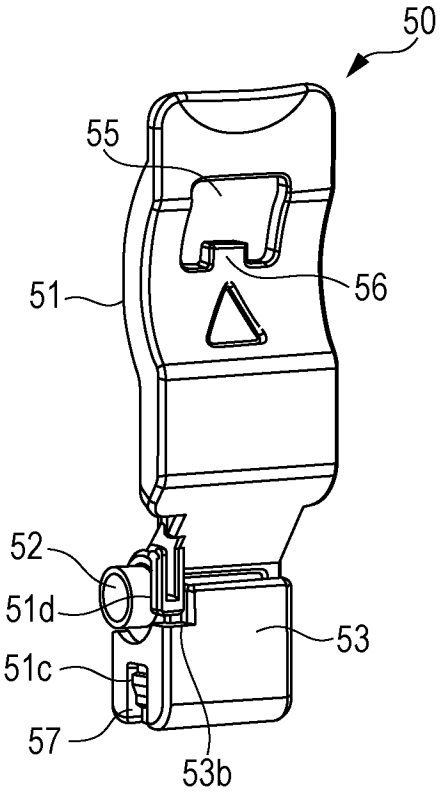
FIG. 10A is a perspective view illustrating an operation lever in the removable unit, as viewed from the front side.
Figure 10B:
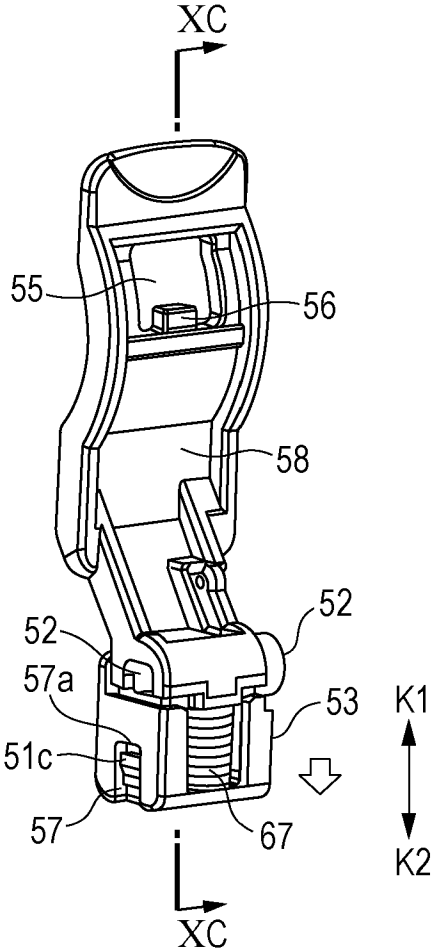
FIG. 10B is a perspective view illustrating the operation lever shown in FIG. 10A, as viewed from the back side.
Figure 10C:
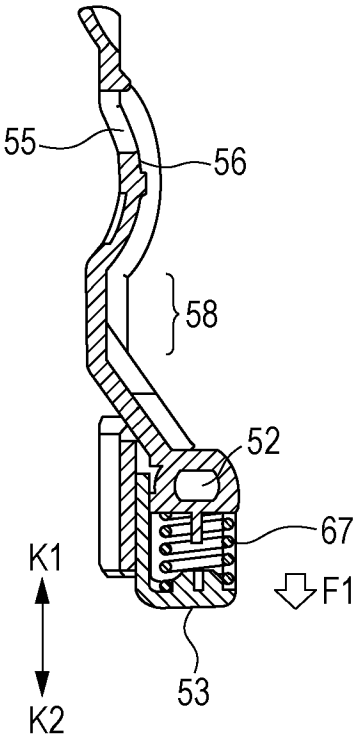
FIG. 10C is a sectional view illustrating the operation lever taken along line XC-XC in FIG. 10B.

As shown in FIGS. 10A through 10C, the operation lever 50 includes a plate-like body 51 formed into a predetermined shape, a bearing 52 provided at the bottom portion the body 51, a displaceable bottom portion 53, and a coil spring 67. The bearing 52 receives a pivot shaft 210 therein and pivotably supports the body 51 in the directions indicated by the arrows J1 and J2 (hereinafter simply called the directions J1 and J2) in FIGS. 14A and 16. The displaceable bottom portion 53 is provided under the bearing 52 and is attached to the bearing 52 so that it is displaceable in the directions (indicated by the arrows K1 and K2 in FIGS. 10B and 10C) (hereinafter simply called the directions K1 and K2) in which the displaceable bottom portion 53 approaches and separates from the bearing 52. The coil spring 67 intervenes between the displaceable bottom portion 53 and the bearing 52 and elastically presses the displaceable bottom portion 53 in the direction K2 in which the displaceable bottom portion 53 separates from the bearing 52. The pivot shaft 210 serves as a pivot point positioned at the bottom portion of the side plate 201A of the support frame 201 of the removable unit 20.

Figure 14A:
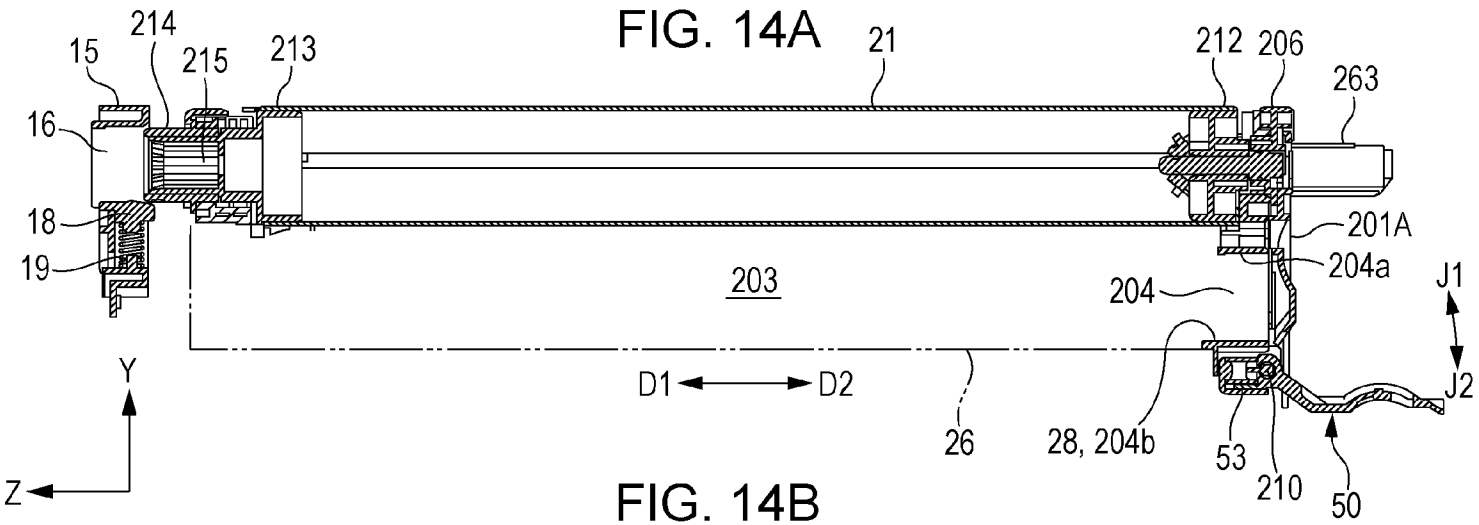
FIG. 14A is a sectional view illustrating the removable unit taken along line XIVA-XIVA of FIG. 8.

As shown in FIGS. 14A, 16, and 18, the operation lever 50 is pivoted (moved) in the directions J1 and J2 about the pivot shaft 210. More specifically, when displacing the end of the removable unit 20 on the upstream side in the inserting direction D1, in the direction E1 in which it approaches the intermediate transfer device 30, the operation lever 50 is pivoted (raised) in the direction J1. Conversely, when displacing the end of the removable unit 20 on the upstream side in the inserting direction D1, in the direction E2 in which it separates from the intermediate transfer device 30, the operation lever 50 is pivoted (lowered) in the direction J2.

When the operation lever 50 is pivoted in the direction J1, the displaceable bottom portion 53 is brought into contact with a fixed plane 135 of the mounting unit 13 and is held there.

The operation lever 50 is elastically pressed by a coil spring (not shown) so that it can be pivoted in the direction J2. This coil spring is fixed in a state in which the coil is attached to the bearing 52 and one end thereof is in contact with the side plate 201A and the other end thereof is in contact with the body 51.

The displaceable bottom portion 53 is formed in a box-like shape within which a space is formed for storing the bottom portion of the body 51 and the coil spring 67 therein. As shown in FIGS. 10A and 10B, a projecting portion 51*c* provided at the bottom portion of the body 51 is fit into a guide groove 57 provided at a side of the displaceable bottom portion 53 so that it can be guided and moved in the directions K1 and K2.

A top edge 57*a* of the guide groove 57 is brought into contact with the projecting portion 51*c* of the body 51 so that the displaceable bottom portion 53 is prevented from moving in the direction K2 in which it separates from the bearing 52. A notch 53*b*, which is part of the top edge of the displaceable bottom portion 53, is brought into contact with a stoppage protruding portion 51*d* of the body 51 so that the displaceable bottom portion 53 is prevented from moving in the direction K1 in which it approaches the bearing 52.

Figure 39:
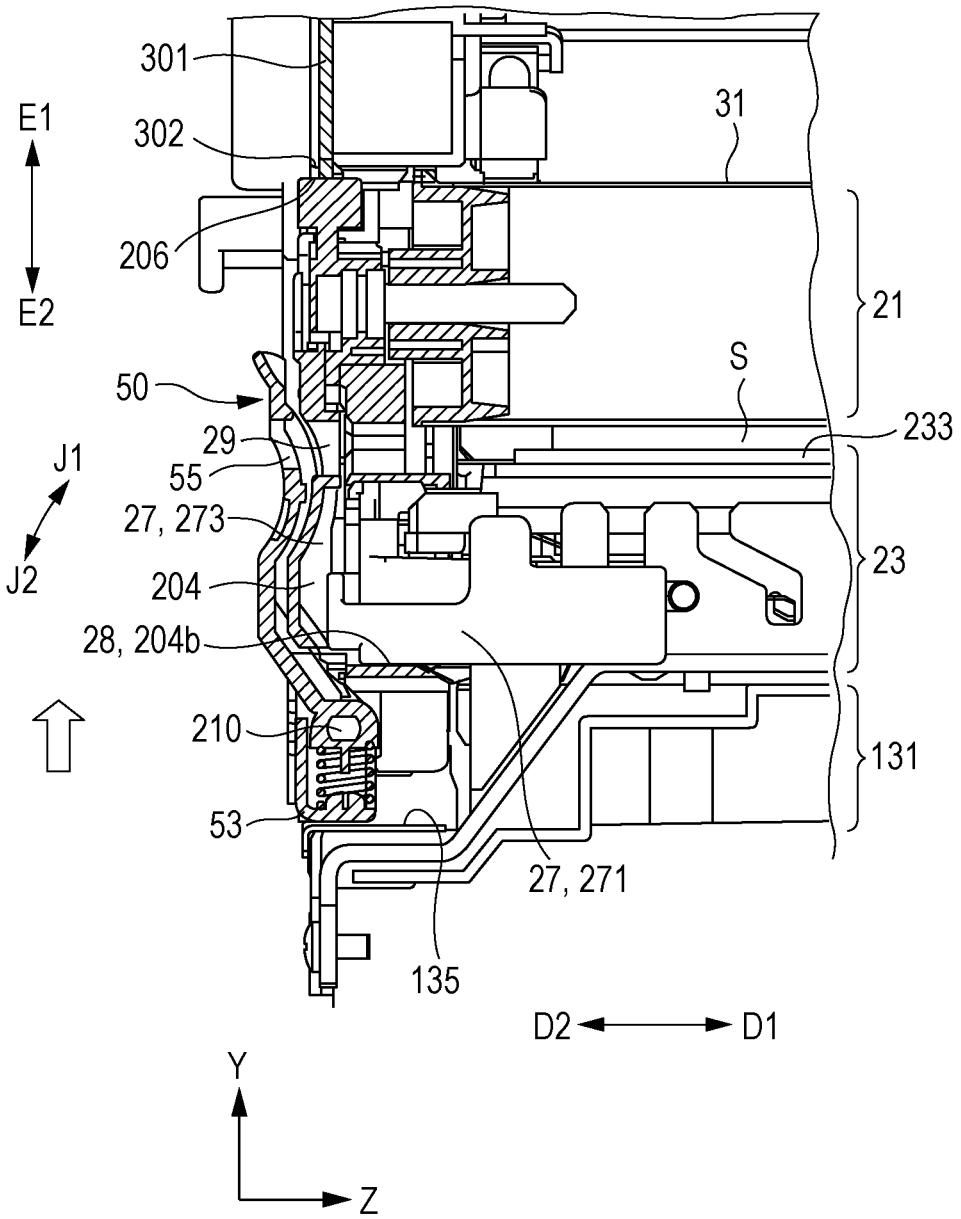
FIG. 39 is a sectional view illustrating the removable unit and the mounting unit taken along line XXXIX-XXXIX of FIG. 38.
Figure 43:
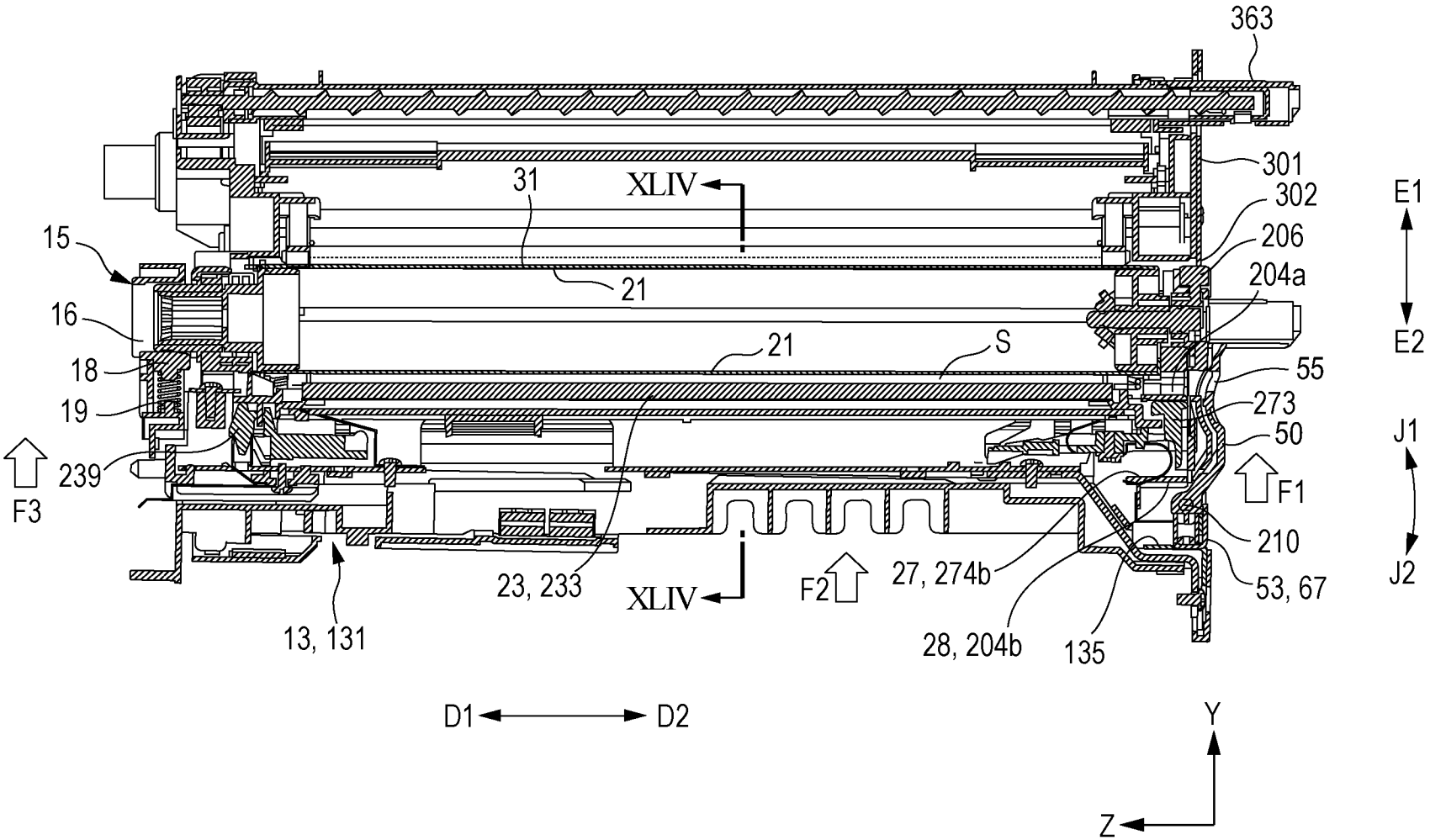
FIG. 43 is a sectional view illustrating the state of the removable unit shown in FIG. 42 positioned on the mounting unit and the state of the exposure device.

The coil spring 67 is disposed within the space of the displaceable bottom portion 53 in a state in which the top edge of the coil spring 67 is in contact with the bearing 52 and the bottom edge thereof is in contact with the inner bottom surface of the displaceable bottom portion 53. With this configuration, the displaceable bottom portion 53 is kept being elastically pressed in the direction K2 in which it separates from the bearing 52 due to a force F1 of the coil spring 67. Then, when the removable unit 20 is mounted on the mounting unit 13 and the operation lever 50 is pivoted (raised) in the direction J1, the displaceable bottom portion 53 is brought into contact with the fixed plane 135 of the mounting unit 13 and is held there (FIGS. 18 and 39). In this case, the displaceable bottom portion 53 is pressed by the force F1 of the coil spring 67. However, a reaction force (F1) against the force F1 is generated in the bearing 52, and acts as a force pressing the end (side plate 201A) of the removable unit 20 on the upstream side in the inserting direction D1, via the pivot shaft 210, in a direction M1 (FIG. 13) in which it approaches the intermediate transfer device 30 (FIGS. 18 and 43).

Storage Space for Exposure Device

In the removable unit 20, as shown in FIGS. 5 through 9, a space 203 for storing the exposure device 23 therein is provided between the developing device 24 and the drum cleaner 26.

The space 203 is, as a whole, a long, narrow space extending substantially along the directions D1 and D2 in which the removable unit 20 is inserted and removed. The end of the removable unit 20 on the downstream side (far end) in the inserting direction D1 is opened, while the end of the removable unit 20 on the upstream side (near end) in the inserting direction D1 is closed.

At the end of the removable unit 20 on the upstream side in the inserting direction D1, a driving and storing portion 204 is provided for driving (moving) and storing one end (driven portion 27) of the exposure device 23, which will be discussed later, when inserting the removable unit 20.

Structure Concerning Positioning of Removable Unit

Figure 9:
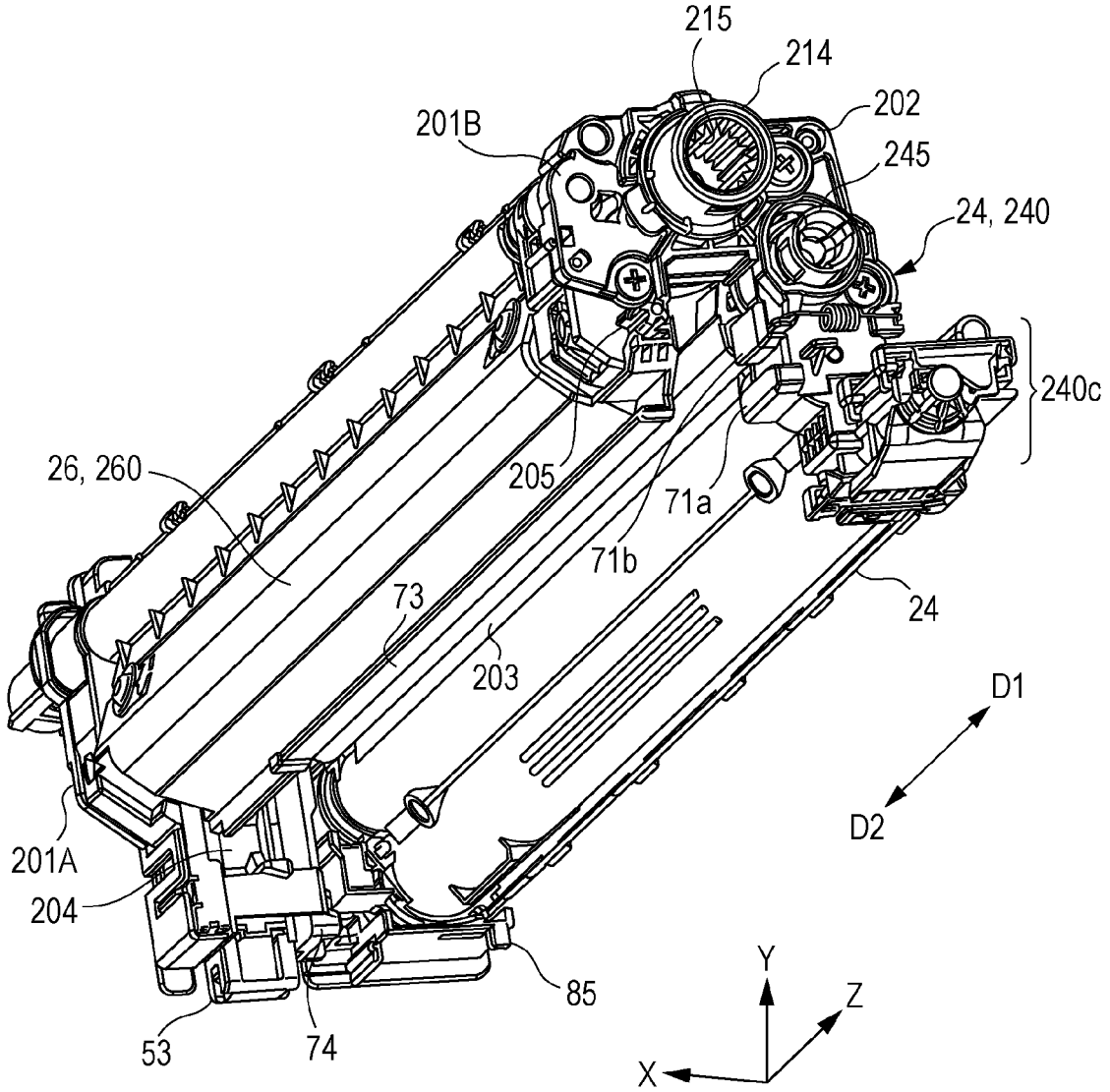
FIG. 9 is a perspective view illustrating the removable unit shown in FIG. 5, as viewed from obliquely downward.

As shown in FIGS. 5, 6, and 9, in the removable unit 20, a fixing protruding portion 205 is provided at the side plate 201B located at the downstream side (far end) in the inserting direction D1.

The protruding portion 205 is provided at the side plate 201B positioned under the drum cleaner 26 in a state in which it protrudes to the downstream side of the removable unit 20 in the inserting direction D1. The protruding portion 205 is inserted into a mounting hole 17 (FIG. 20) formed in a holding portion 15 (FIG. 20), which will be discussed later, of the mounting unit 13. By the provision of the protruding portion 205, the bottom portion of the side plate 201B is fixed to the holding portion 15.

As shown in FIGS. 4, 5, and 7, at the side plate 201A located on the upstream side (near end) of the inserting direction D1 of the removable unit 20, a contact surface 206 is provided for positioning the end of the removable unit 20 on the upstream side in the inserting direction D1 when inserting and storing the removable unit 20 in the mounting unit 13.

The contact surface 206 is provided at the top edge of the side plate 201A on substantially the same level as the arc-shaped outer peripheral surface of the photoconductor drum 21. The curvature of the contact surface 206 formed as an arc is substantially the same as that of the outer peripheral surface of the photoconductor drum 21. When positioning the removable unit 20 as described above, the contact surface 206 is brought into contact with a contact surface receiving portion 302 (FIG. 15), which will be discussed later, formed on a support plate 301 (FIG. 15) of the intermediate transfer device 30 located in the mounting unit 13, and is fit into the contact surface receiving portion 302. In this manner, when inserting and storing the removable unit 20 in the mounting unit 13, the contact surface 206 is able to position the photoconductor drum 21 of the removable unit 20 (more precisely, the end of the removable unit 20 on the upstream side in the inserting direction D1) to a contact position at which the photoconductor drum 21 is in contact with the intermediate transfer belt 31.

Structure Concerning Guiding of Removable Unit

As shown in FIGS. 5 through 9, a first guided portion (portion to be guided) 71 (FIG. 25) is provided at a position at which it faces the above-described space 203 in which the exposure device 23 is stored. A first guiding portion 75 (FIG. 13), which will be discussed later, of the exposure device 23 is fit into the first guided portion 71, so that the first guided portion 71 can be guided.

The first guided portion 71 includes two opposing protruding portions 71*a* and 71*b* and a guided space. The opposing protruding portions 71*a* and 71*b* are provided at the end of the housing 240 of the developing device 24 on the downstream side in the inserting direction D1. The opposing protruding portions 71*a* and 71*b* protrude within the space 203 and oppose each other while being vertically separated from each other. The guided space provided between the opposing protruding portions 71*a* and 71*b* receives the first guiding portion 75 therein. The first guided portion 71 is guided only when the first guiding portion 75 is fit into the guided space. Accordingly, the first guided portion 71 is used as a temporary guided portion to be guided by a temporary guiding portion.

As shown in FIGS. 5 through 9, at the bottom edge of a housing 260 of the drum cleaner 26 and at the bottom edge of the interconnecting member of the support frame 201, a second guided portion 73 is provided. The second guided portion 73 is engaged with a second guiding portion 77 (FIG. 20), which will be discussed later, of the mounting unit 13 so that it can be guided and supported.

The second guided portion 73 is provided as a plate-like member having a predetermined length (length by which the second guided portion 73 is guided) Gm2 (FIG. 25) along the inserting direction D1 and projecting in a direction opposite to the space 203 of the exposure device 23. When the second guided portion 73 is engaged with the second guiding portion 77 of the mounting unit 13, it guides the movement of the removable unit 20 in cooperation with the second guiding portion 77 and also allows the removable unit 20 to be supported by the mounting unit 13.

Figure 11:
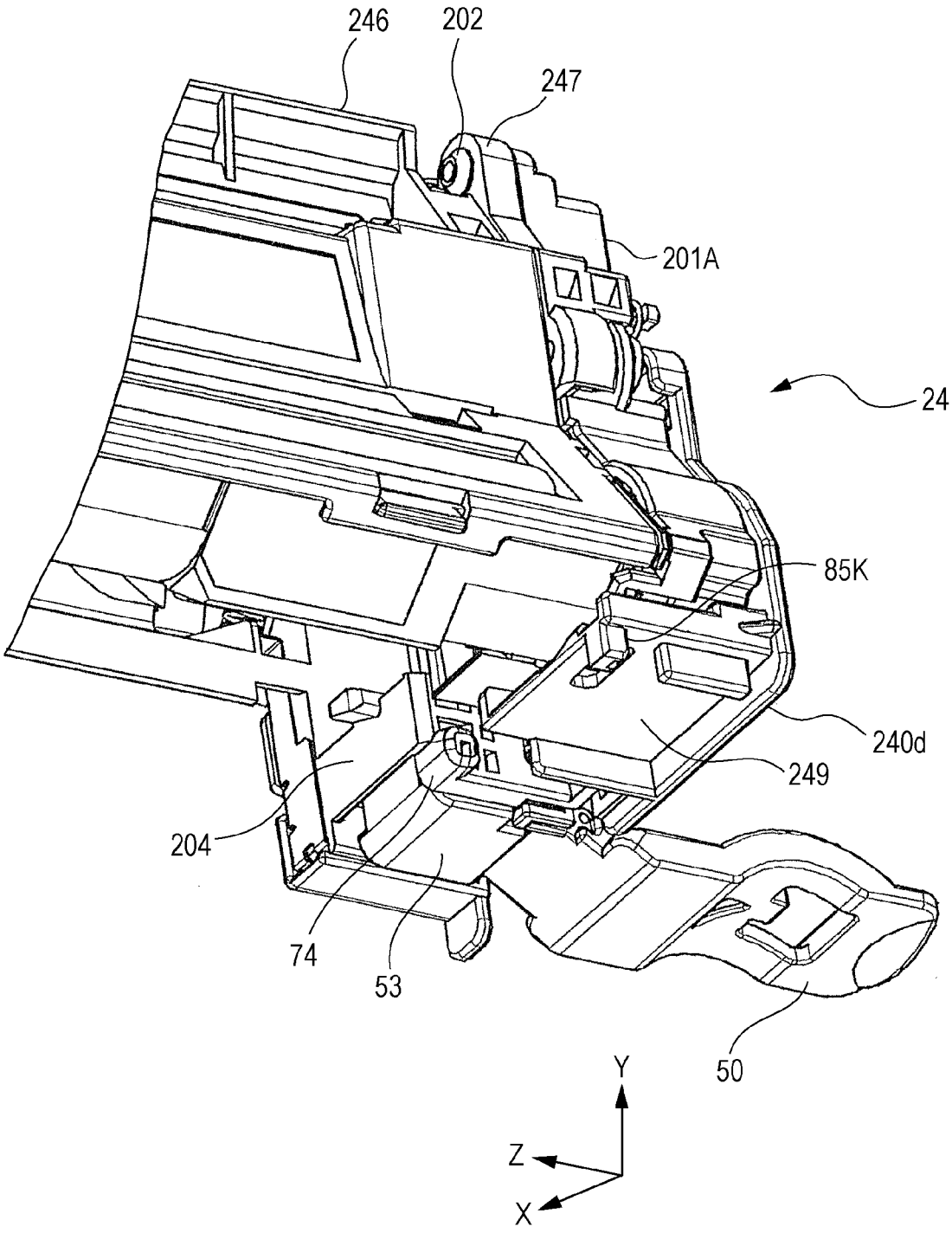
FIG. 11 is a perspective view illustrating the configuration of the bottom portion of the removable unit shown in FIG. 4, as viewed from the near end of the inserting direction of the removable unit.
Figure 12:
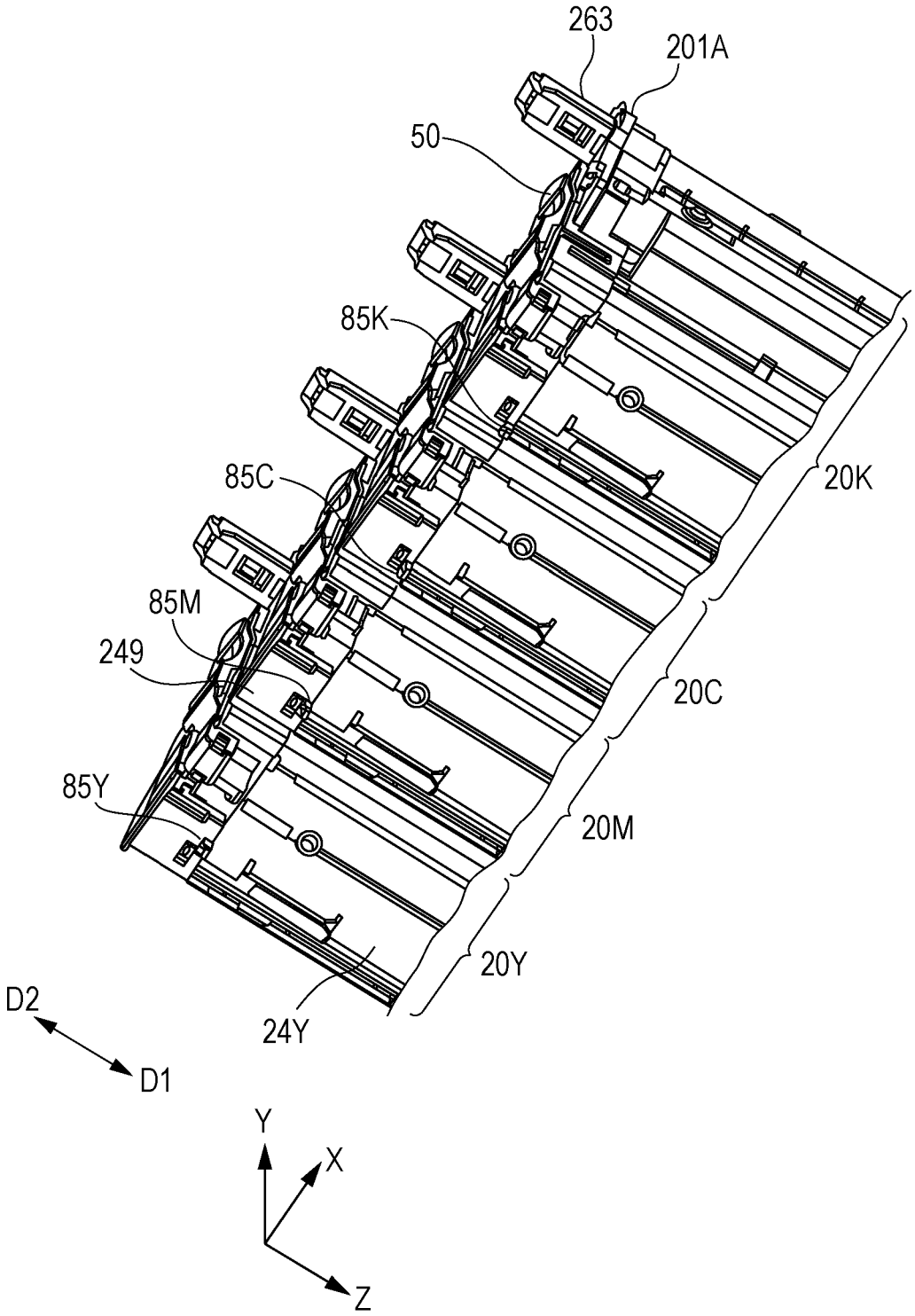
FIG. 12 is a perspective view illustrating projections, which serve as incorrect-mounting prevention members, of four removable units.

As shown in FIGS. 9 and 11, a protruding portion 74 is provided at the bottom portion of the side plate 201A of the support frame 201. The protruding portion 74 is fit into a protrusion mating portion 78 (FIG. 24), which will be discussed later, of the mounting unit 13 and so that it can be positioned and fixed.

The protruding portion 74 is formed at the bottom portion and inside of the side plate 201A, as a member which protrudes in a direction in which it faces the bottom edge of the housing 240 of the developing device 24 or a projection 85, which serves as an incorrect-mounting prevention member (discussed later). When positioning the removable unit 20 which has been inserted into the mounting unit 13, the protruding portion 74 is fit into the protrusion mating portion 78 of the mounting unit 13 and is then moved. As a result, the protruding portion 74 is fixed. In this manner, the bottom portion of the side plate 201A is fixed by the protruding portion 74.

Structure Concerning Incorrect-Mounting Prevention Member of Removable Unit

As shown in FIGS. 6, 7, 9, and 22, the projection 85 is provided as an incorrect-mounting prevention member, which will be discussed later. The projection 85 is fit into a projection mating groove 81 (FIG. 25), which serves as an incorrect-mounting prevention member, only when they match each other.

The projection 85 is provided on a compartment plane 249 at the bottom of the end of the housing 240 of the developing device 24 on the upstream side in the inserting direction D1. The compartment planes 249 formed in the developing devices 24 of the four removable units 20 have the same area. A total of four projections 85Y, 85M, 85C, and 85K are formed. Each of the projections 85Y, 85M, 85C, and 85K is formed at a predetermined position of the associated compartment plane 249 of the housing 240 of the developing device 24, as a configuration (for example, a prism) in which it projects downward by a predetermined length.

That is, each of the four projections 85Y, 85M, 85C, and 85K is formed at a position at which it matches one of the four projection mating grooves 81Y, 81M, 81C, and 81K, which will be discussed later. All the four projections 85Y, 85M, 85C, and 85K are formed in the same configuration, but are formed at different positions. A bottommost edge portion 240*d* shown in FIG. 11 protrudes farther downward than the above-described compartment plane 249 in the housing 240 of the developing device 24 so as to serve as a stoppage plate. The projection 85 is formed at a position farther inward from the inner surface of the bottommost edge portion 240*d* of the housing 240 by the length of the associated projection mating groove 81.

(Configuration of Exposure Device)

Figure 13:
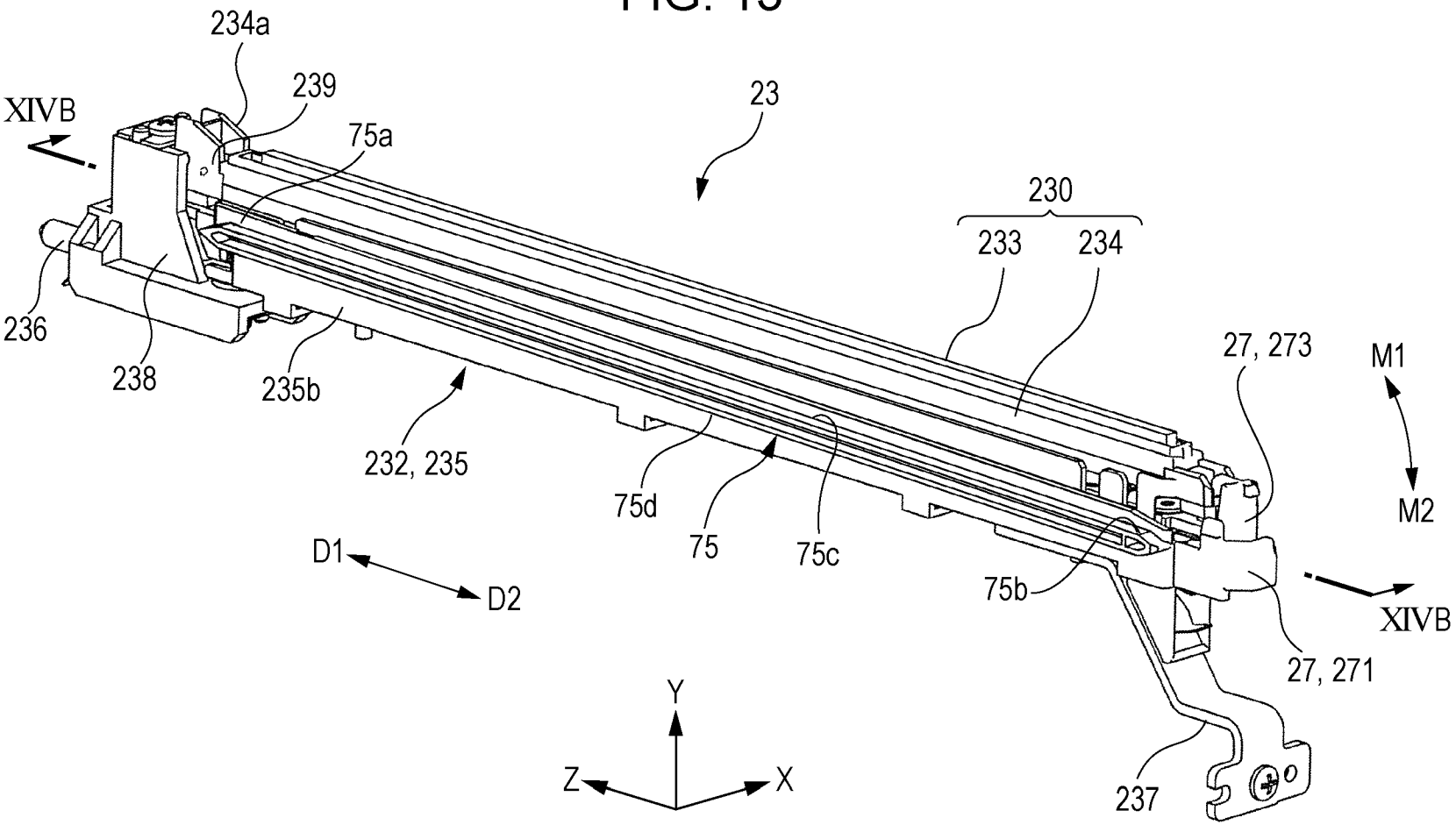
FIG. 13 is a perspective view illustrating an exposure device included in the image forming apparatus shown in FIG. 1.

As shown in FIG. 13, the exposure device 23 includes a light-emitting structure 230 and a support structure 232. The support structure 232 supports the light-emitting structure 230 so that the light-emitting structure 230 is movable in directions in which it approaches and separates from the photoconductor drum 21 (indicated by the arrows M1 and M2).

Figure 14B:
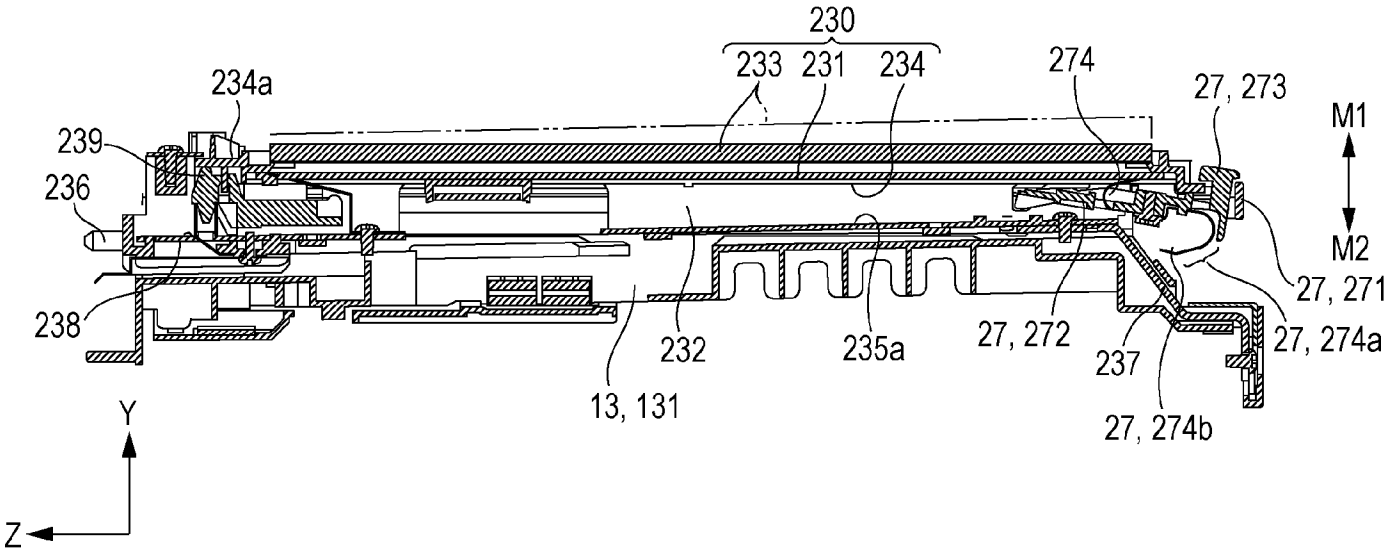
FIG. 14B is a sectional view illustrating the exposure device taken along line XIVB-XIVB of FIG. 13.

As shown in FIG. 14B, the light-emitting structure 230 includes a light source 231, an optical component 233, and a support member 234. The light source 231 includes plural light-emitting elements (such as light-emitting diodes (LEDs)) arranged on a substrate in the axial direction of the entire photoconductor drum 21. The optical component 233 is, for example, a lens which outputs light emitted from the light source 231 while focusing it on the photoconductor drum 21. The support member 234 supports the light source 231 and the optical component 233.

As shown in FIGS. 13 and 14B, the support structure 232 includes a gutter-like body 235, a mounting projection 236, and a mounting plate 237. In the body 235, a storage portion is formed for storing the light-emitting structure 230 therein. The mounting projection 236 and the mounting plate 237 are used for mounting the body 235 on the mounting unit 13 of the housing 10. The storage portion of the body 235 is formed as a space surrounded by a long, narrow rectangular bottom plate 235*a* extending in the axial direction of the photoconductor drum 21 and two opposing side plates 235*b* raised from the longitudinal ends of the bottom plate 235*a*.

The support structure 232 includes a pivoting support portion 238 at the longitudinal end of the storage portion of the body 235 on the downstream side of the inserting direction D1 of the removable unit 20. The pivoting support portion 238 pivotably supports the light-emitting structure 230. As shown in FIG. 14B, in the pivoting support portion 238, a pivot point member 239 is provided which is in point- or line-contact with an end portion 234*a* of the support member 234 of the light-emitting structure 230 on the downstream side of the inserting direction D1 so as to support the bottom of the end portion 234*a*. With this configuration, the light-emitting structure 230 within the storage portion of the support structure 232 pivots about the pivot point member 239 in the directions indicated by the arrows M1 and M2.

A driven portion 27 is provided at the end of the light-emitting structure 230 on the upstream side of the inserting direction D1 of the removable unit 20. The driven portion 27 is moved so that the light-emitting structure 230 will pivot in a direction in which it approaches the photoconductor drum 21 of the removable unit 20.

The driven portion 27 includes a frame-like portion 271, a pivoting member 272, a positioning contact member 273, and a leaf spring 274. The frame-like portion 271 extends and protrudes from the end of the support member 234 of the light-emitting structure 230 on the upstream side in the inserting direction D1. The pivoting member 272 pivots upward and downward, within the internal space of the frame-like portion 271, about a pivot point positioned on the bottom surface of the support member 234. The positioning contact member 273 is provided at the forward end of the pivoting member 272, and is brought into contact with a contact receiving surface 204*a*, which is a top surface of the driving and storing portion 204, at the side plate 201A of the removable unit 20. The leaf spring 274 elastically presses the pivoting member 272 so that the pivoting member 272 may be pivotable downward.

When mounting the removable unit 20 on the mounting unit 13, the driven portion 27 contacts a driving portion 28, which will be discussed later, provided in the driving and storing portion 204 of the removable unit 20, and is moved. As a result, the driven portion 27 is driven so that the end of the light-emitting structure 230 on the upstream side in the inserting direction D1 is shifted in the direction M1 in which it approaches the photoconductor drum 21. In contrast, when the driven portion 27 is not in contact with the driving portion 28, the end of the light-emitting structure 230 stored within the storage portion of the support structure 232 on the upstream side in the inserting direction D1 is shifted in the direction M2 in which it separates from the photoconductor drum 21 by gravity.

As shown in FIGS. 9 and 14A, the driving and storing portion 204 of the removable unit 20 is a structure within which a space for storing the driven portion 27 is formed at the bottom portion of the side plate 201A which faces the space 203 for storing the exposure device 23. As shown in FIG. 14A, the driving and storing portion 204 has a contact receiving surface (top surface) 204*a* and a lower inner wall surface (bottom surface) 204*b*, which are formed as substantially flat surfaces parallel with the axis direction of the photoconductor drum 21 of the removable unit 20.

The driving portion 28 provided in the driving and storing portion 204 is formed as the lower inner wall surface (bottom surface) 204*b* of the driving and storing portion 204. The driving portion 28 is formed in a shape and has strength so as to receive a force (F2) of the leaf spring 274 of the driven portion 27.

As shown in FIG. 14B, the leaf spring 274, as a whole, is formed as a spring bent in the shape of an S. The central portion of the leaf spring 274 is fixed to the pivoting member 272, and the top end thereof is in contact with part of the support member 234 or the frame-like portion 271 of the light-emitting structure 230, and the bottom end thereof is exposed below the pivoting member 272 and the frame-like portion 271 as a free end.

The leaf spring 274, in particular, the bottom end portion of the S-shape, is constituted by an introduction surface 274*a* and an installation surface 274*b*. The introduction surface 274*a* is formed as an upgrade slope which makes it easy for the driven portion 27 to be inserted into the internal space (particularly, the lower inner wall surface 204*b*) of the driving and storing portion 204 when inserting the removable unit 20 into the mounting unit 13. When the removable unit 20 is mounted on the mounting unit 13, the installation surface 274*b* becomes a flat surface, which is stably fixed on the lower inner wall surface 204*b* of the driving and storing portion 204.

The leaf spring 274 also serves as a first pressing member for elastically pressing the light-emitting structure 230 of the exposure device 23 against the photoconductor drum 21 when the final positioning of the removable unit 20 is performed after the driven portion 27 of the exposure device 23 has been stored in the driving portion 28 provided in the storage space of the driving and storing portion 204. Accordingly, the leaf spring 274 is set such that it presses the light-emitting structure 230 against the photoconductor drum 21, for example, with a predetermined force F2 (FIG. 43).

In the support structure 232, the first guiding portion 75 is provided in one of the two opposing side plates 235*b* forming the storage portion of the body 235. The first guiding portion 75 guides the insertion and the removal of the removable unit 20 into and from the mounting unit 13.

Figure 25:
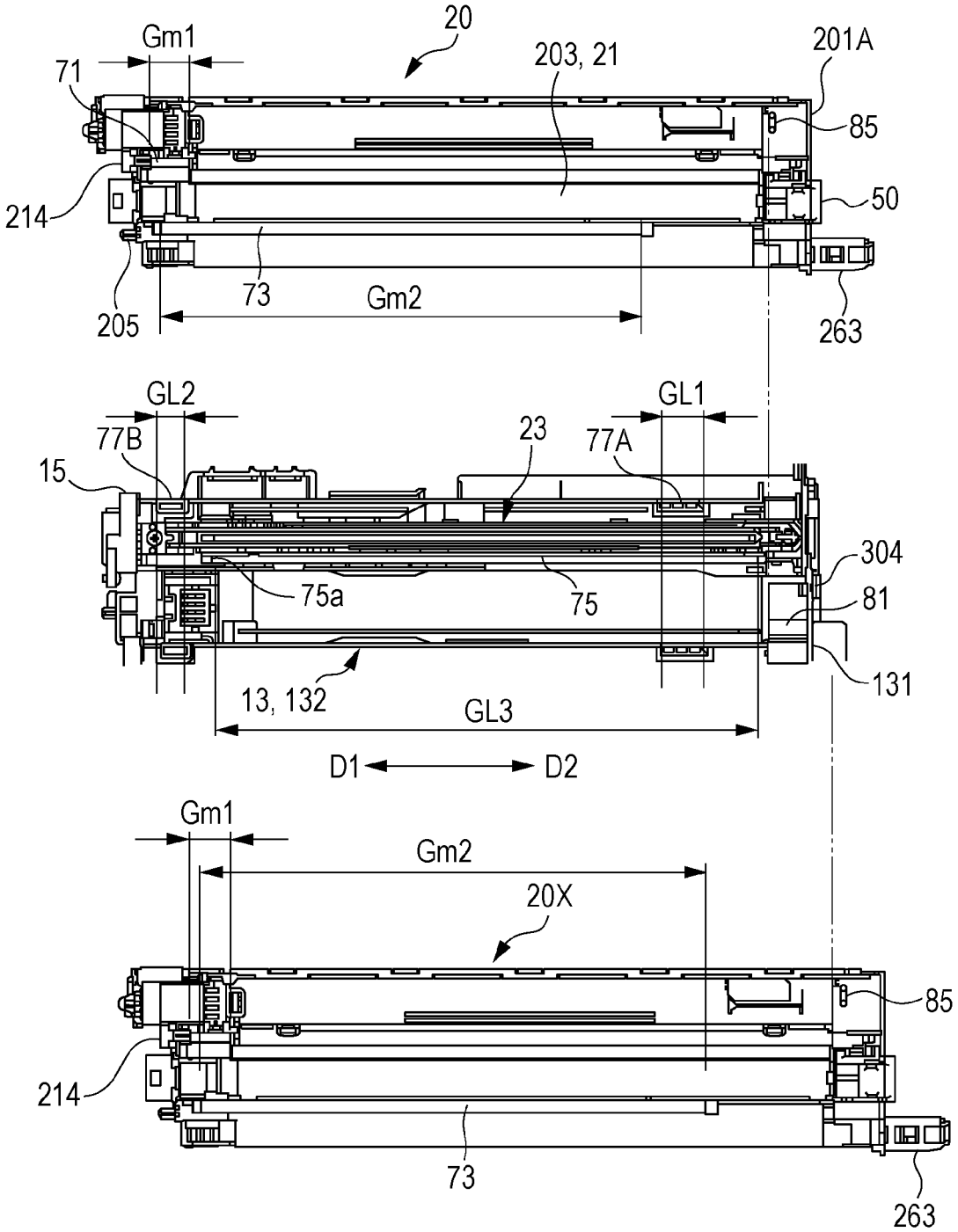
FIGS. 25 and 26 illustrate the relationships between guiding portions provided in the mounting unit shown in FIG. 20 and guided portions provided in the removable unit shown in FIG. 4.

The first guiding portion 75 is provided on the outer surface of one of the opposing side plates 235*b* of the support structure 232 located at a position facing the developing device 24. The first guiding portion 75 is formed as a rail-like shape linearly extending along the inserting direction D1 and the removing direction D2 of the removable unit 20 by a predetermined length (length by which the first guiding portion 75 guides the first guided portion 71) GL3 (FIGS. 13 and 25). As discussed above, the inserting direction D1 of the removable unit 20 is a direction inclined upward toward the downstream side of the inserting direction D1. In accordance with this inclined direction, an end 75*a*, which is the downstream side in the inserting direction D1, of the first guiding portion 75 is located at a relatively high position compared with an end 75*b*, which is the upstream side in the inserting direction D1. The first guiding portion 75 has linear guiding surfaces 75*c* and 75*d* which extend upward in accordance with the above-described inclined direction D1.

When the first guiding portion 75 is fit into the first guided portion 71 of the removable unit 20, it guides the removable unit 20 along the inserting direction D1 or the removing direction D2. However, the first guiding portion 75 serves as a temporary guiding portion for guiding the removable unit 20 only when it is fit into the first guided portion 71. This will be discussed later.

As shown in FIGS. 14B, 15, 20, and 29, the exposure device 23 configured as described above (more specifically, the support structure 232) is mounted on a predetermined portion (installation surface 133 in FIG. 21) of the mounting unit 13 of the housing 10.

(Configuration of Mounting Unit of Housing)

As shown in FIGS. 15 and 20 through 22, the mounting unit 13 of the housing 10 on which the individual removable units 20 are removably mounted includes a mounting table 131, holding portions 15, and a support plate 301. On the mounting table 131, the four removable units 20 are installed. The holding portions 15 are disposed at the downstream side (far end) in the inserting direction D1 of the removable units 20. The support plate 301 is disposed at the front side (near side) of the intermediate transfer device 30 and above a portion of the mounting table 131 on the upstream side (near end) in the inserting direction D1.

Figure 21:
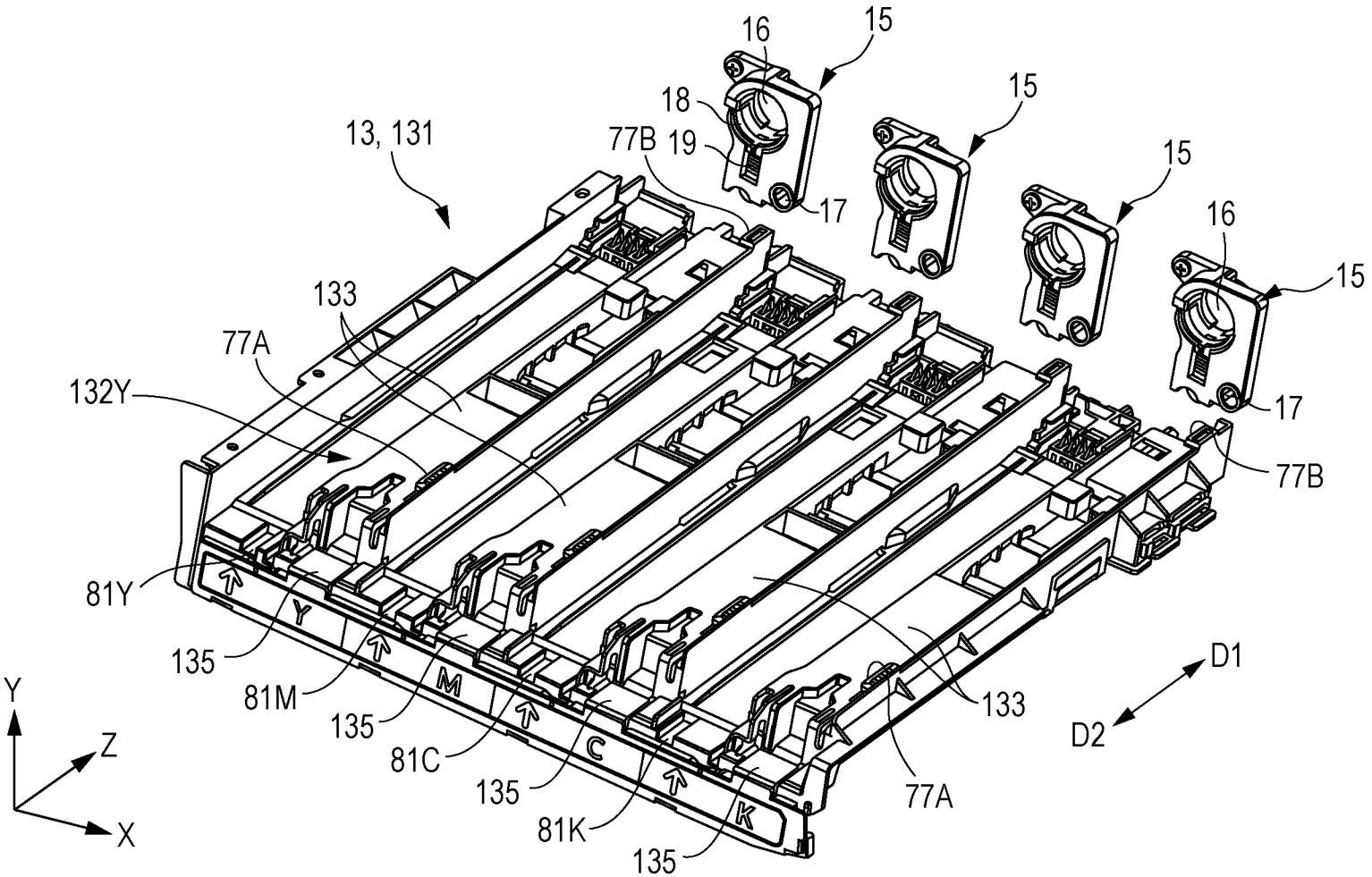
FIG. 21 is a perspective view illustrating the mounting unit shown in FIG. 20 from which an intermediate transfer device, an exposure device, and a back-side support plate are removed.
Figure 22:
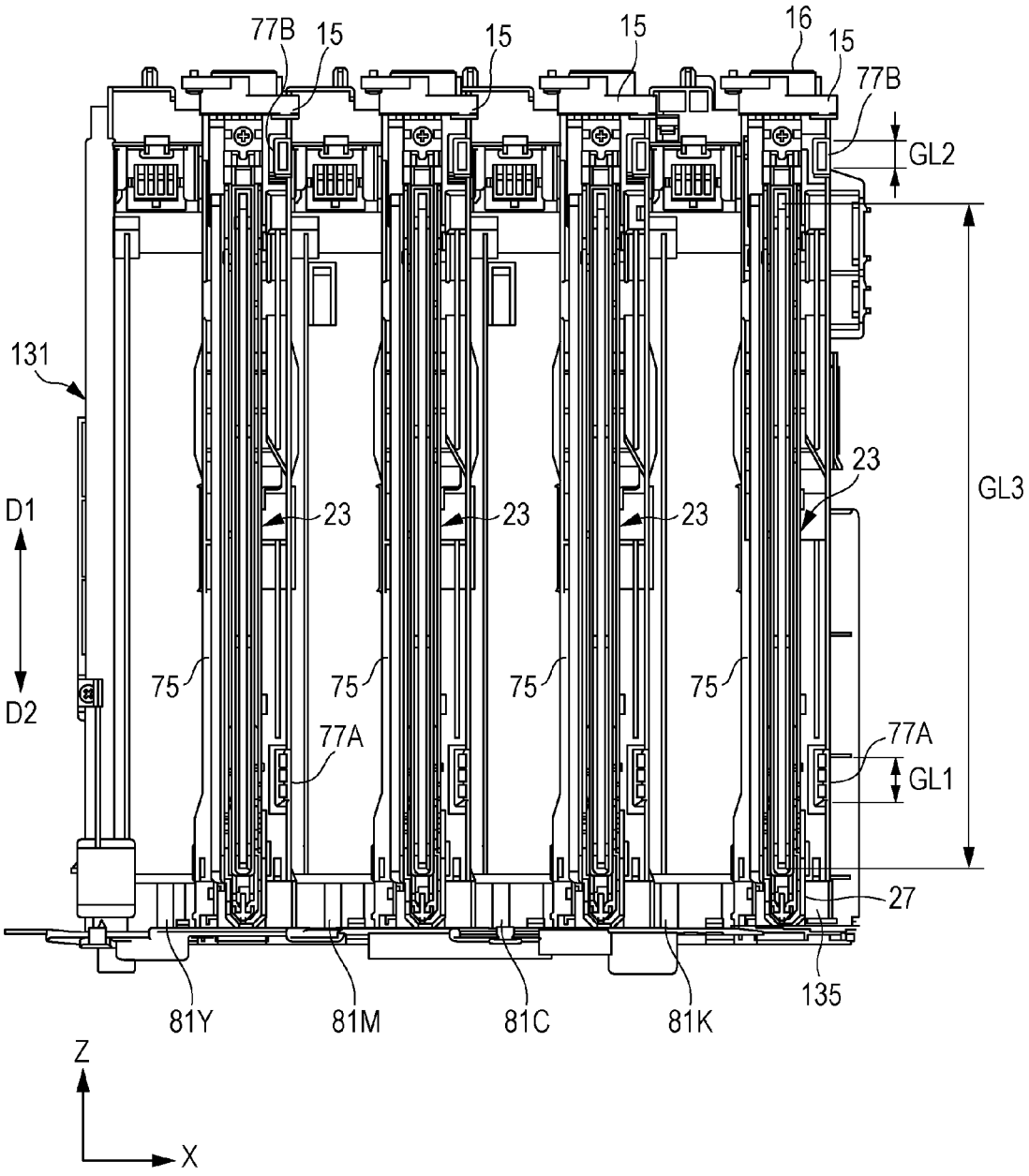
FIG. 22 is a plan view illustrating the mounting unit shown in FIG. 21 to which an exposure device is attached.

The mounting table 131 is partitioned into mounting portions 132 on which the four removable units 20Y 20M, 20C, and 20K are mounted. For example, on the mounting portion 132Y, the removable unit 20Y is mounted. The mounting table 131 is disposed obliquely within the housing 10 with respect to a reference level (FIGS. 18 and 21), in accordance with the state in which the removable units 20 are obliquely disposed with respect to the reference level, as discussed above. The mounting portions 132 extend along the inserting direction D1 and the removing direction D2 of the removable units 20. In part of each of the mounting portions 132, the installation surface 133 on which the exposure device 23 is mounted is formed (FIG. 21).

In each of the mounting portions 132, second guiding portions 77A and 77B are provided at the top edge of a part of the mounting portion 132, which also serves as a boundary partition intervening between the mounting portions 132. When the second guided portion 73 of each removable unit 20 is engaged with the second guiding portions 77A and 77B, the second guiding portions 77A and 77B guide the movement of the removable unit 20 and also support the removable unit 20.

The second guiding portions 77A and 77B are formed at predetermined two areas (positions) in the inserting direction D1 of the removable unit 20 on the top edge of part of the mounting portion 132, which also serves as a boundary partition. The second guiding portions 77A and 77B are formed as plate-like portions which bend inward and form a guiding space downward. Guiding lengths GL of the second guiding portions 77A and 77B in the inserting direction D1 are set to be predetermined lengths GL1 and GL2, respectively (FIG. 25).

The positional relationships between the second guiding portions 77A and 77B and the removable unit 20 are as follows (FIG. 25). While the removable unit 20 is (in the process of) being mounted on the mounting portion 32 (FIG. 46A), the second guided portion 73 of the removable unit 20 is engaged with at least the second guiding portion 77A on the upstream side in the inserting direction D1 or both of the second guiding portions 77A and 77B. When the removable unit 20 is properly mounted on the mounting portion 32, the second guided portion 73 is engaged with the second guiding portion 77B on the downstream side in the inserting direction D1.

The holding portion 15 is disposed in association with each of the mounting portions 132 of the mounting unit 13. The holding portion 15 is provided on a plate-like body, and includes a holding hole 16 and a mounting hole 17. The shaft 214 of the photoconductor drum 21 of each removable unit 20 is inserted into the holding hole 16 and is held therein. The protruding portion 205 of each removable unit 20 is inserted into the mounting hole 17 and is held therein. The holding portion 15 is fixed by a support frame (not shown) disposed at the far end of the mounting unit 13.

A pressing member 18 is provided at the bottom portion of the holding hole 16. The pressing member 18 elastically presses the shaft 214 of the photoconductor drum 21 toward the top surface of the holding hole 16. The pressing member 18 includes a body and a coil spring 19. The body has a semi-circle pressing surface which is fixed to the body of the holding portion 15 such that it is displaceable upward and downward. The coil spring 19 elastically presses this body of the pressing member 18 upward.

As shown in FIG. 15, the support plate 301 at the front side of the intermediate transfer device 30 is a plate-like member supporting the intermediate transfer belt 31, the plural support rollers 32, and the belt cleaner 36. The support plate 301 is disposed at a position on the upstream side (near end) of the inserting direction D1 of the removable unit 20. A discharge terminating portion 363 is part of a transport pipe which transports toner removed by the belt cleaner 36.

The support plate 301 is formed in a configuration, as a whole, having a bottom side 301*a* extending in substantially parallel with the tilting surface of the mounting table 131. On the bottom side 301*a*, four contact surface receiving portions 302 and four third guiding portions 304 are provided. The positioning contact surface 206 provided at the side plate 201A of the removable unit 20 is brought into contact with the contact surface receiving portion 302 so as to position the photoconductor drum 21 of the removable unit 20. When the projecting edge portion 246 of the developing device 24 of the removable unit 20 is brought into contact with the third guiding portion 304, the third guiding portion 304 guides the insertion and the removal of the removable unit 20.

In the contact surface receiving portion 302, a contact area is provided at a position facing the positioning contact surface 206. The contact area is formed as an arc-like shape which matches the configuration of the positioning contact surface 206. The third guiding portion 304 is provided at a position facing the projecting edge portion 246. The third guiding portion 304 is formed as a plate-like member which guides the movement of the removable unit 20 which is being mounted on or dismounted from the mounting unit 13 while regulating the displacement of the removable unit 20 (particularly, the displacement in the direction E1 in which the removable unit 20 approaches the intermediate transfer belt 31). Accordingly, the third guiding portion 304 serves as a regulating member while the removable unit 20 is being mounted on or dismounted from the mounting unit 13.

In the mounting unit 13, as shown in FIGS. 20 through 23, projection mating grooves 81, which serve as incorrect-mounting prevention members for the removable units 20, are provided at the end of the mounting table 131 on the upstream side in the inserting direction D1.

Figure 23:
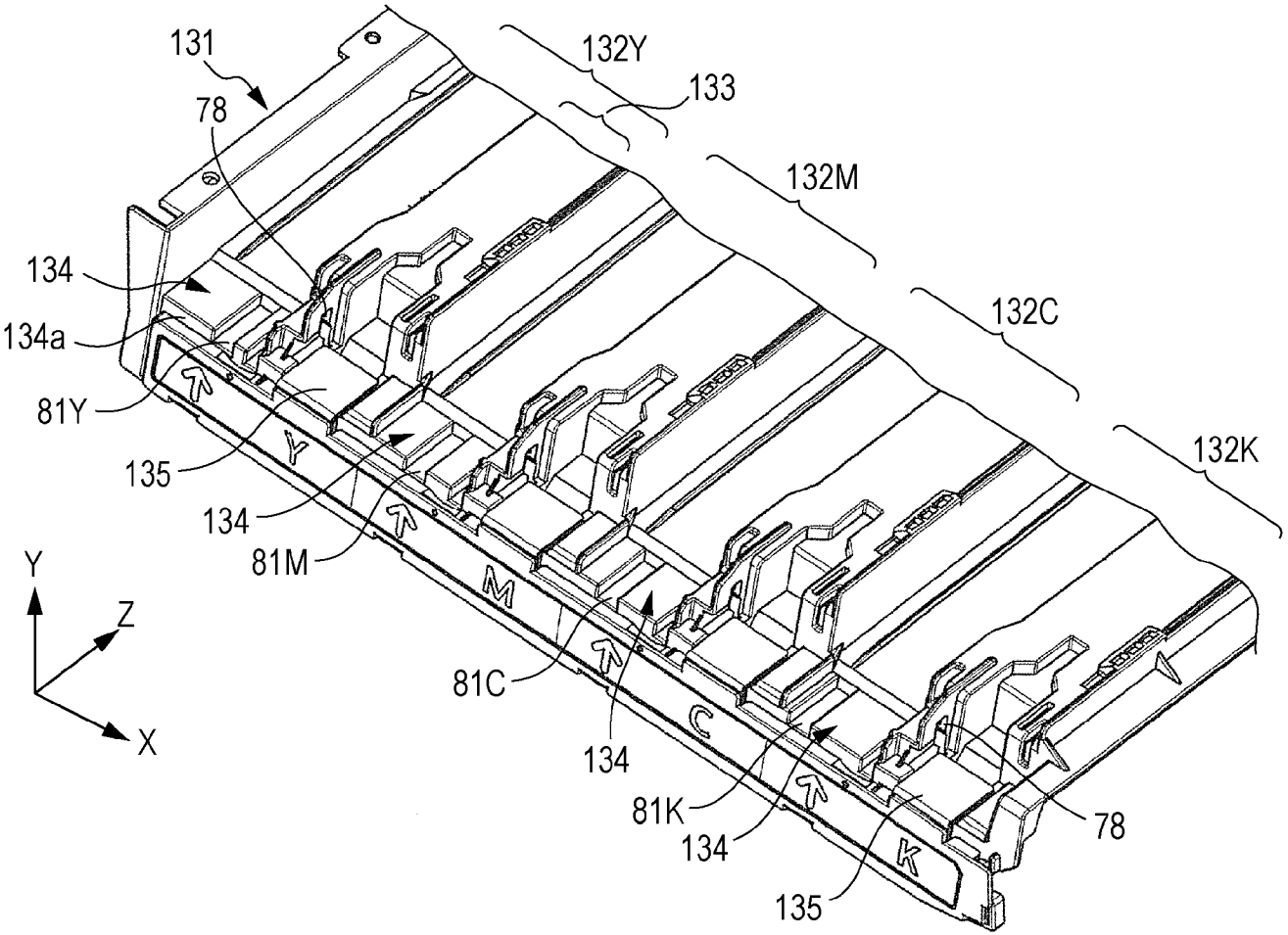
FIG. 23 is a perspective view illustrating an end portion of the mounting unit shown in FIG. 21, as viewed from the near end of the inserting direction of a removable unit.

The projection mating groove 81 is provided in each of the mounting portions 132 of the mounting table 131, and a total of four projection mating grooves 81 are formed. As shown in FIG. 23, the projection mating grooves 81 are formed at predetermined positions of compartment planes 134 having the same area at the end of the mounting table 131. The projection mating grooves 81 have a predetermined depth and length extending in the inserting direction D1 of the removable unit 20. The projection mating grooves 81 are formed as an upward opening linear groove-like shape. The depth of the projection mating grooves 81 is set to be slightly greater than the height of the projections 85 of the removable units 20. The length of the projection mating grooves 81 in the inserting direction D1 is the same. The length of the projection mating groove 81 is a length by which the projection 85 can be stopped at a predetermined insertion stoppage position by colliding against it when the removable unit 20 is inserted into the mounting unit 13.

In the exemplary embodiment, the positions at which the projection mating grooves 81 are formed in the compartment planes 134 in a direction intersecting with the inserting direction D1 are as follows, as shown in FIGS. 20 and 23. The projection mating groove 81Y is formed at the rightmost position in the compartment plane 134. The projection mating groove 81M is formed at a position slightly rightward with respect to the center of the compartment plane 134. The projection mating groove 81C is formed at a position slightly leftward with respect to the center of the compartment plane 134. The projection mating groove 81K is formed at the leftmost position in the compartment plane 134. The projections 85Y, 85M, 85C, and 85K are formed at positions of the removable units 20 associated with those of the projection mating grooves 81Y, 81M, 81C, and 81K, respectively.

As shown in FIGS. 21 and 23, fixed planes 135 are provided at the end of the mounting table 131 on the upstream side in the inserting direction D1. The fixed plane 135 is used for holding the displaceable bottom portion 53, which is the bottom edge of the operation lever 50 of the removable unit 20.

The fixed plane 135 is provided in each of the mounting portions 132. The top surface of the fixed plane 135 is formed as, for example, a flat surface. When the operation lever 50 is operated upon positioning the removable unit 20, the displaceable bottom portion 53 of the operation lever 50 is moved and is contact with the fixed plane 135. At this time, the fixed plane 135 holds the displaceable bottom portion 53.

Figure 24:
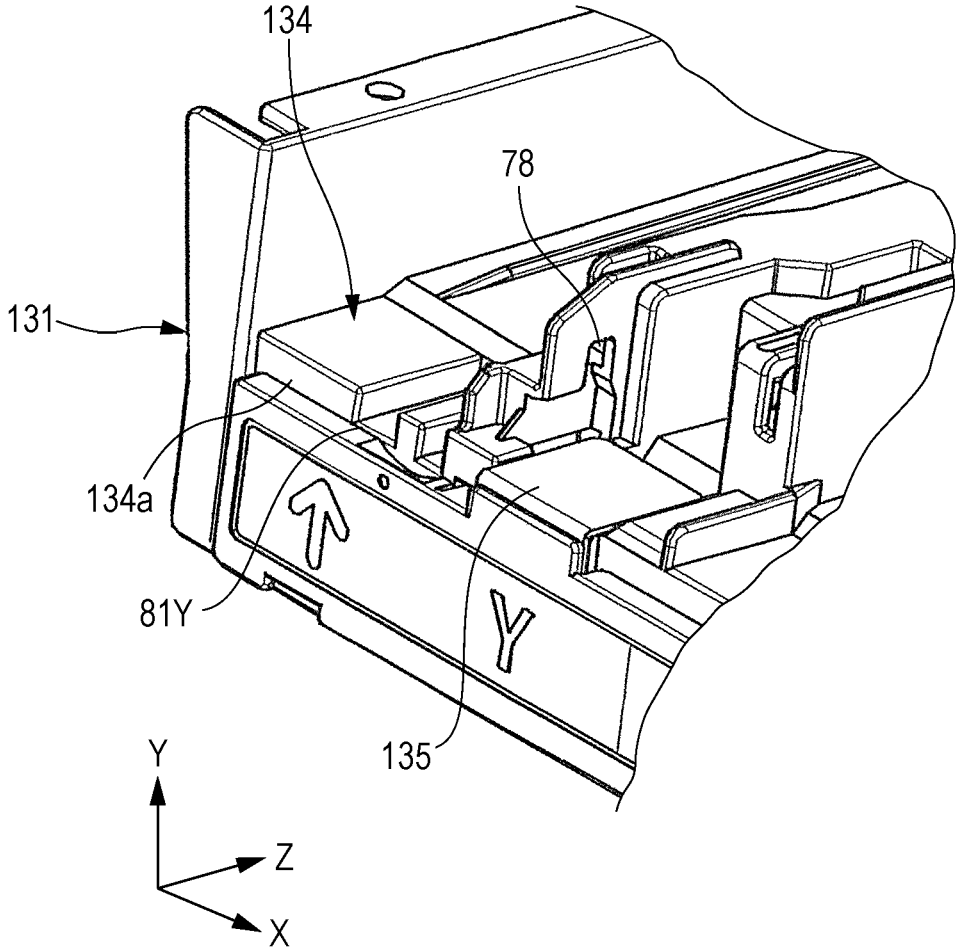
FIG. 24 is a partially enlarged perspective view illustrating the end portion of the mounting unit shown in FIG. 23.

As shown in FIGS. 23 and 24, in the mounting unit 13, protrusion mating portions 78 are provided at the end of the mounting table 131 on the upstream side in the inserting direction D1. The protruding portion 74 of the removable unit 20 is inserted into the protrusion mating portion 78 and is held.

The protrusion mating portion 78 is formed as an upward closed notch-like shape. The protrusion mating portion 78 is notched upward in a direction in which the end of the removable unit 20 on the upstream side in the inserting direction D1 is displaced and positioned in the mounting unit 13 (in the direction E1 in which the removable unit 20 approaches the intermediate transfer belt 31). The protrusion mating portion 78 is formed at the end of the fixed plane 135 closer to the projection mating groove 81. The protrusion mating portion 78 is also provided in each of the mounting portions 132.

FIG. 25 shows the forming positions of the first and second guided portions 71 and 73 provided in the removable unit 20 and the lengths Gm by which they are guided. FIG. 25 also shows the forming positions of the first guiding portion 75 provided in the exposure device 23 of the mounting unit 13 and the second guiding portions 77A and 77B provided in each mounting portion 132 of the mounting unit 13, and the lengths GL by which the first guiding portion 75 and the second guiding portions 77A and 77B guide the first and second guided portions 71 and 73, respectively.

In FIG. 25, the middle section shows one mounting portion 132 of the mounting unit 13, and the upper section shows a removable unit 20 which has been completely and correctly inserted, as viewed from the bottom surface, while the lower section shows a removable unit 20X which is being inserted incorrectly, as viewed from the bottom surface.

The first guiding portion 75 of the exposure device 23 of the mounting unit 13 has a relatively long length G3 along the inserting direction D1 and guides the first guided portion 71 by relatively a long length. The end 75*a* of the first guiding portion 75 is located at a position before it reaches a position at which the first guided portion 71 is not guided.

The second guiding portions 77A and 77B of the mounting unit 13 respectively have lengths GL1 and GL2 and are respectively positioned at the end of the upstream side and at the end of the downstream side in the inserting direction D1. The second guiding portion 77A first starts to guide the second guided portion 73 of the removable unit 20, and then, the second guiding portion 77B starts to guide the second guided portion 73, together with the second guiding portion 77A. The second guiding portions 77A and 77B guide and support, in cooperation with each other, the second guided portion 73 of the removable unit 20 which has been correctly inserted, as shown in the upper section of FIG. 25.

Figure 26:
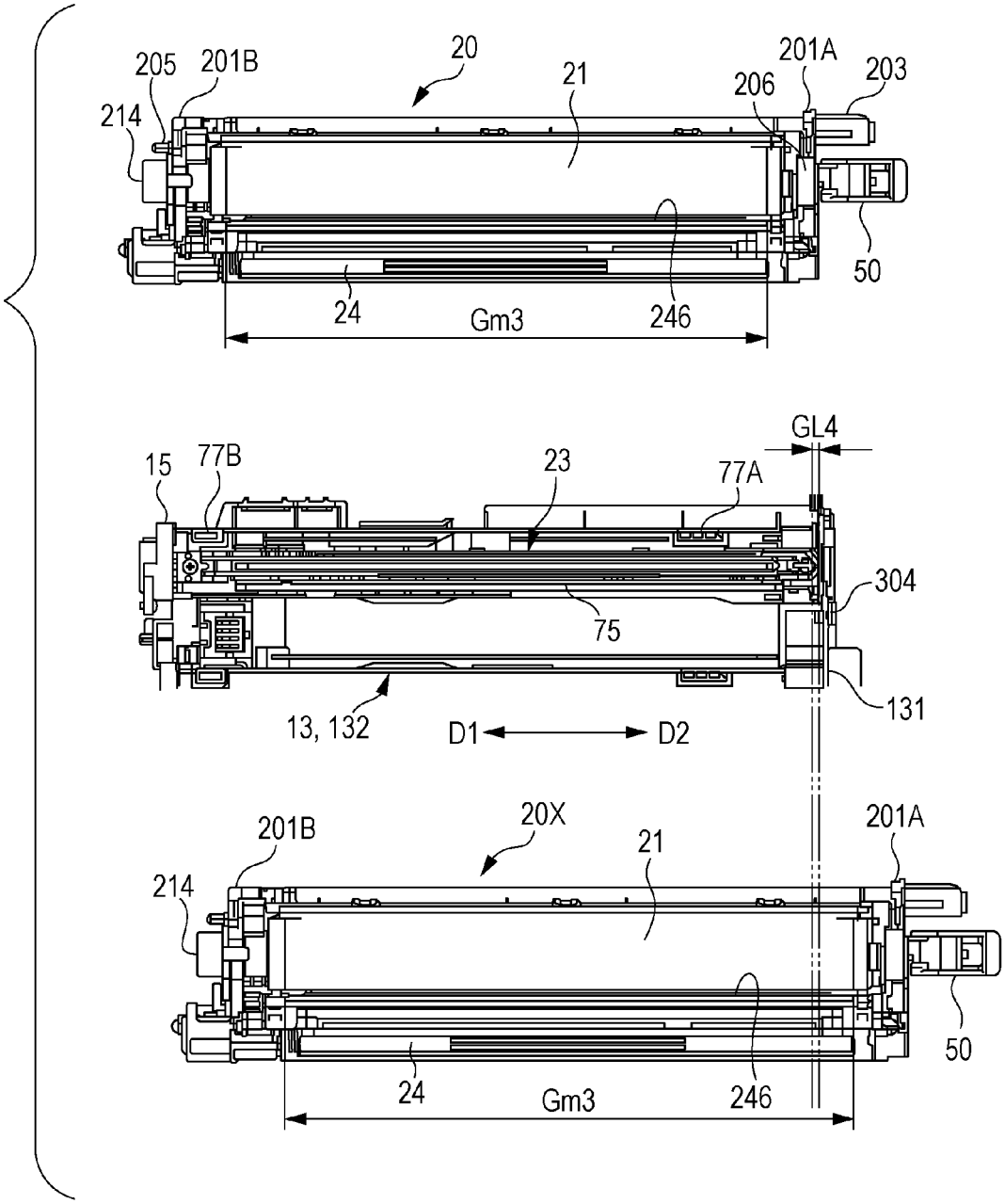

FIG. 26 shows the forming position of the projecting edge portion 246, which serves as a regulating member, provided in the developing device 24 of the removable unit 20 and the length Gm by which the projecting edge portion 246 is guided. FIG. 26 also shows the forming position of the third guiding portion 304 provided on the support plate 301 of the intermediate transfer device 30 of the mounting unit 13 and the length GL by which the third guiding portion 304 guides the projecting edge portion 246.

As in FIG. 25, in FIG. 26, the middle section shows one mounting portion 132 of the mounting unit 13, and the upper section shows a removable unit 20 which has been completely and correctly inserted, as viewed from the bottom surface, while the lower section shows a removable unit 20X which is being inserted incorrectly, as viewed from the bottom surface.

The third guiding portion 304 has a short length G4 and is located at the end of the upstream side in the inserting direction D1, and guides the projecting edge portion 246 of the removable unit 20 by relatively a long length corresponding to a length Gm3 shown in FIG. 26. The third guiding portion 304 is located at a position at which it does not guide the projecting edge portion 246 of the removable unit 20 which has been correctly inserted shown in the upper section of FIG. 26. More specifically, the third guiding portion 304 is located at the extreme edge on the upstream side in the inserting direction D1.

(Details of Mounting and Dismounting Operation of Removable Unit)

Operations for mounting and dismounting the removable units 20 on and from the mounting unit 13 will be described below in detail.

Insertion Process in Mounting of Removable Unit

Figure 33:
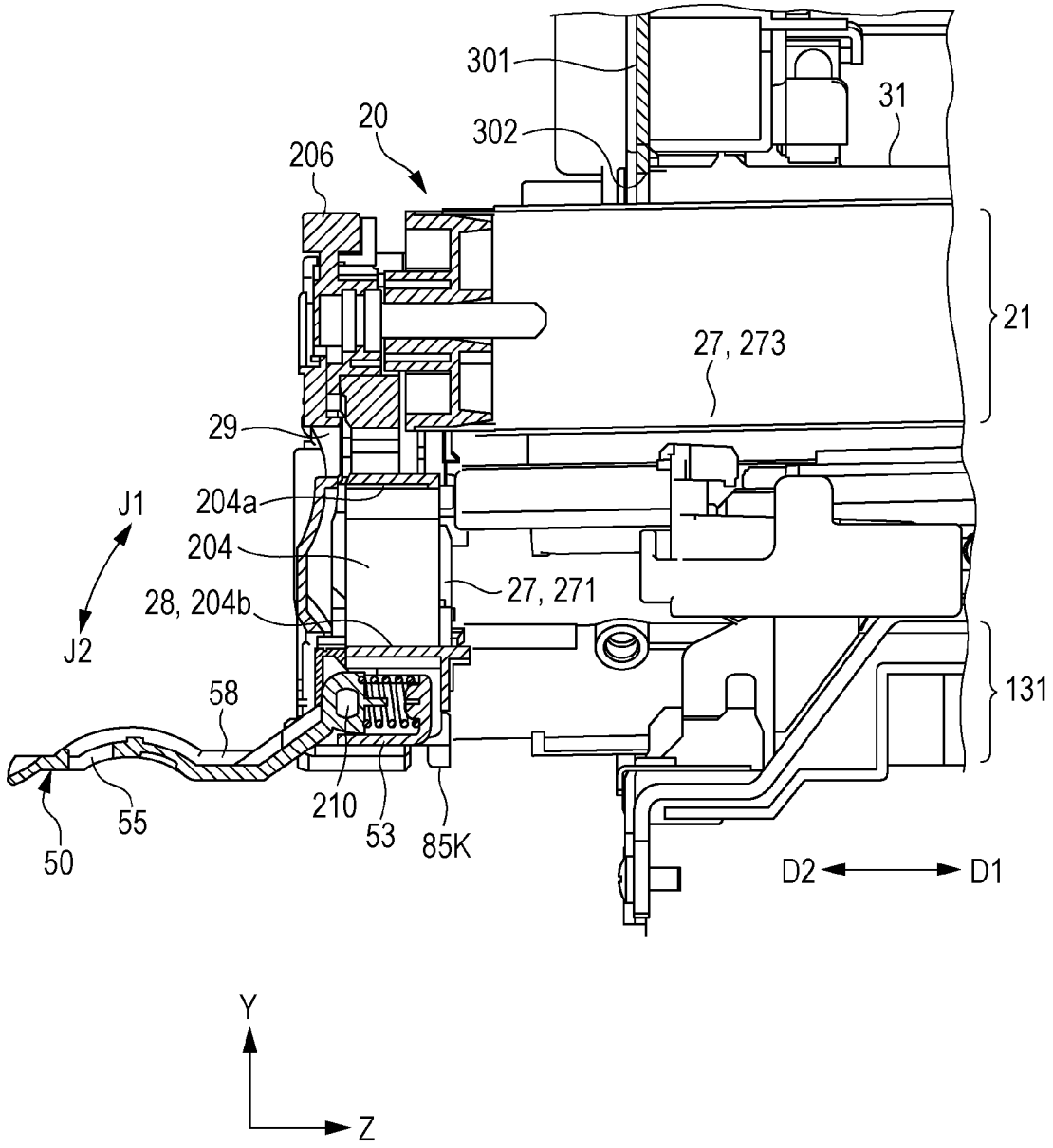
FIG. 33 is a sectional view illustrating the removable unit and the mounting unit taken along line XXXIII-XXXIII of FIG. 32.

Mounting of the removable units 20 on the mounting unit 13 is started by inserting each removable unit 20 into the associated mounting portion 132 of the mounting unit 13, as shown in FIG. 15. More specifically, the removable unit 20 is shifted along the inserting direction D1 to be inserted into the associated mounting portion 132, from the side of the side plate 201B on which the shaft 214 of the photoconductor drum 21 is provided. In this case, the operation lever 50 is in a lying position (pivoted in the direction J2, as shown in FIGS. 16 and 33).

Then, the removable unit 20 is shifted toward a space formed between the mounting table 131 of the mounting unit 13 and the support plate 301 of the intermediate transfer device 30 so that the exposure device 23 attached to the mounting portion 132 can be inserted into the space 203 formed at the bottom portion of the removable unit 20 for receiving the exposure device 23. Then, as shown in FIGS. 27 through 30, the first guiding portion 75 provided in the exposure device 23 of the mounting unit 13 is fit into the first guided portion 71 provided at the lower side of the removable unit 20, and then, the first guiding portion 75 starts to guide the first guided portion 71. Thereafter, the projecting edge portion 246 provided at the upper side of the removable unit 20 starts to contact the third guiding portion 304 provided on the support plate 301 of the mounting unit 13, and the third guiding portion 304 starts to guide (and regulate) the projecting edge portion 246.

Figure 29:
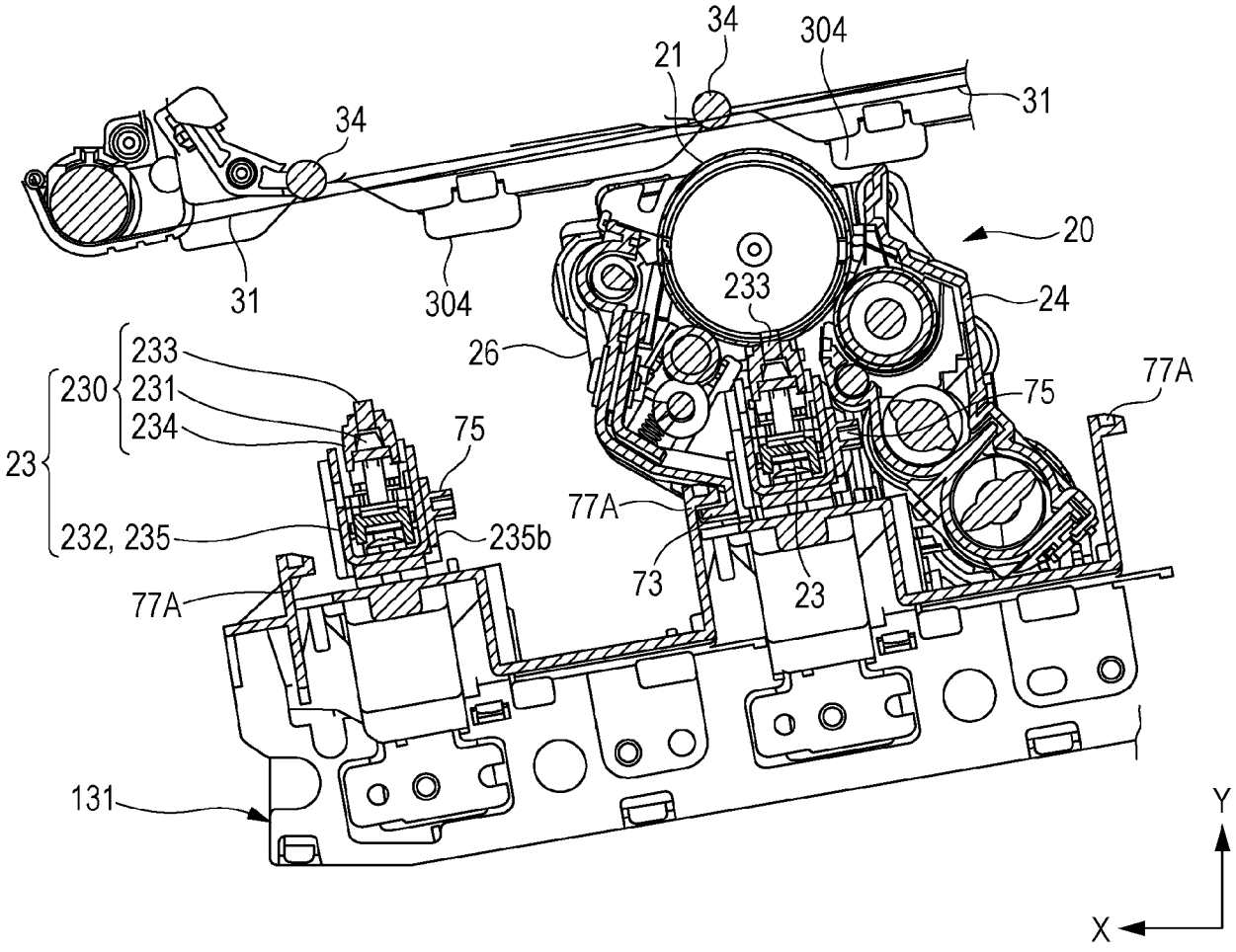
FIG. 29 is a partially sectional view illustrating the state of a removable unit and the mounting unit when mounting or dismounting the removable unit on or from the mounting unit, as viewed from the downstream side of the inserting direction of the removable unit.
Figure 30:
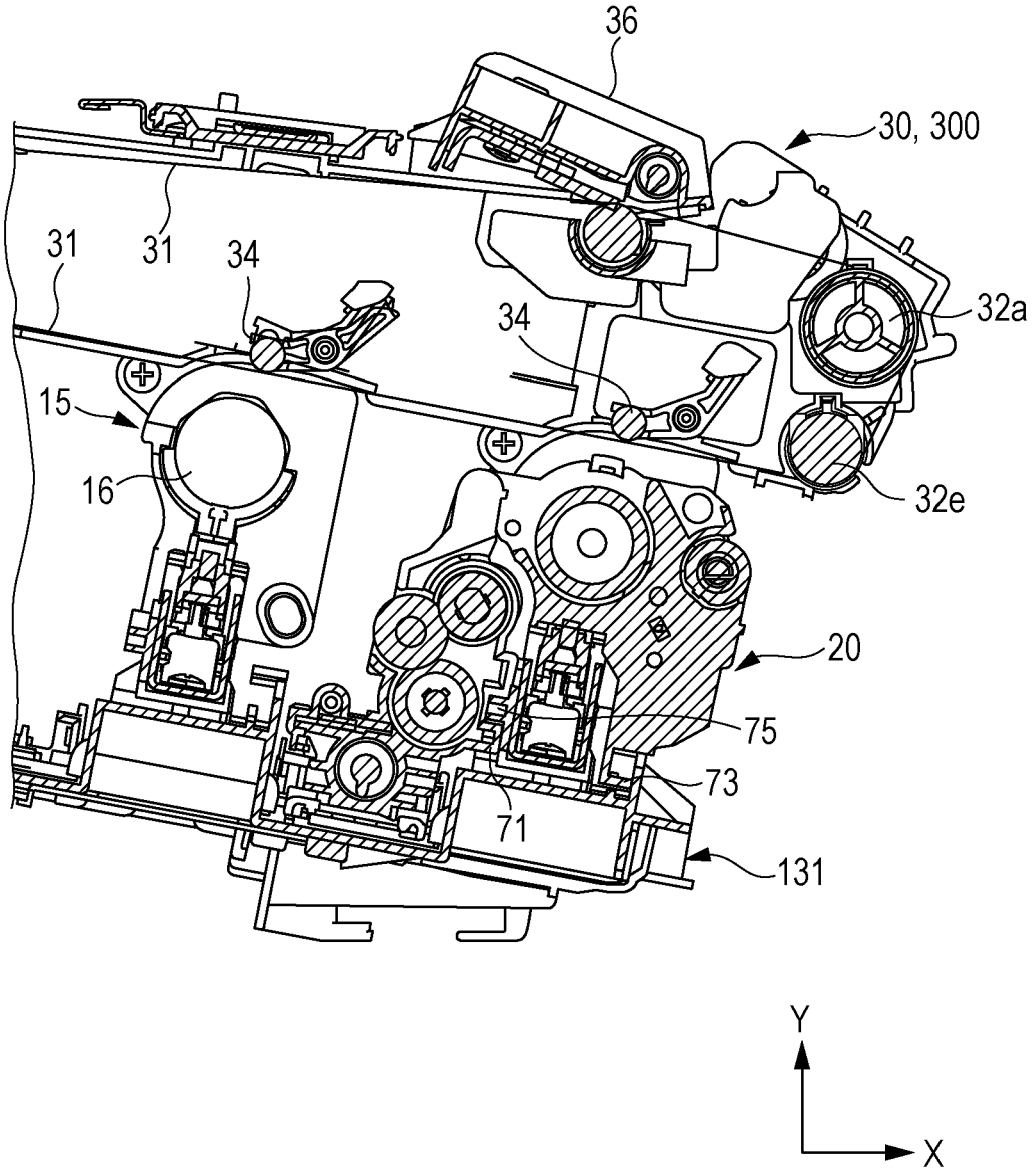
FIG. 30 is a partially sectional view illustrating the state of a removable unit and the mounting unit when mounting or dismounting the removable unit on or from the mounting unit, as viewed from the upstream side of the inserting direction of the removable unit.

The removable unit 20 is further shifted along the inserting direction D1. Then, the second guided portion 73 at the lower side of the removable unit 20 is engaged with the second guiding portion 77A at the near side of the mounting unit 13, and the second guiding portion 77A starts to guide the second guided portion 73 (FIG. 29).

With this operation, during the process of inserting the removable unit 20, the portion of the removable unit 20 in which the developing device 24 is disposed is shifted while being stably held by the guidance of the first guiding portion 75 and by the guidance and the regulation of the third guiding portion 304 of the mounting unit 13, and at the same time, the portion of the removable unit 20 in which the drum cleaner 26 is disposed is shifted while being stably held by the guidance of the second guiding portion 77A of the mounting unit 13.

As a result, the removable unit 20 is stably inserted into the mounting unit 13 so that it can be shifted along the inserting direction D1 while it is being guided and supported at three points formed by the first, second, and third guiding portions 75, 77A, and 304. Accordingly, the photoconductor drum 21 can be avoided from contacting the light-emitting structure 230 since a distance (gap) between the lower portion of the photoconductor drum 21 and the light-emitting structure 230 (optical component 233) of the exposure device 23 is maintained. The photoconductor drum 21 can also be avoided from contacting the intermediate transfer belt 31 since a distance (gap) between the upper portion of the photoconductor drum 21 and the intermediate transfer belt 31 of the intermediate transfer device 30 is maintained. Additionally, the unexpected movement (displacement) of the removable unit 20 in the upward direction is prevented since the removable unit 20 is guided and regulated by the third guiding portion 304 via the projecting edge portion 246 of the developing device 24.

Figure 31:
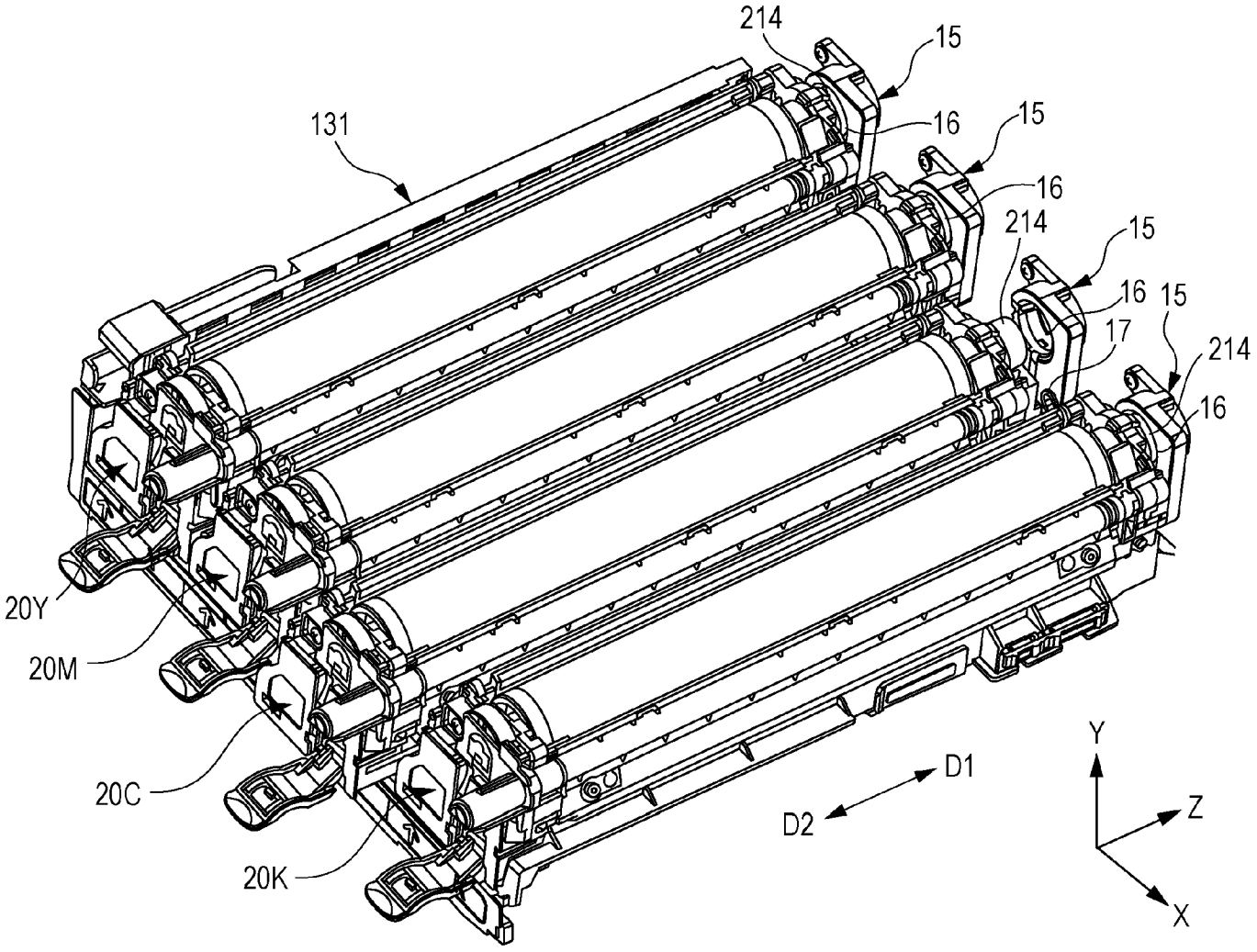
FIG. 31 is a partially sectional view illustrating the state of a removable unit and the mounting unit when mounting or dismounting the removable unit on or from the mounting unit, as viewed from above on the upstream side of the inserting direction of the removable unit.

As shown in FIG. 31, the removable unit 20 is shifted until the shaft 214 of the photoconductor drum 21 and the protruding portion 205 provided at the end of the removable unit 20 on the downstream side in the inserting direction D1 (end close to the side plate 201B) are respectively inserted into the holding hole 16 and the mounting hole 17 of the holding portion 15 provided at the end of the mounting unit 13 on the downstream side in the inserting direction D1.

Figure 32:
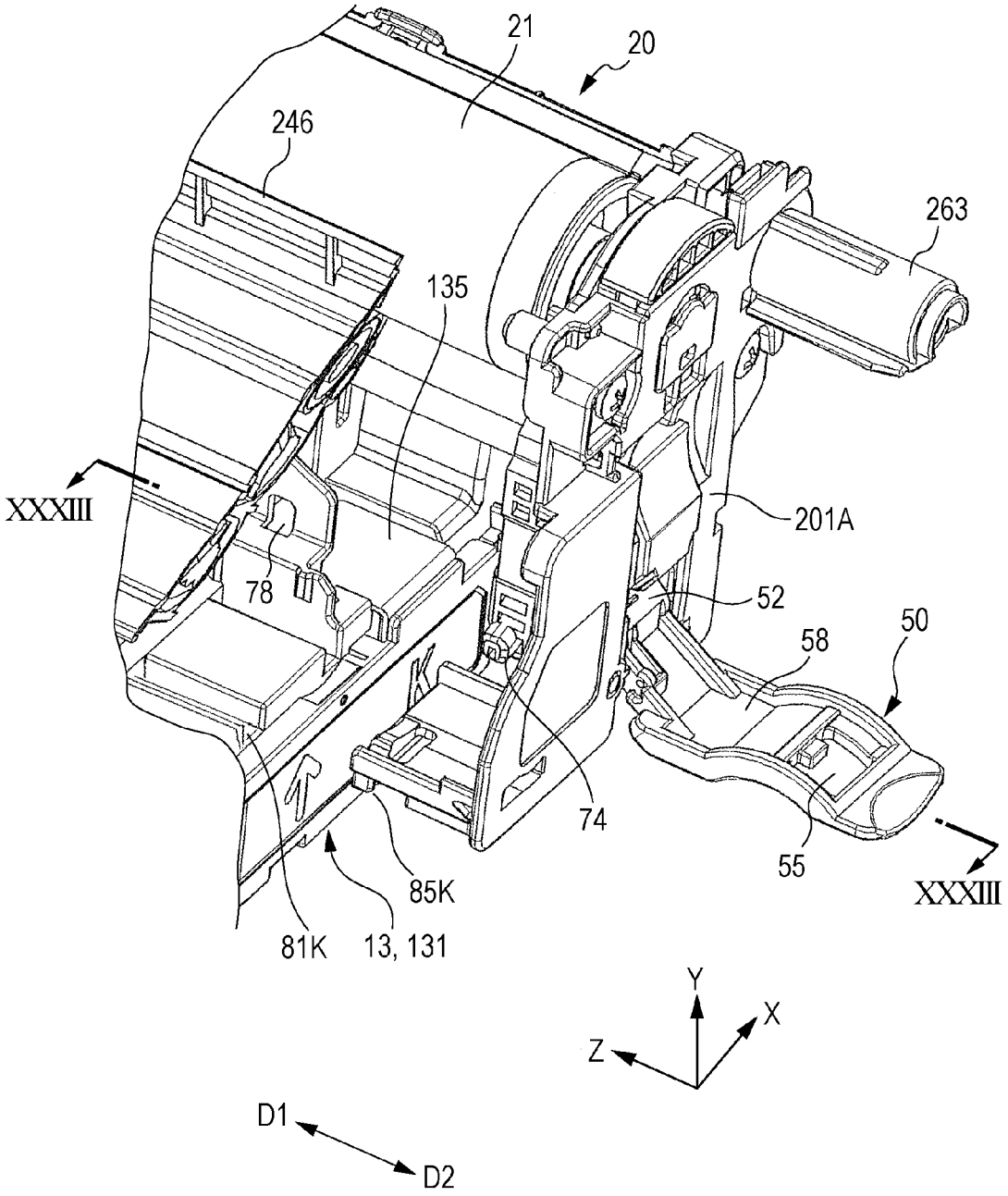
FIG. 32 is a perspective view illustrating a state in which a removable unit is being inserted into or removed from the mounting unit.

In the removable unit 20, as shown in FIG. 32, at a position (at which the removable unit 20 is being inserted) before the removable unit 20 reaches the insertion stoppage position of the mounting unit 13, it is checked whether or not the projection 85, which serves as an incorrect-mounting prevention member, matches the projection mating groove 81, which also serves as an incorrect-mounting prevention member, of the mounting unit 13. FIG. 33 is a schematic sectional view of the removable unit 20 and the mounting unit 13 taken along line XXXIII-XXXIII of FIG. 32.

It is now assumed that a removable unit 20X of a color (one of the removable units 20Y, 20M, and 20K) other than the removable unit 20C is inserted into the mounting portion 132C of the mounting unit 13 by mistake.

Figure 34:
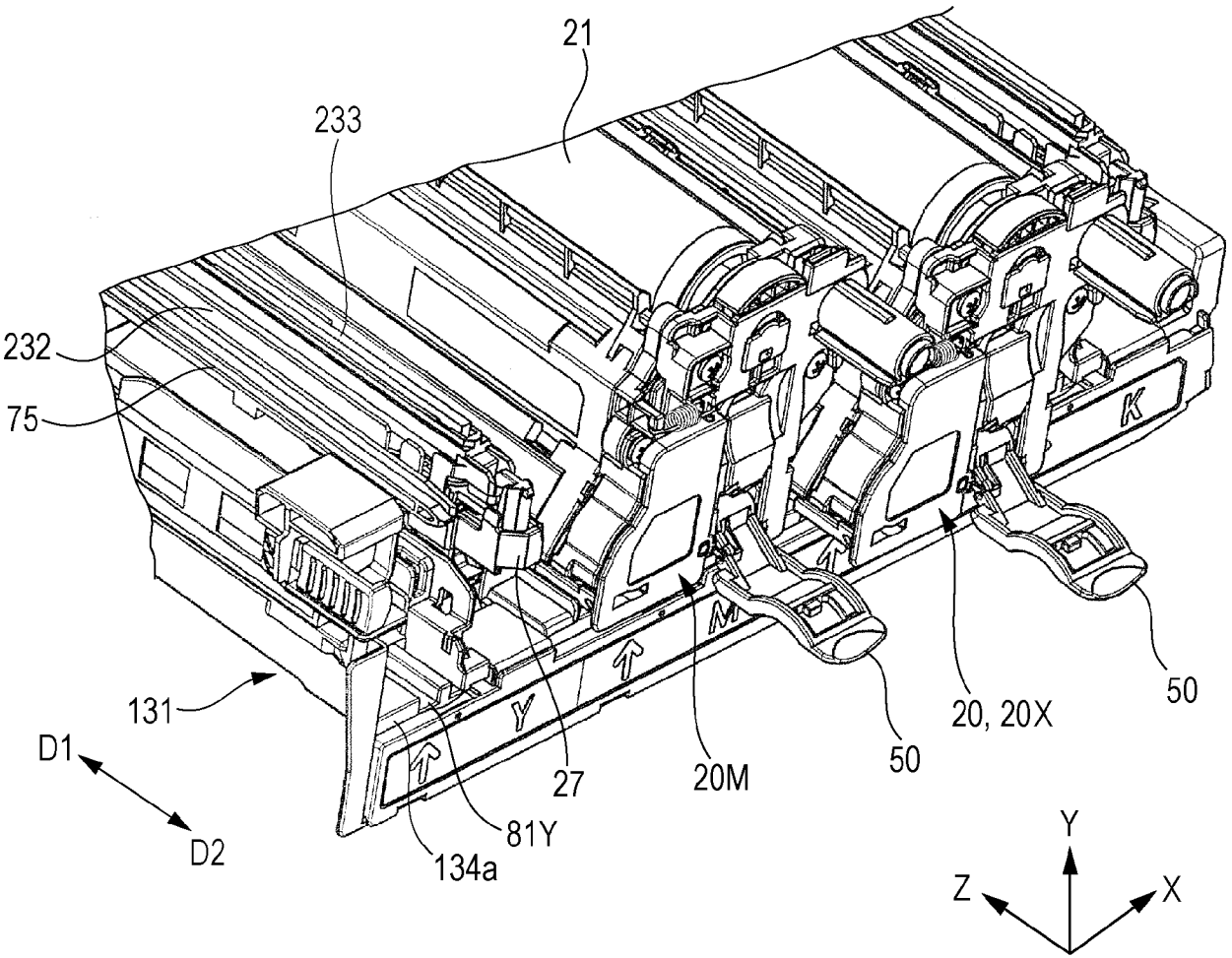
FIG. 34 is a perspective view illustrating the positional relationships of a correctly inserted removable unit and an incorrectly inserted removable unit to the mounting unit.
Figure 35:
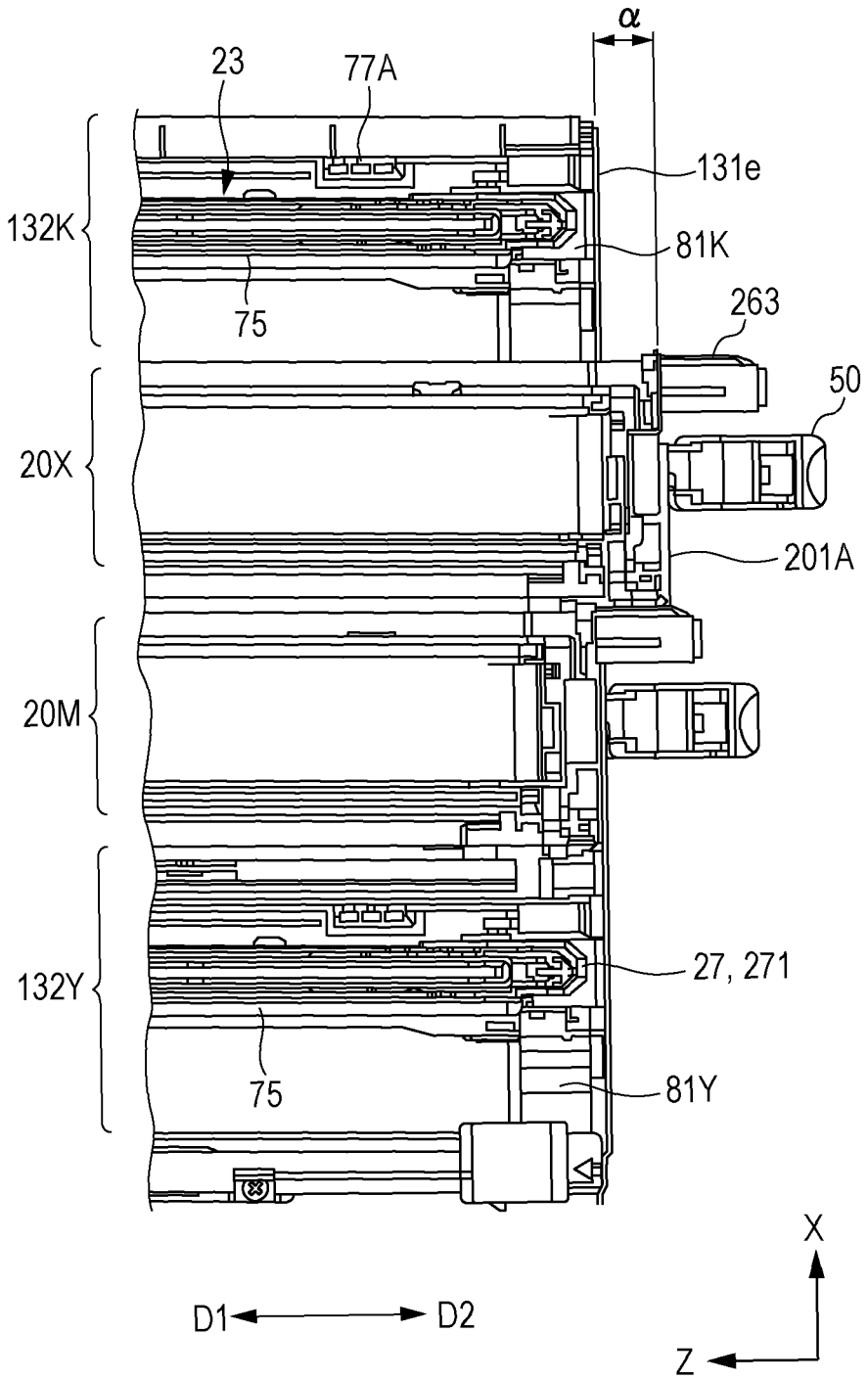
FIG. 35 is a plan view illustrating the positional relationships of the correctly inserted removable unit and the incorrectly inserted removable unit shown in FIG. 34 to the mounting unit.

In this case, as shown in FIGS. 31, 34, and 35, in the incorrectly inserted removable unit 20X, the outer surface of the end (side plate 201A) on the upstream side in the inserting direction D1 is stopped at a position before an end 131*e* of the mounting table 131 on the upstream side in the inserting direction D1 by a predetermined distance a. That is, the projection 85, which serves as an incorrect-mounting prevention member, of the removable unit 20X does not match the projection mating groove 81C, which also serves as an incorrect-mounting prevention member, of the mounting unit 13. Accordingly, the projection 85 is unable to fit into the projection mating groove 81C, and instead, it abuts against a surface 134*a* of the compartment plane 134 (FIG. 23) and is prevented from moving in the inserting direction D1.

The inserting operation is stopped in this manner. Accordingly, while the removable unit 20X is being inserted, the user of the image forming apparatus 1 is able to know that the removable unit 20X is incorrectly mounted on the mounting unit 13.

In this case, as shown in FIG. 31, in the incorrect removable unit 20X, the shaft 214 of the photoconductor drum 21 and the protruding portion 205 at the end (side plate 201B) of the downstream side in the inserting direction D1 are stopped before they reach the holding hole 16 and the mounting hole 17, respectively, provided in the holding portion 15 of the mounting unit 13, and are not inserted thereinto.

The incorrect removable unit 20X is inserted up to a position before and near a position at which the removable unit 20C would be completely inserted into the mounting portion 132C of the mounting unit 13. At this time, as shown in FIGS. 25 and 26, the first and second guided portions 71 and 73 and the projecting edge portion 246 of the removable unit 20X are respectively guided by the first, second, and third guiding portions 75, 77A, and 304 of the mounting unit 13, and the unexpected movement of the removable unit 20X is regulated by the third guiding portion 304. Accordingly, while the incorrect removable unit 20X is being inserted into the mounting unit 13, the lower portion of the photoconductor drum 21 is reliably prevented from contacting the exposure device 23, and the upper portion of the photoconductor drum 21 is reliably prevented from contacting the intermediate transfer belt 31, thereby preventing the impairment of the components of the image forming apparatus 1.

In contrast, when the correct removable unit 20 is inserted into the associated mounting portion 132 of the mounting unit 13, the projection 85, which serves as an incorrect-mounting prevention member, of the removable unit 20 matches the projection mating groove 81, which also serves as an incorrect-mounting prevention member, of the mounting unit 13.

Figure 36:
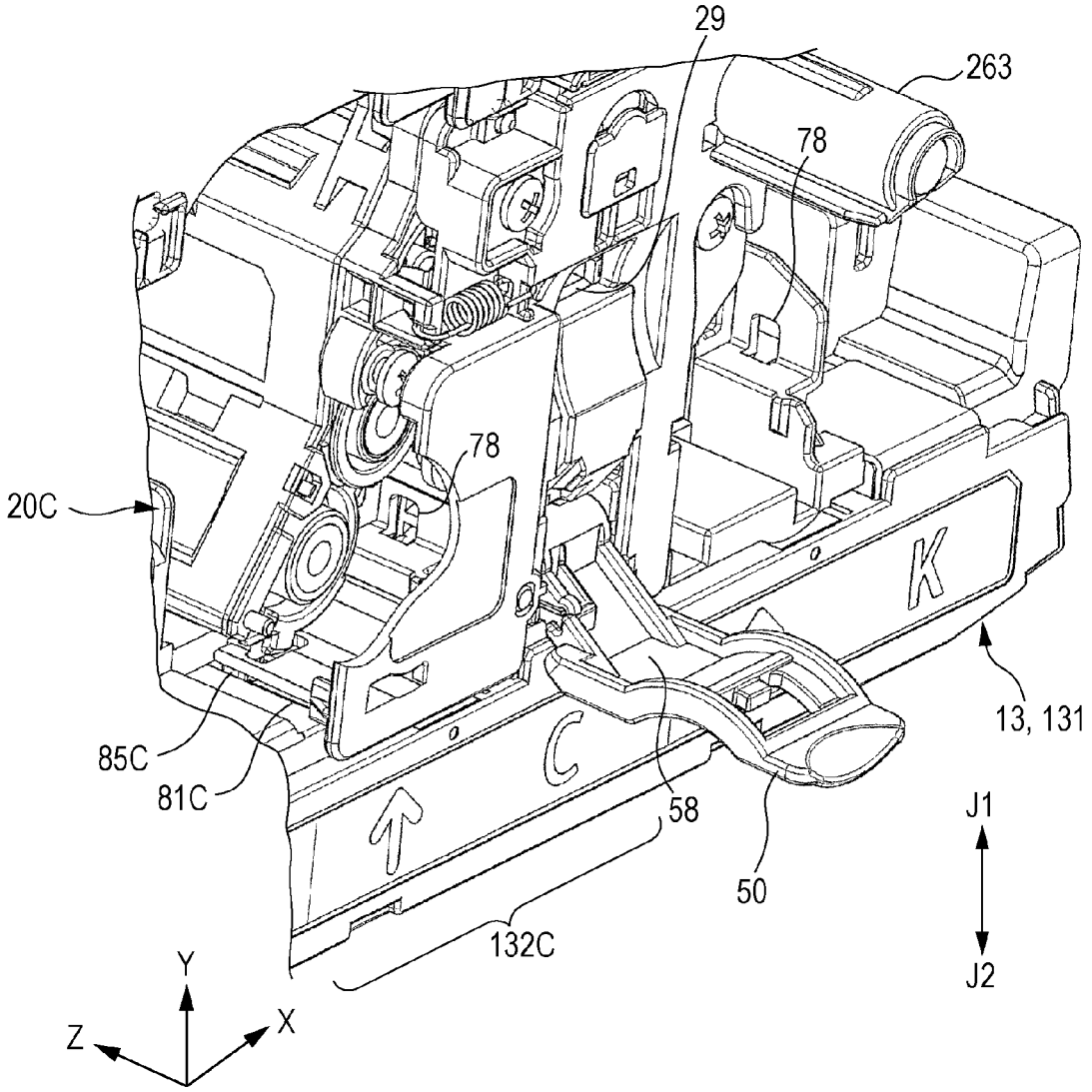
FIG. 36 is a perspective view illustrating a state in which a removable unit is correctly inserted in the mounting unit.
Figure 37:
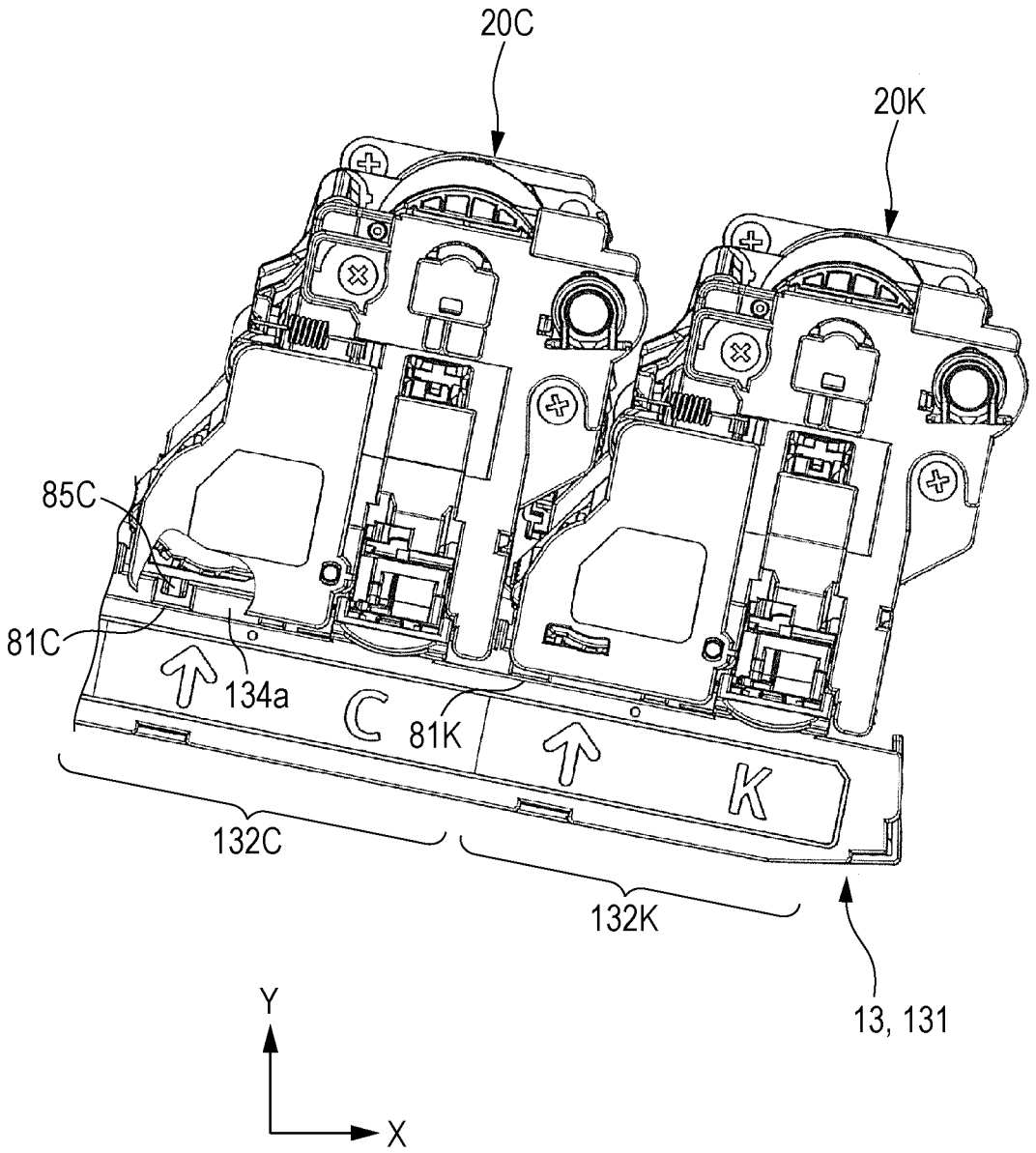
FIG. 37 is a partial cutaway side view illustrating a state in which a removable unit is correctly inserted in the mounting unit.

In this case, as shown in FIGS. 36 and 37, since the projection 85 is fit into the projection mating groove 81, the correct removable unit 20 is further moved to the inward of the mounting portion 132. The removable unit 20 is further inserted into the associated mounting portion 132 after checking whether or not the removable unit 20 is correctly mounted. Thus, the shaft 214 of the photoconductor drum 21 and the protruding portion 205 at the end (side plate 201B) of the downstream side in the inserting direction D1 are respectively inserted into the holding hole 16 and the mounting hole 17 of the holding portion 15 (FIGS. 16 and 31).

By performing the above-described inserting operation, the individual removable units 20 are inserted into the associated mounting portions 132 of the mounting unit 13.

As discussed above, when each of the removable units 20 has been inserted into the mounting unit 13, it is stored in the mounting unit 13 in a state in which the end of the removable unit 20 on the upstream side in the inserting direction D1 is displaced to separate from the intermediate transfer device 30 (FIG. 16). The end of the photoconductor drum 21 on the upstream side in the inserting direction D1 is displaced downward such that it separates from the outer peripheral surface 31*a* of the intermediate transfer belt 31 (more specifically, the belt portions supported by the transfer rollers of the first transfer portions 34) of the intermediate transfer device 30 which is positioned and fixed on the mounting unit 13 in advance. The removable unit 20 is, as a whole, maintained such that it tilts downward toward one side. With this configuration, while the removable unit 20 is being inserted into the mounting unit 13, the photoconductor drum 21 of the removable unit 20 is prevented from contacting the intermediate transfer belt 31.

When the removable units 20 have been inserted into the mounting unit 13, as shown in FIG. 17, none of the contact surfaces 206 provided on the side plates 201A are in contact with the contact surface receiving portions 302 provided on the support plate 301 of the intermediate transfer device 30, as viewed from the near side of the mounting unit 13 in the inserting direction D1.

Figure 41:
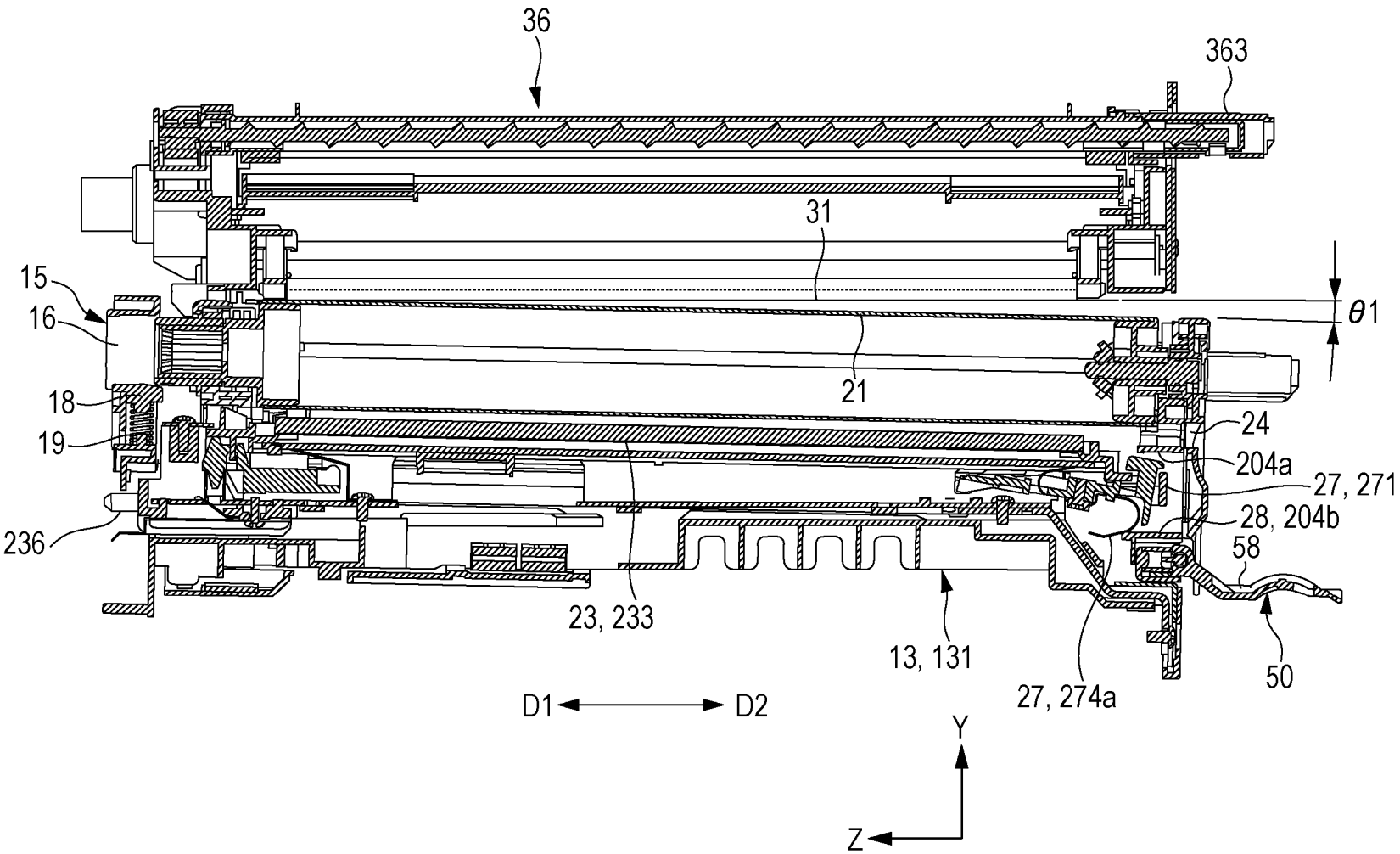
FIGS. 41 and 42 are sectional views illustrating the movement of a removable unit which is mounting on or dismounting from the mounting unit and the positional relationship between the removable unit and an exposure device.

In this case, in the removable unit 20, when the shaft 214 of the photoconductor drum 21 is inserted into the holding hole 16 provided in the holding portion 15 of the mounting unit 13, the shaft 214 is maintained at a state in which it is elastically pressed by the pressing member 18, which is pressed by the coil spring 19, in a direction in which the shaft 214 approaches the intermediate transfer belt 31 (FIGS. 16 and 41).

In this case, since it has already been checked whether or not the removable unit 20 is correctly mounted (after the projection 85 has fit into the projection mating groove 81), the engagement state of the first guided portion 71 with the first guiding portion 75 of the mounting unit 13 is canceled (FIG. 25), and the contact state of the projecting edge portion 246, which is a regulating member, with the third guiding portion 304 of the mounting unit 13 is also canceled (FIG. 26). Accordingly, the developing device 24 of the removable unit 20 is released from the state in which it is guided by the first and third guiding portions 75 and 304 and is regulated by the third guiding portion 304.

In this case, at the end of the removable unit 20 on the downstream side in the inserting direction D1, the second guided portion 73 is engaged only with the second guiding portion 77B provided at the far end of the mounting unit 13. On the other hand, at the end of the removable unit 20 on the upstream side in the inserting direction D1, the second guided portion 73 is not engaged with the second guiding portion 77A provided at the near end of the mounting unit 13 (FIG. 25). Accordingly, the end of the drum cleaner 26 on the downstream side in the inserting direction D1 is supported by the second guiding portion 77B, while the end of the drum cleaner 26 on the upstream side in the inserting direction D1 is released from the state in which it is guided and supported by the second guiding portion 77A.

As a result, when the removable unit 20 has been inserted into the mounting unit 13, the end of the removable unit 20 on the downstream side in the inserting direction D1 is held and supported by the holding portion 15 and the second guiding portion 77B of the mounting unit 13, while the end thereof on the upstream side in the inserting direction D1 is released from the state in which it is guided (regulated) by the first, second, and third guiding portions 75, 77A, and 304. In this state, the removable unit 20 is ready to perform the subsequent positioning operation.

Positioning Process in Mounting of Removable Unit

Subsequently, as shown in FIGS. 18, 19, and 38 through 40, the positioning of each of the removable units 20 within the associated mounting portions 132 is performed. More specifically, the operation lever 50 which is in a lying position is changed to a standing position.

When the operation lever 50 is pivoted upward in the direction J1 about the pivot shaft 210, which serves as a pivot point, on the side plate 201A of the removable unit 20, the corners and the bottom surface of the displaceable bottom portion 53 of the operation lever 50 is pivoted while being in contact with the fixed plane 135 of the mounting table 131 of the mounting unit 13. With this operation, the operation lever 50 functions as a "lever" in which the body 51 above the bearing 52 serves as the point of effort, the bearing 52 serves as the fulcrum, and the displaceable bottom portion 53 serves as the point of load.

Accordingly, when the operation lever 50 is pivoted upward in the direction J1, the displaceable bottom portion 53 contacts the fixed plane 135 and is pressed against it so as to raise the bearing 52 due to the principle of leverage. As a result, the side plate 201A of the removable unit 20 is raised by the bearing 52 via the pivot shaft 210. In this case, the displaceable bottom portion 53 is displaced in the direction in which it approaches the bearing 52 while being resistant to the force of the coil spring 67, and the bottom surface of the displaceable bottom portion 53 is in surface-contact with the fixed plane 135. Finally, the operation lever 50 is in a completely standing position while being in surface-contact with the fixed plane 135.

By performing the pivoting operation to raise the operation lever 50 in the direction J1, as shown in FIGS. 18 and 39, the end (side plate 201A) of the removable unit 20 on the upstream side in the inserting direction D1 is displaced in the direction E1 in which it approaches the intermediate transfer belt 31 of the intermediate transfer device 30.

Figure 38:
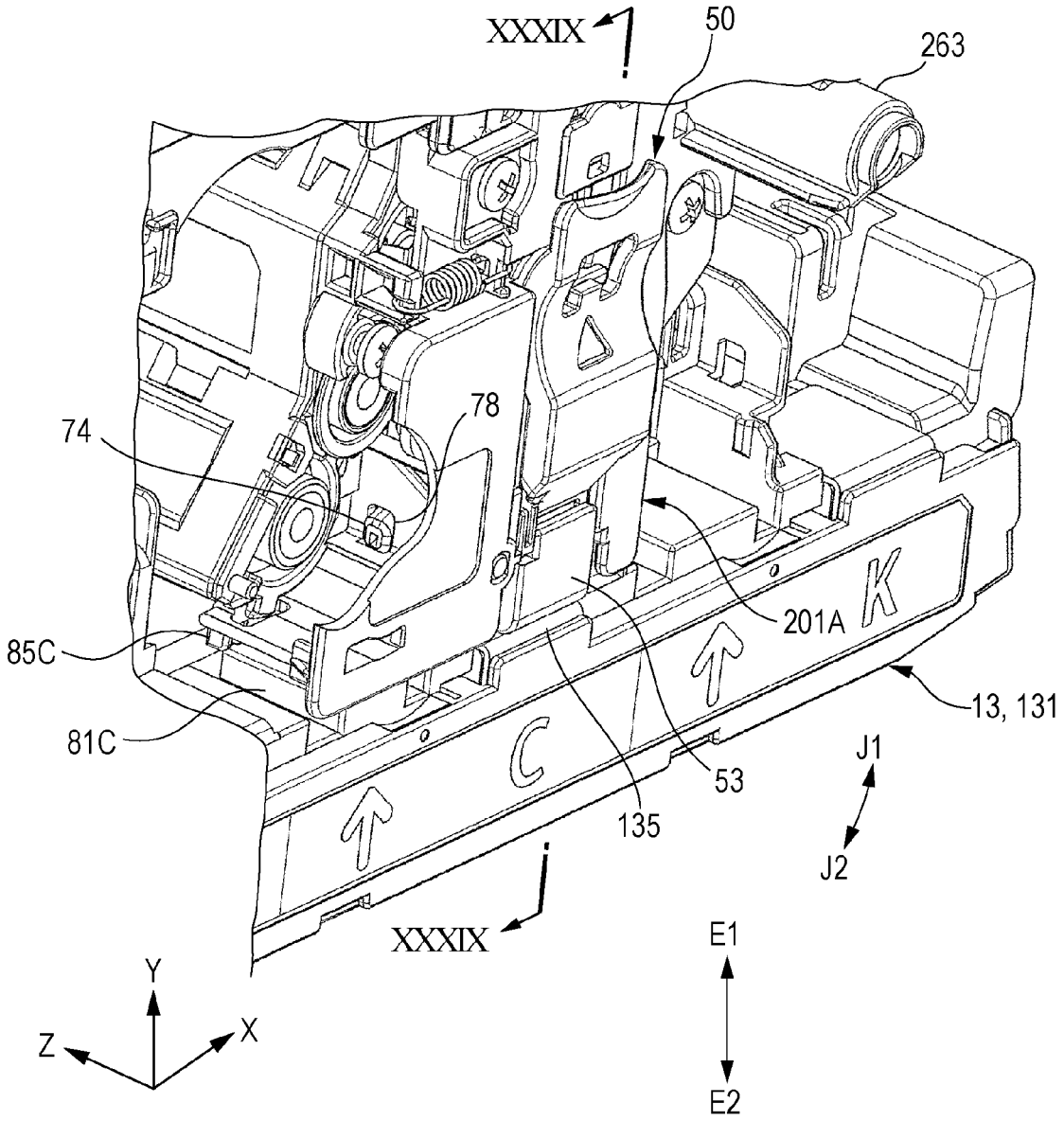
FIG. 38 is a perspective view illustrating a state in which a removable unit has been positioned (mounted) on the mounting unit.

In this case, in the removable unit 20, as shown in FIG. 38, the protruding portion 74 at the lower side of the side plate 201A is fit into the protrusion mating portion 78 of the mounting unit 13. Then, the removable unit 20 is guided so that it can be displaced in the direction E1 in which it approaches the intermediate transfer device 30, and also, the protruding portion 74 is held at a position somewhere in the middle of the protrusion mating portion 78. As a result, the positioning of the removable unit 20 with respect to the inserting direction D1 (and the removing direction D2) is performed. Additionally, in the removable unit 20, as shown in FIG. 19, the contact surface 206 at the top portion of the side plate 201A is brought into contact with the contact surface receiving portion 302 formed on the support plate 301 of mounting unit 13. As a result, the positioning of the removable unit 20 is performed.

As a result of the above-described operation, the positioning of each of the removable units 20 in the associated mounting portions 132 of the mounting unit 13 is performed, and the mounting of the removable unit 20 on the mounting unit 13 has been completed. As a result of the positioning of each removable unit 20, it is located at a position at which it is able to perform an image forming operation in the mounting unit 13. At this stage, the operation lever 50 is maintained in a standing state as a result of the bottom surface of the displaceable bottom portion 53 being in surface-contact with the fixed plane 135 of the mounting unit 13.

After the positioning of the removable units 20 has been completed, as shown in FIG. 19, all the contact surfaces 206 on the side plates 201A are in contact with the contact surface receiving portions 302 formed on the support plate 301 of the intermediate transfer device 30, as viewed from the upstream side (near end) of the mounting unit 13 in the inserting direction D1.

After the positioning (mounting of the removable units 20) has been completed, as shown in FIGS. 18 and 39, all the removable units 20 including the end portions of the photoconductor drums 21 on the upstream side in the inserting direction D1 are in contact with the intermediate transfer belt 31 of the intermediate transfer device 30 (more specifically, the belt portions supported by the transfer rollers of the first transfer portions 34), as discussed above.

In this case, in the removable unit 20, the contact surface 206 is brought into contact with and is fit into the contact surface receiving portion 302 formed on the support plate 301 of the intermediate transfer device 30, so that the photoconductor drum 21 contacts, at an accurate position, the intermediate transfer belt 31. As a result, during image formation, toner images formed on the photoconductor drums 21 of the removable units 20 can be reliably transferred to the intermediate transfer belt 31 at correct first transfer positions.

Figure 40:
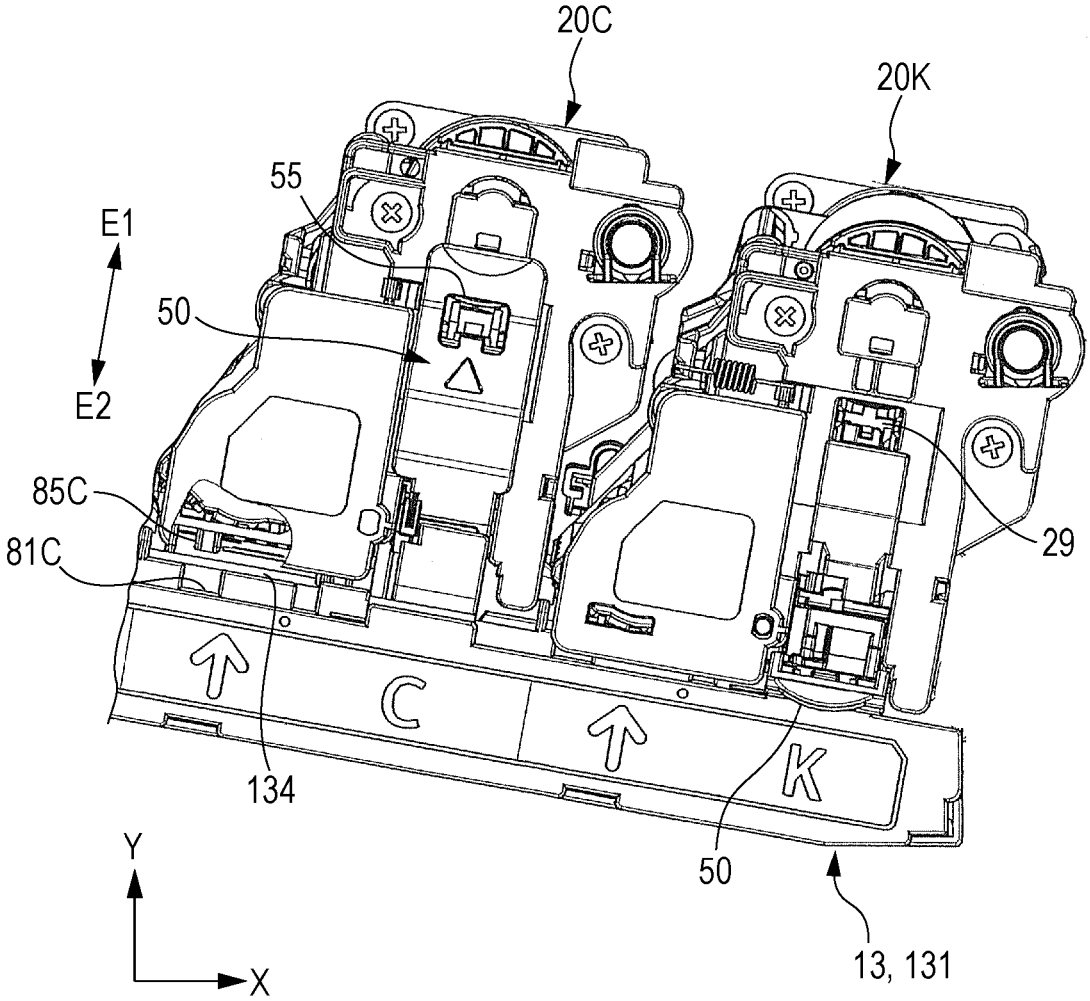
FIG. 40 is a partial cutaway side view illustrating a state in which a removable unit has been positioned on the mounting unit.

When the removable unit 20 is displaced in the direction E1 in which the side plate 201A approaches the intermediate transfer device 30 as a result of the operation of the operation lever 50, as shown in FIGS. 38 and 40, the projection 85, which serves as an incorrect-mounting prevention member, of the removable unit 20 is displaced upward and is removed from the projection mating groove 81, which also serves as an incorrect-mounting prevention member, of the mounting unit 13. That is, the projection 85 is released from the engagement state with the projection mating groove 81. In FIG. 40, the operation lever 50 of the removable unit 20K is in the lying position, and the above-described positioning operation has not been performed for the removable unit 20K.

When the mounting of the removable unit 20 has been completed, the developing device 24 having a pivoting support structure is released from a state in which it is regulated by the projection 85 and the projection mating groove 81, which serve as the incorrect-mounting prevention members, and the pivoting support structure functions regularly. That is, the developing device 24 is maintained in a state in which it is pivotable in the directions H1 and H2. The developing device 24 is also released from a state in which it is guided by the first and third guiding portions 75 and 304 of the mounting unit 13 and is regulated by the third guiding portion 304.

In the removable unit 20 mounted on the mounting unit 13, as shown in FIGS. 18 and 43, at the end portion of the removable unit 20 on the upstream side in the inserting direction D1, the operation lever 50 is subjected to a reaction force (F1) from the fixed plane 135 of the mounting unit 13 due to the force F1 of the coil spring 67 in the displaceable bottom portion 53. Accordingly, the end portion (side plate 201A) of the removable unit 20 is elastically pressed so that it can be displaced in the direction E1 in which it approaches the intermediate transfer device 30.

As a result, the contact state of the photoconductor drum 21 of the removable unit 20 with the intermediate transfer belt 31 can be stably maintained.

State of Exposure Device in Mounting of Removable Unit

In the image forming apparatus 1, when mounting the removable unit 20 on the mounting unit 13, in accordance with the movement of the removable unit 20, the exposure device 23 attached to the mounting unit 13 is also approaching the photoconductor drum 21 of the removable unit 20, in other words, the positioning of the exposure device 23 is performed.

Figure 27:
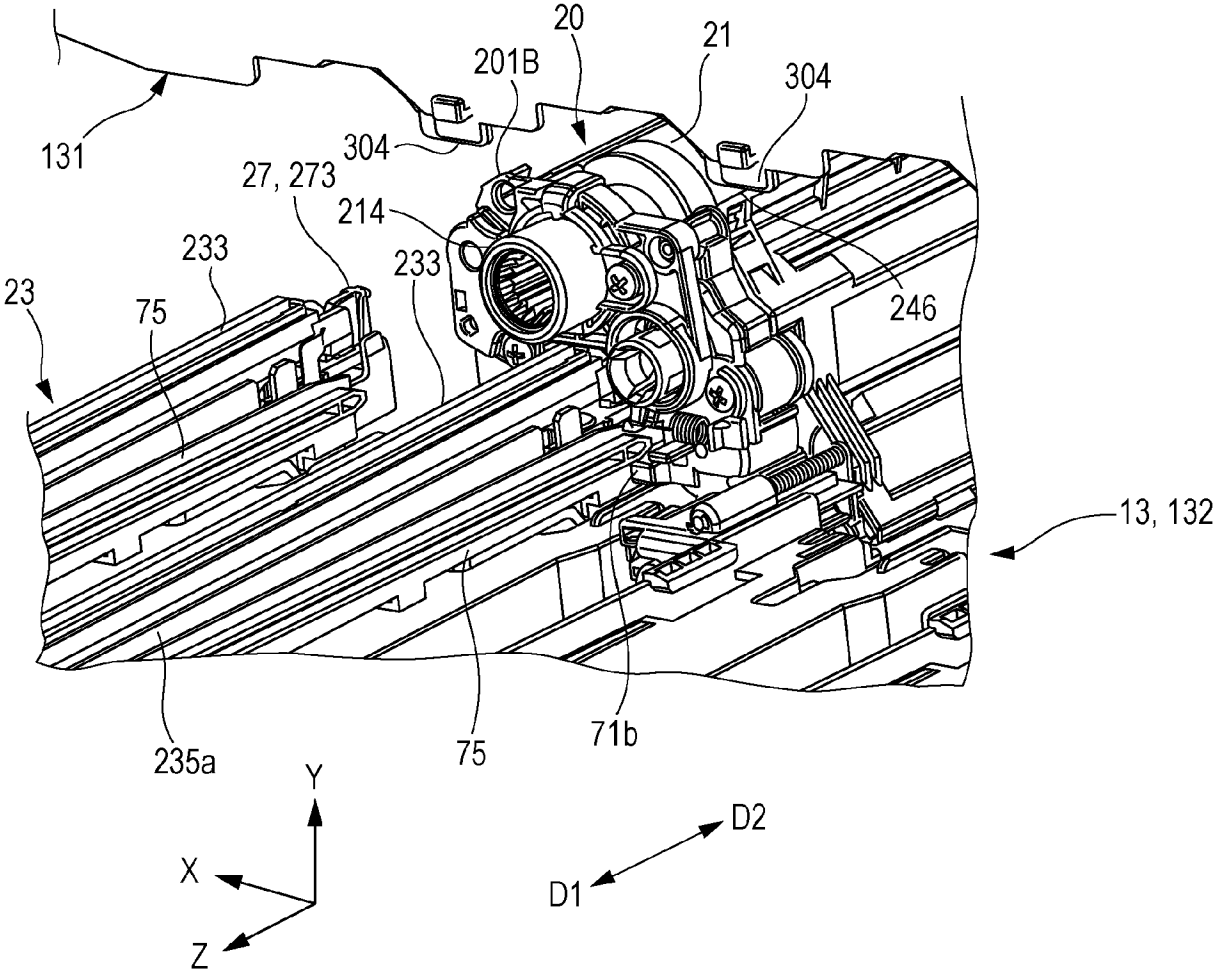
FIGS. 27 and 28 are perspective views illustrating the state and the positional relationship between an end portion of a removable unit, as viewed from the far end of the inserting direction, and an end portion of the mounting unit, as viewed from the near end of the inserting direction, when mounting or dismounting the removable unit on or from the mounting unit, as viewed from different angles.
Figure 28:
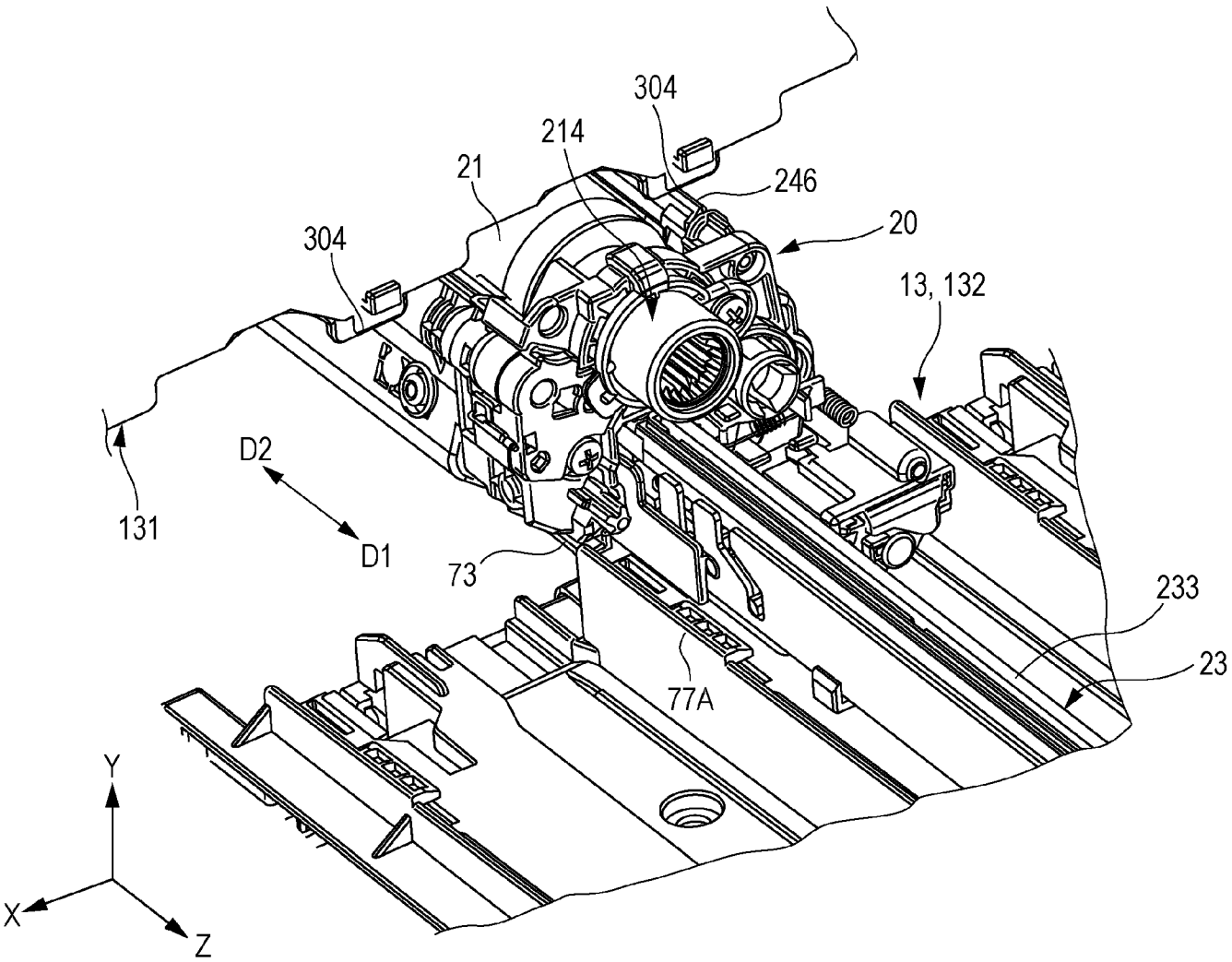

This will be discussed more specifically. As shown in FIG. 27, the removable unit 20 is inserted into the mounting unit 13 having the exposure device 23 thereon, as discussed above. Then, as shown in FIG. 41, the driving and storing portion 204 provided in the side plate 201A at the end of the removable unit 20 on the upstream side in the inserting direction D1 approaches the end of the exposure device 23 on the upstream side in the inserting direction D1. At the same time, the bottom portion (more specifically, the tilting introduction surface 274*a*) of the leaf spring 274 of the driven portion 27 at the end of the exposure device 23 on the upstream side contacts the edge of the lower inner wall surface (bottom surface) 204*b*, which serves as the driving portion 28, of the driving and storing portion 204. At this time, it has already been checked whether or not the removable unit 20 is correctly mounted, by using the projection 85 and the projection mating groove 81, which serve as incorrect-mounting prevention members, and the shaft 214 of the photoconductor drum 21 has started to be inserted into the holding hole 16 of the holding portion 15.

Then, the removable unit 20 is further shifted in the inserting direction D1 and is completely inserted in the mounting unit 13. Then, as shown in FIG. 42, the tilting introduction surface 274*a*, which serves as the driven portion 27, of the leaf spring 274 provided in the exposure device 23 runs on the edge of the bottom surface 204*b* of the driving and storing portion 204 and advances on the bottom surface 204*b*. As a result, part of the frame-like portion 271, the pivoting member 272, and the leaf spring 274, and the entirety of the positioning contact member 273 which form the driven portion 27 are moved and stored in the internal space of the driving and storing portion 204 of the removable unit 20.

In this case, the tilting introduction surface 274*a* of the leap spring 274 provided in the exposure device 23 runs on the edge of the bottom surface 204*b* of the driving and storing portion 204 and advances on the bottom surface 204*b*. Accordingly, the end of the light-emitting structure 230 of the exposure device 23 on the upstream side in the inserting direction D1 is subjected to a force in the upward direction via the leaf spring 274 and the pivoting member 272, and thus, the exposure device 23 is pivoted about the pivot point member 239 of the support structure 232 in the direction M1 in which the exposure device 23 approaches the photoconductor drum 21. When the tilting introduction surface 274*a* of the leaf spring 274 is completely in contact with the bottom surface 204*b* of the driving and storing portion 204, the optical component 233 of the light-emitting structure 230 of the exposure device 23 is in a state in which it separates from the photoconductor drum 21 by about a predetermined spacing S.

Then, the operation lever 50 is pivoted in the direction J1 so as to perform the positioning of the removable unit 20 in the mounting unit 13. Then, as shown in FIG. 43, due to the leverage of the operation lever 50, the side plate 201A of the removable unit 20 is displaced in the direction E1 in which it approaches the intermediate transfer device 30, and the driving and storing portion 204 is also displaced in a similar manner. As a result, the leaf spring 274 within the internal space of the driving and storing portion 204 is raised by the bottom surface 204*b*, and thus, the installation surface 274*b* of the leaf spring 274 is brought into contact with the bottom surface 204*b*, and the top surface of the positioning contact member 273 is brought into contact with the contact receiving surface 204*a* of the driving and storing portion 204.

In this manner, in accordance with the movement of the removable unit 20 when it is being inserted into the mounting unit 13, the light-emitting structure 230 of the exposure device 23 attached to the mounting unit 13 is also shifted to a state (FIGS. 43 and 44) in which the light-emitting structure 230 has approached the photoconductor drum 21 of the removable unit 20.

At this time, as shown in FIG. 43, the end of the light-emitting structure 230 of the exposure device 23 on the upstream side in the inserting direction D1 (within the driving and storing portion 204 in the side plate 201A) is subjected to a force F2 of the leaf spring 274 of the driven portion 27 via the positioning contact member 273. Then, the end of the light-emitting structure 230 is pressed in the direction M1 in which it approaches the photoconductor drum 21, and the predetermined spacing S (corresponding to the focal length) between the optical component 233 of the light-emitting structure 230 and the photoconductor drum 21 is stably maintained.

As shown in FIG. 43, the top surface of the positioning contact member 273 of the driven portion 27 of the exposure device 23 is brought into surface-contact with the contact receiving surface 204*a* located on the top portion of the driving and storing portion 204 of the removable unit 20. This makes it possible to synchronize the vibration between the photoconductor drum 21 and the light-emitting structure 230, and the focal length between the light-emitting structure 230 and the photoconductor drum 21 is unlikely to be changed.

Dismounting of the removable unit 20 from the mounting unit 13 is performed in the order reverse to the above-described mounting operation.

Positioning Canceling Process in Dismounting of Removable Unit

First, as shown in FIGS. 16 and 42, the operation lever 50 of each of the removable units 20 is pivoted in the direction J2 so that it is changed from the standing position to the lying position. Because of this pivoting operation for the operation lever 50 in the direction J2, the contact state of the displaceable bottom portion 53 with the fixed plane 135 of the mounting unit 13 is canceled, and the operation lever 50 is in the lying position.

Then, in the removable unit 20, while the shaft 214 of the photoconductor drum 21 is being stored in the holding hole 16 of the holding portion 15, the end (side plate 201A) of the removable unit 20 on the downstream side in the removing direction D2 (upstream side in the inserting direction D1) is no longer subjected to a force in the upward direction due to the pivoting operation of the operation lever 50 in the direction J2. Accordingly, the end (side plate 201A) of the removable unit 20 is shifted in the direction E2 by gravity in which it separates from the intermediate transfer device 30.

As a result, the end of the photoconductor drum 21 of the removable unit 20 on the downstream side in the removing direction D2 is separated from the intermediate transfer belt 31 of the intermediate transfer device 30. The photoconductor drum 21 is, as a whole, in a tilting state in which it separates from the intermediate transfer belt 31. Accordingly, the removable unit 20 is ready to be removed.

In this case, the positioning contact member 273, which forms the driven portion 27, of the light-emitting structure 230 of the exposure device 23 remains being stored and held within the driving and storing portion 204 of the removable unit 20, and the predetermined spacing S between the light-emitting structure 230 and the photoconductor drum 21 is also maintained.

Removing Process in Dismounting of Removable Unit

Then, the removable unit 20 is removed from the mounting unit 13 along the removing direction D2. In this case, as shown in FIG. 31, the shaft 214 of the photoconductor drum 21 of the removable unit 20 is removed from the holding hole 16 of the holding portion 15 of the mounting unit 13, and the protruding portion 205 provided on the side plate 201B is removed from the mounting hole 17 of the holding portion 15.

Slightly before the shaft 214 of the photoconductor drum 21 is removed from the holding hole 16, the first guided portion 71 of the removable unit 20 starts to be engaged with the first guiding portion 75 of the mounting unit 13, and the projecting edge portion 246 of the developing device 24 of the removable unit 20 also starts to contact the third guiding portion 304, which serves as a regulating member, of the mounting unit 13 (FIGS. 25 and 26). The removable unit 20 then starts to be guided by the first and third guiding portions 75 and 304 and be regulated by the third guiding portion 304.

The second guided portion 73 of the removable unit 20 is released from the engagement state with the second guiding portion 77B of the mounting unit 13, while it starts to be engaged with the second guiding portion 77A (FIG. 25) and to be guided by the second guiding portion 77A.

State of Exposure Device in Dismounting of Removable Unit

When dismounting the removable unit 20 from the mounting unit 13, in the light-emitting structure 230 of the exposure device 23, the positioning contact member 273, which forms the driven portion 27, of the exposure device 23 is removed from the driving and storing portion 204 of the removable unit 20. In this state, the end of the light-emitting structure 230 on the upstream side in the removing direction D2 is lowered downward by gravity, and the light-emitting structure 230 pivots about the pivot point member 239 in the support structure 232 in the direction M2 in which it separates from the photoconductor drum 21. As a result, the distance between the light-emitting structure 230 and the photoconductor drum 21 is increased.

Accordingly, when removing the removable unit 20, the photoconductor drum 21 can be reliably prevented from contacting the intermediate transfer belt 31 and the light-emitting structure 230 of the exposure device 23. Thus, the dismounting operation for the removable unit 20 can be smoothly performed, and also, the photoconductor drum 21, the intermediate transfer belt 31, and the exposure device 23 are not impaired.

The light-emitting structure 230 of the exposure device 23 attached to the mounting unit 13 is separated from the photoconductor drum 21 of the removable unit 20, in accordance with the movement of the removable unit 20 when it is being removed from the mounting unit 13.

(Structure Concerning Cleaning in Removable Unit)

Figure 45:
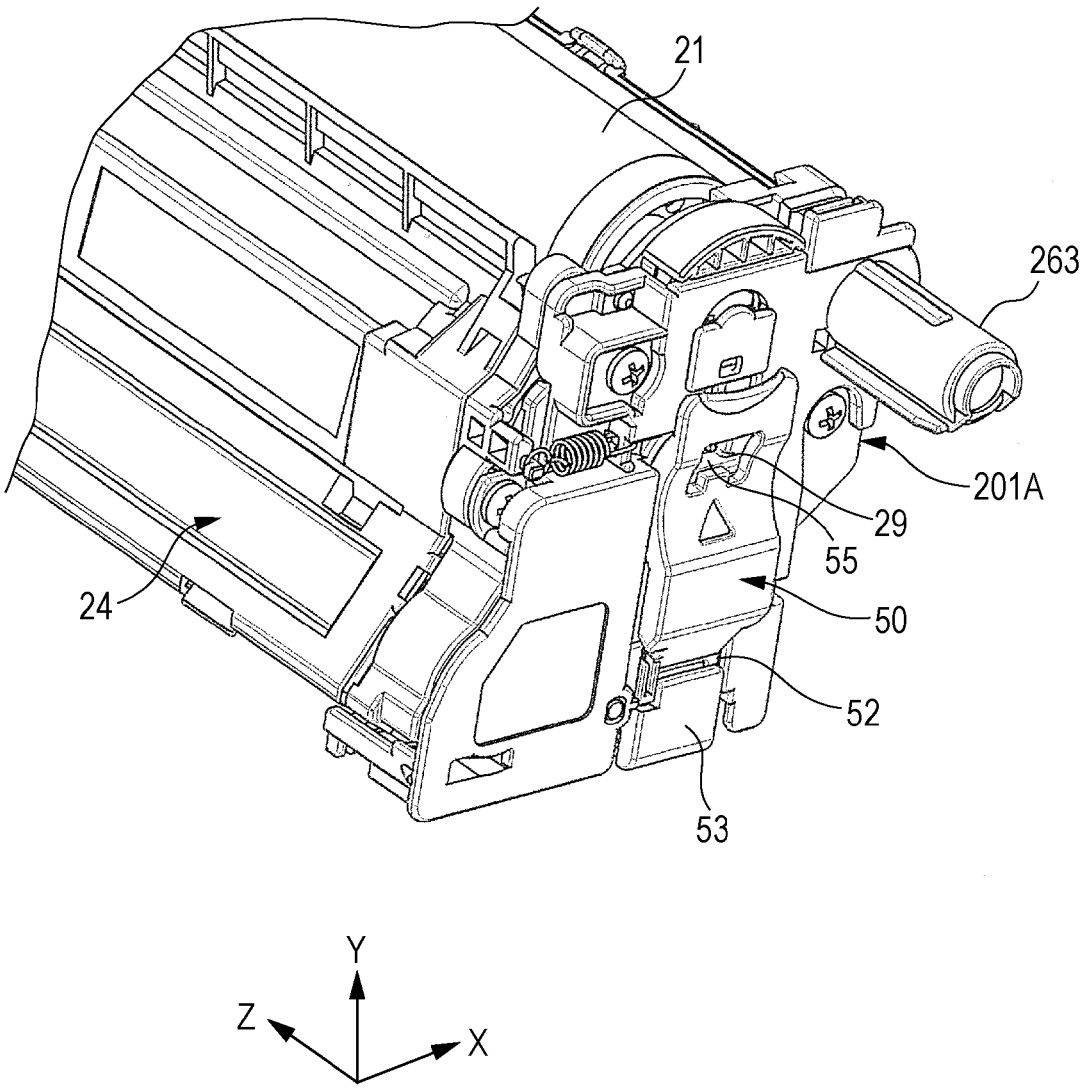
FIG. 45 is a perspective view illustrating the configuration of an operation lever of the removable unit shown in FIG. 4.

In the removable unit 20, as shown in FIG. 45, an opening 55 for a cleaning device is provided in part of the operation lever 50.

In order to clean the exposure device 23 from the removable unit 20 mounted on the mounting unit 13, an insertion slot 29 is provided in the removable unit 20 for receiving a long, narrow cleaning device 90 (FIG. 48) which removes unwanted substances, such as toner, adhering to the optical component 233 of the light-emitting structure 230 of the exposure device 23. By inserting and moving the cleaning device 90 through this insertion slot 29, cleaning is performed.

Figure 46A:
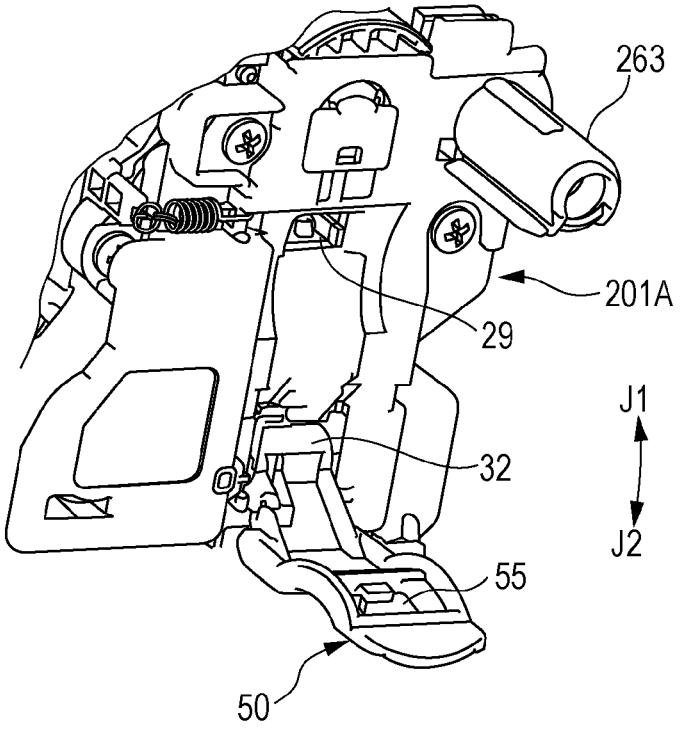
FIGS. 46A and 46B are perspective views illustrating a state in which the operation lever shown in FIG. 45 is in a lying position and a state in which the operation lever is in a standing position, respectively.

For performing cleaning while the removable unit 20 remains being mounted on the mounting unit 13, the insertion slot 29 is provided on the side plate 201A at the end of the removable unit 20 on the upstream side in the inserting direction D1, as shown in FIG. 46A. The insertion slot 29 is provided at a position in the side plate 201A corresponding to a portion at which the optical component 233 of the exposure device 23 and the photoconductor drum 21 of the removable unit 20 oppose each other.

In the removable unit 20, when performing positioning of the removable unit 20 inserted into the mounting unit 13, the operation lever 50 is pivoted about the bearing 52 in the direction J1 so that it is shifted from a lying position (second operation position) to a standing position (first operation position). In the first operation position, however, the body 51 of the operation lever 50 would conceal the entirety of the insertion slot 29. That is, the insertion slot 29 would be closed by the body 51 of the operation lever 50. Such a situation may occur if the opening 55 were not provided in the operation lever 50 in FIG. 46B.

In the removable unit 20, when the operation lever 50 is in the lying position, as shown in FIG. 46A, the insertion slot 29 is not covered by the operation lever 50 but is exposed to the exterior.

However, as shown in FIG. 42, when the operation lever 50 is in the lying position, the positioning contact member 273, which forms the driven portion 27, of the exposure device 23 is not in contact with the contact receiving surface 204*a* of the driving and storing portion 204 of the removable unit 20. Accordingly, the optical component 233 of the exposure device 23 is also in an unstable state. Additionally, when the operation lever 50 is in the lying position, the end of the removable unit 20 on the upstream side in the inserting direction D1 is lowered, and, the light-emitting structure 230 (such as the optical component 233) of the exposure device 23, as a whole, is inclined, as shown in FIG. 42.

As a result, it is difficult to stably and uniformly clean the tilting optical component 233 of the exposure device 23. It may be possible to take measures to stabilize the optical component 233. In this case, however, a dedicated holding mechanism or component is required, which is not very effective.

Accordingly, as shown in FIGS. 45, 46B, 39, and 10A through 10C, the opening 55 for allowing the cleaning device 90 to pass therethrough is provided in the body 51 of the operation lever 50. More specifically, the opening 55 is provided at a position which faces the insertion slot 29 on the side plate 201A when the operation lever 50 is raised in the standing position. The opening 55 is formed as, for example, a rectangular through-hole.

Figure 47A:
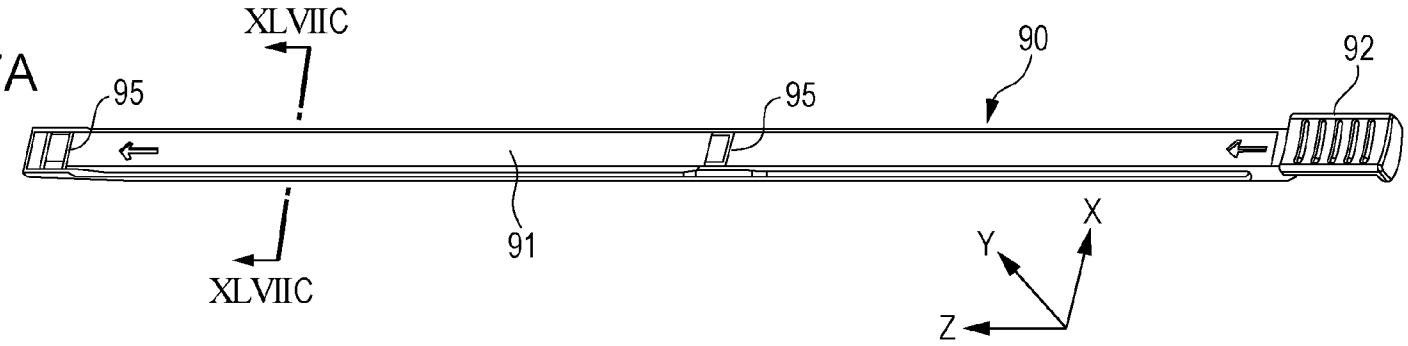
FIGS. 47A and 47B are perspective views respectively illustrating the front side and the back side of a cleaning device used in a removable unit.
Figure 47B:
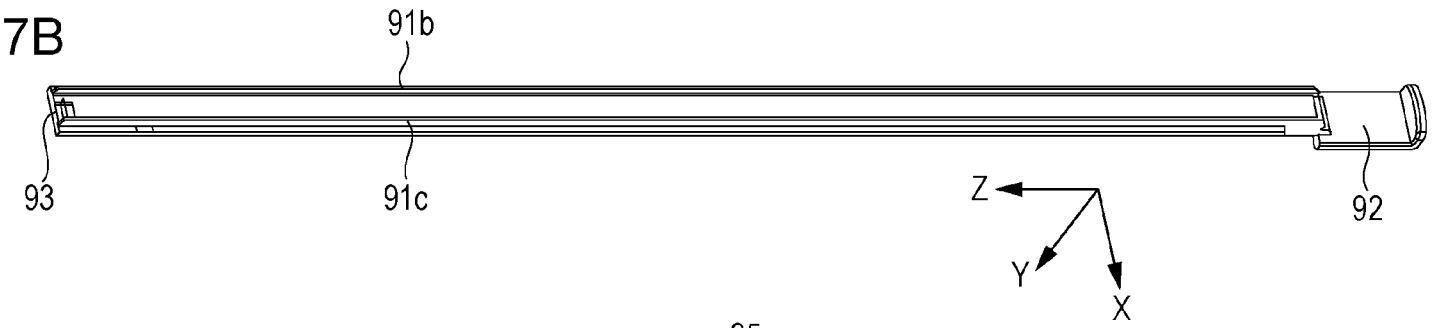
Figure 47C:
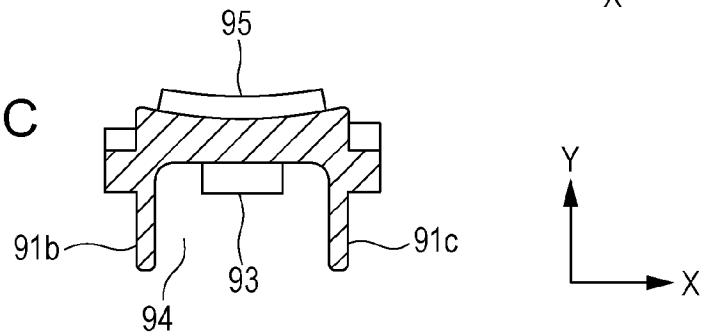
FIG. 47C is a sectional view illustrating the cleaning device taken along line XLVIIC-XLVIIC of FIG. 47A.

The cleaning device 90 includes, for example, a long, narrow plate-like body 91, a handle 92, and a cleaning member 93, as shown in FIGS. 47A through 47C. The handle 92 is provided at one end of the body 91. The cleaning member 93 is provided on the back side at the other end of the body 91 and cleans the surface of a subject, such as the optical component 233. The body 91 has a length by which the end thereof having the cleaning member 93 thereon can reach the entirety of a subject to be cleaned. The cleaning member 93 is made of a material suitable for a subject to be cleaned, for example, film.

In the cleaning device 90, as shown in FIGS. 47B and 47C, at both longitudinal ends of the body 91, back-side identifying side portions 91*b* and 91*c* extending from the back side are provided, and a space 94 is formed between the side portions 91*b* and 91*c*. On the front side of the body 91, cushioning members 95 are provided. By the provision of the cushioning members 95, it is possible to prevent unwanted contact of the body 91 with the photoconductor drum 21 which faces the optical component 233 and also to prevent the body 91 from being impaired.

In the operation lever 50, as shown in FIGS. 10A through 10C, at the center of the bottom side of the opening 55, a projection 56 is provided for preventing the cleaning device 90 from being inserted upside down. By the provision of the projection 56, recessed portions are formed at both sides of the projection 56 within the opening 55. The two side portions 91*b* and 91*c* of the cleaning device 90 are inserted into these recessed portions.

In the operation lever 50, a storage portion 58 is provided between the opening 55 of the body 51 and the bearing 52. The storage portion 58 stores unwanted substances discharged or dropped from the insertion slot 29 when the operation lever 50 is laid down in the lying position. The storage portion 58 is formed in a depressed shape when the operation lever 50 is in the lying position (FIGS. 36 and 41).

In the image forming apparatus 1, cleaning is performed for the optical component 233 of the exposure device 23 after images have been formed for a predetermined number of sheets or when the image forming apparatus 1 is checked upon the detection of a poor image quality.

Figure 46B:
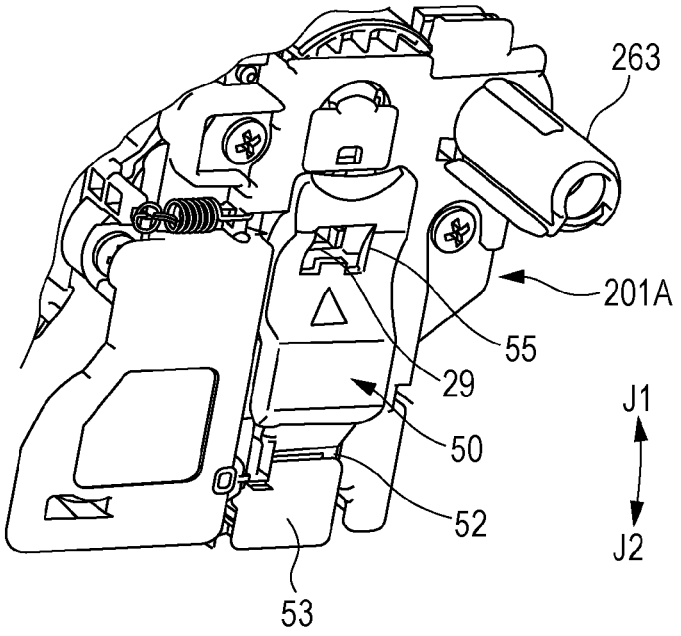
Figure 48:
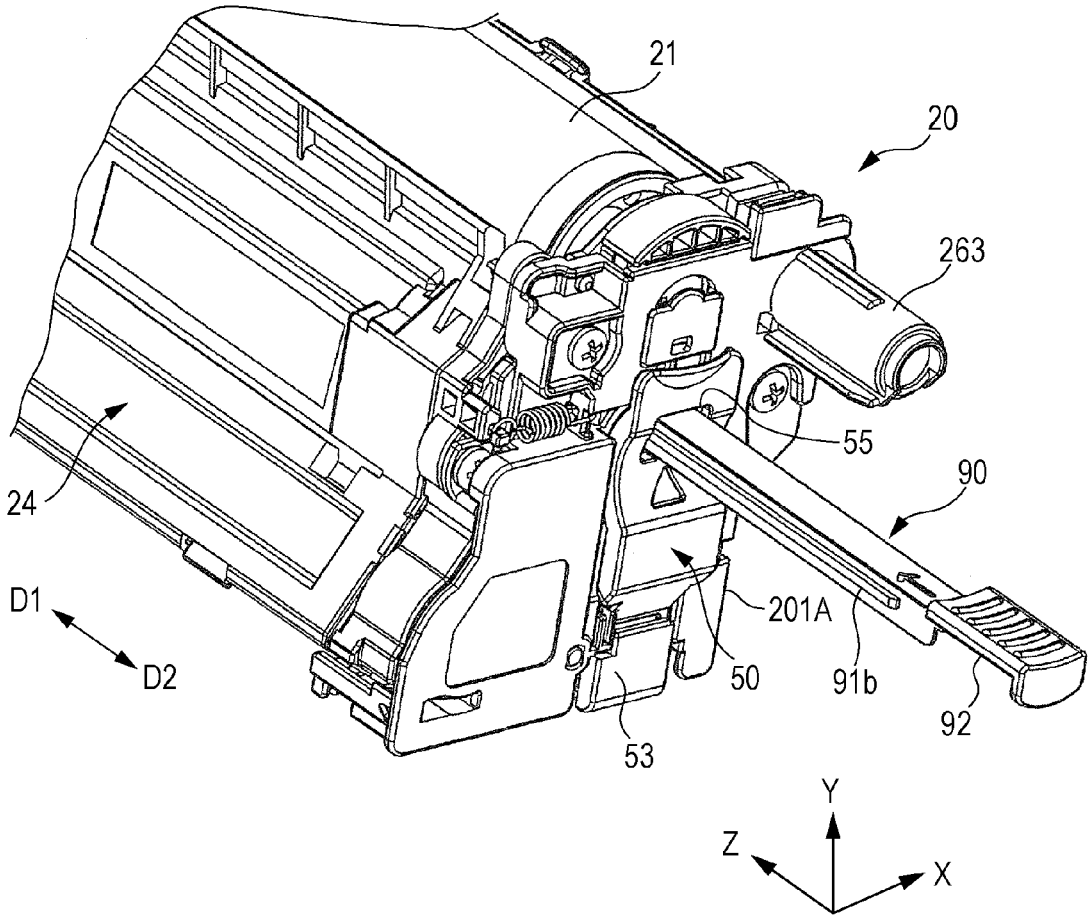
FIG. 48 is a perspective view illustrating a state in which cleaning is performed by inserting a cleaning device through an opening of the operation lever shown in FIG. 45.

Cleaning is performed while the operation lever 50 of the removable unit 20 mounted on the mounting unit 13 is in the standing position, as shown in FIGS. 45 and 48. In this case, as shown in FIG. 46B, the entire insertion slot 29 can be seen through the opening 55 of the operation lever 50.

Figure 49A:
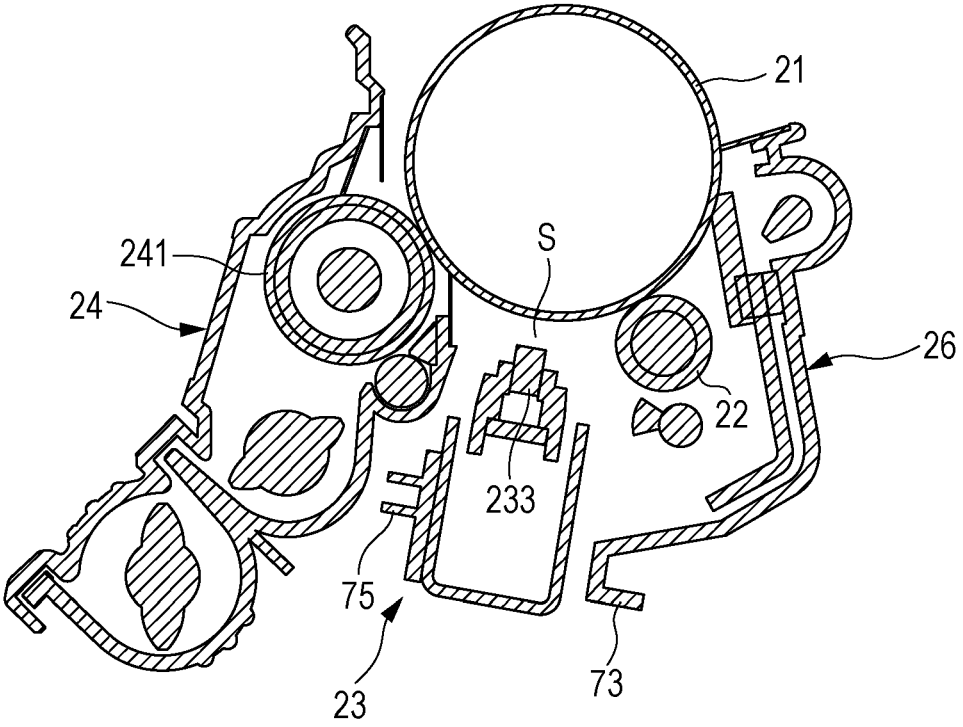
FIG. 49A is a sectional view illustrating an exposure device to be cleaned by a cleaning device and surrounding components.
Figure 49B:
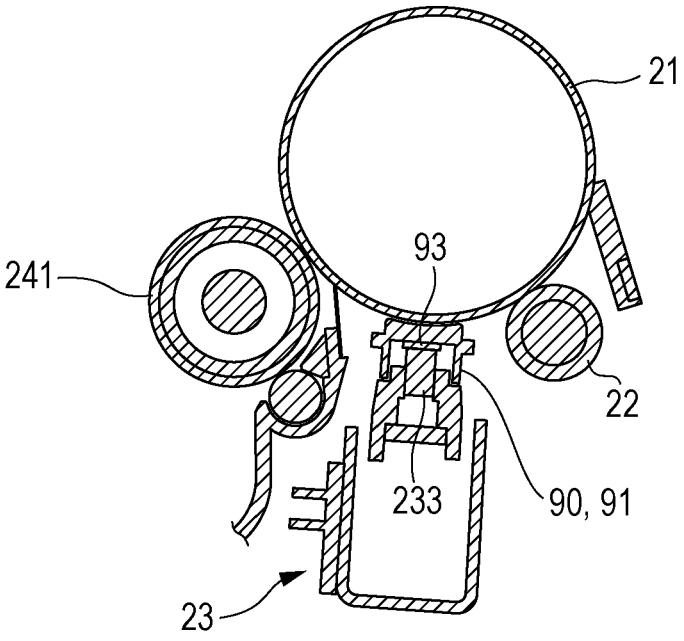
FIG. 49B is a sectional view illustrating a state in which the exposure device is cleaned by the cleaning device.

When performing cleaning, as shown in FIG. 48, the cleaning device 90 is inserted through the opening 55 of the operation lever 50, from the end having the cleaning member 93 thereon. As a result of this operation, the cleaning device 90 passes through the insertion slot 29 of the removable unit 20. Then, the body 91 and the cleaning member 93 of the cleaning device 90 enter the predetermined spacing S between the photoconductor drum 21 and the optical component 233 of the exposure device 23, as shown in FIG. 49A, and the cleaning member 93 advances while being in contact with the optical component 233 of the exposure device 23, as shown in FIG. 49B.

After the cleaning device 90 is inserted to the end of a subject to be cleaned, it is pulled toward the upstream side in the inserting direction D1 and is removed from the insertion slot 29 and the opening 55. Then, cleaning is finished. The moving direction of the cleaning device 90 is a direction substantially along the inserting direction D1 of the removable unit 20. Cleaning may be performed repeatedly if necessary, for example, the cleaning device 90 is reciprocated for a subject to be cleaned.

When cleaning is performed, the position of the removable unit 20 has already been fixed by shifting the operation lever 50 in the standing position. Accordingly, the predetermined spacing S between the photoconductor drum 21 of the removable unit 20 and the optical component 233 of the exposure device 23 is stably maintained. It is thus possible to stably and uniformly perform cleaning by using the cleaning device 90. During cleaning, the cleaning device 90 is moved while the cushioning members 95 on the front side of the body 91 are facing the photoconductor drum 21. The provision of the cushioning members 95 makes it possible to prevent the body 91 of the cleaning device 90 from accidentally contacting the photoconductor drum 21. Additionally, even if the cleaning device 90 is erroneously inserted upside down, the body 91 of the cleaning device 90 abuts against the projection 56 so as to be prevented from entering the opening 55. Thus, the optical component 233 of the exposure device 23 and the photoconductor drum 21 are prevented from being impaired by the erroneously inserted cleaning device 90.

By performing this cleaning operation, unwanted substances, such as toner, adhering to the optical component 233 of the exposure device 23 is removed by the cleaning member 93 of the cleaning device 90, and is extracted to the exterior when the cleaning device 90 is removed from the removable unit 20. In this case, the removed substances are extracted while still being adhering to the cleaning device 90. Even if the removed substances are dropped from the insertion slot 29 of the removable unit 20 when the cleaning device 90 is removed or the removable unit 20 is dismounted, it is caught in the storage portion 58 of the operation lever 50 positioned below the insertion slot 29 and is collected, as shown in FIGS. 32, 33, and 36. The cleaning device 90 is stored at a predetermined portion of the image forming apparatus 1 and is taken out of this portion and used when cleaning is performed.

Other Exemplary Embodiments

In the above-described exemplary embodiment, the exposure device 23 is constituted by the light-emitting structure 230 and the support structure 232, and the support structure 232 only is fixed to the mounting unit 13. However, the exposure device 23 may be formed as an integral device, and the integral exposure device 23 may be fixed to the mounting unit 13 (mounting table 131) such that it pivots in directions in which it approaches and separates from the photoconductor drum 21 of the removable unit 20.

The configuration of the driven portion 27 provided in the exposure device 23 and that of the driving portion 28 provided in the removable unit 20 are not restricted to those discussed in the above-described exemplary embodiment. For example, one of or both of the driven portion 27 and the driving portion 28 may be inclined upward or downward along the inserting direction D1 of the removable unit 20. In this case, as well as in the above-described exemplary embodiment, a member serving as the first pressing member, such as the leaf spring 274, may be built in or attached to the driven portion 27. A member serving as the first pressing member, such as the leaf spring 274, may be disposed in the driving portion 28.

The configuration of the removable unit 20 is not restricted to that discussed in the above-described exemplary embodiment. Any removable unit may be used as long as it has a photoconductor drum.

In the above-described exemplary embodiment, in the image forming apparatus 1, the four removable units 20Y, 20M, 20C, and 20K are removably mounted on the mounting unit 13. However, any number of removable units including a single removable unit may be removably mounted on the mounting unit 13. That is, the conditions, such as the type, of the image forming apparatus 1 are not particularly restricted as long as a removable unit having at least a photoconductor drum is used and the exposure device 23 is fixed to the mounting unit 13.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

a housing including a mounting unit;

a removable unit that includes at least a photoconductor drum and that is mounted on and dismounted from the mounting unit as a result of being inserted into and being removed from the mounting unit in a direction along an axial direction of the photoconductor drum; and an exposure device that includes a light-emitting source disposed along the axial direction of the photoconductor drum and that is fixed to the mounting unit in a state in which the exposure device pivots about a pivot point, which is provided on a downstream side in an inserting direction of the removable unit, in directions in which the exposure device approaches and separates from the photoconductor drum of the removable unit, wherein the exposure device includes a driven portion at an end on an upstream side in the inserting direction of the removable unit, the driven portion being driven so as to move the exposure device in a direction in which the exposure device approaches the photoconductor drum, and the removable unit includes a driving portion at the end on the upstream side in the inserting direction of the removable unit, the driving portion contacting the driven portion of the exposure device and driving the driven portion so as to move the exposure device in the direction in which the exposure device approaches the photoconductor drum.

2. The image forming apparatus according to claim 1, wherein a first pressing member is provided in the driven portion of the exposure device or in the driving portion of the removable unit, the first pressing member pressing the exposure device in the direction in which the exposure device approaches the photoconductor drum when the driven portion and the driving portion are in contact with each other.

3. The image forming apparatus according to claim 2, wherein:

the first pressing member is provided in the driven portion of the exposure device; and the removable unit includes a portion having a surface which is subjected to a pressing force of the first pressing member.

4. The image forming apparatus according to claim 1, wherein:

the exposure device includes a light-emitting structure and a support structure, the light-emitting source being provided in the light-emitting structure, the support structure being fixed to the mounting unit and supporting the light-emitting structure so that the light-emitting structure moves in directions in which the light-emitting structure approaches and separates from the photoconductor drum; and the driven portion is provided in the light-emitting structure, and the light-emitting structure is supported by the support structure so that the light-emitting structure moves by gravity in a direction in which the light-emitting structure separates from the photoconductor drum when the driven portion is not in contact with the driving portion.

5. The image forming apparatus according to claim 4, wherein the support structure includes a guiding portion which holds and guides the removable unit so that the photoconductor drum is not in contact with the light-emitting structure when inserting or removing the removable unit into or from the mounting unit.

6. The image forming apparatus according to claim 1, wherein:

when the removable unit has been inserted in the mounting unit, the end on the upstream side in the inserting direction of the removable unit is separated from a position at which the end on the upstream side in the inserting direction of the removable unit will be located, and the entirety of the removable unit is in a tilting state; and the inserting direction and a removing direction of the removable unit are set along a direction of the tilting state of the removable unit.

7. The image forming apparatus according to claim 6, wherein the removable unit includes a second pressing member, and, when the removable unit has been inserted in the mounting unit, the second pressing member presses the end on the upstream side in the inserting direction of the removable unit toward the position at which the end on the upstream side in the inserting direction of the removable unit will be located.

8. The image forming apparatus according to claim 1, further comprising:

an intermediate transfer body that is fixed to the mounting unit of the housing in a state in which the intermediate transfer body has been located, an image formed on the photoconductor drum of the removable unit being transferred to the intermediate transfer body, wherein, when the removable unit has been mounted on the mounting unit and has been located, the photoconductor drum is in contact with the intermediate transfer body.

* * * * *